US011181342B2

(12) United States Patent
Sammut et al.

(10) Patent No.: US 11,181,342 B2
(45) Date of Patent: Nov. 23, 2021

(54) APPARATUS AND METHOD FOR CALCULATING AIMING POINT INFORMATION

(71) Applicant: HVRT CORP., Orofino, ID (US)

(72) Inventors: Dennis J. Sammut, San Bruno, CA (US); Todd Hodnett, Arthur City, TX (US)

(73) Assignee: HVRT CORP., Orofino, ID (US)

( * ) Notice: Subject to any disclaimer, the term of this patent is extended or adjusted under 35 U.S.C. 154(b) by 0 days.

(21) Appl. No.: 16/657,422

(22) Filed: Oct. 18, 2019

(65) Prior Publication Data

US 2020/0049456 A1 Feb. 13, 2020

Related U.S. Application Data

(63) Continuation of application No. 15/685,132, filed on Aug. 24, 2017, now Pat. No. 10,451,385, which is a continuation of application No. 15/477,773, filed on Apr. 3, 2017, now Pat. No. 10,488,153, which is a continuation of application No. 15/018,507, filed on Feb. 8, 2016, now Pat. No. 9,612,086, which is a continuation of application No. 14/629,099, filed on Feb. 23, 2015, now Pat. No. 9,255,771, which is a continuation of application No. 13/800,078, filed on Mar. 13, 2013, now Pat. No. 8,959,824, which is a continuation of application No. PCT/US2013/020534, filed on Jan. 7, 2013.

(Continued)

(51) Int. Cl.

| | |
|---|---|
| ***F41G 1/38*** | (2006.01) |
| ***F41G 1/473*** | (2006.01) |
| ***F41G 3/08*** | (2006.01) |
| ***F41G 3/00*** | (2006.01) |

(52) U.S. Cl.

CPC ..... *F41G 1/38* (2013.01); *F41G 1/473* (2013.01); *F41G 3/00* (2013.01); *F41G 3/08* (2013.01)

(58) Field of Classification Search

CPC ... F41G 1/38; F41G 1/473; F41G 3/00; F41G 3/08

USPC ..... 42/122

See application file for complete search history.

(56) References Cited

U.S. PATENT DOCUMENTS

| | | | |
|---|---|---|---|
| 912,050 | A | 2/1909 | Wanee |
| 1,006,699 | A | 10/1911 | Straubel |

(Continued)

FOREIGN PATENT DOCUMENTS

| | | |
|---|---|---|
| CZ | 20024241 | 8/2004 |
| DE | 3401855 | 7/1985 |

(Continued)

OTHER PUBLICATIONS

"Horus Vision Scopes," Rifle Sporting Firearms Journal, pp. 20-24, No. 206, Mar. 2003, 6 pages.

(Continued)

*Primary Examiner* — Michelle Clement

(74) *Attorney, Agent, or Firm* — Casimir Jones, S.C.; Kirk J. Hogan

(57) ABSTRACT

The present invention relates to target acquisition and related devices, and more particularly to telescopic gunsights and associated equipment used to achieve shooting accuracy at, for example, close ranges, medium ranges and extreme ranges at stationary and moving targets.

19 Claims, 43 Drawing Sheets

Related U.S. Application Data

(60) Provisional application No. 61/585,074, filed on Jan. 10, 2012.

(56) References Cited

U.S. PATENT DOCUMENTS

| | | | |
|---|---|---|---|
| 1,107,163 | A | 8/1914 | Grauheding |
| 1,127,230 | A | 2/1915 | Grauheding |
| 1,190,121 | A | 7/1916 | Critchett |
| 1,406,620 | A | 2/1922 | Dear |
| 1,425,321 | A | 8/1922 | Etherington |
| 1,428,389 | A | 9/1922 | Miller |
| 1,540,772 | A | 6/1925 | Gibbs |
| 1,708,389 | A | 4/1929 | Karnes |
| 1,851,189 | A | 3/1932 | King |
| 2,094,623 | A | 10/1937 | Stokey |
| 2,150,629 | A | 3/1939 | Mossberg |
| 2,154,454 | A | 4/1939 | Joyce |
| 2,171,571 | A | 9/1939 | Karnes |
| 2,413,600 | A | 12/1946 | Bierman |
| 2,420,273 | A | 5/1947 | West |
| 2,450,712 | A | 10/1948 | Brown |
| 2,464,521 | A | 3/1949 | McCall |
| 2,486,940 | A | 11/1949 | Garber et al. |
| 2,615,252 | A | 10/1952 | Wing |
| 2,806,287 | A | 9/1957 | Sullivan |
| 2,807,981 | A | 10/1957 | Barnes |
| 2,823,457 | A | 2/1958 | Mihalyi |
| 2,891,445 | A | 6/1959 | Staubach |
| 2,949,816 | A | 8/1960 | Weaver |
| 2,952,180 | A | 9/1960 | Estes |
| 2,955,512 | A | 10/1960 | Kollmorgen et al. |
| 3,058,391 | A | 10/1962 | Leupold |
| 3,059,338 | A | 10/1962 | Coeytaux |
| 3,161,716 | A | 12/1964 | Burris et al. |
| 3,190,003 | A | 6/1965 | O'Brien |
| 3,229,370 | A | 1/1966 | Plisk et al. |
| 3,297,389 | A | 1/1967 | Gibson |
| 3,313,026 | A | 4/1967 | Akin, Jr. |
| 3,381,380 | A | 5/1968 | Thomas |
| 3,383,987 | A | 5/1968 | MacMillan |
| 3,386,330 | A | 6/1968 | Burris |
| 3,392,450 | A | 7/1968 | Herter et al. |
| 3,410,644 | A | 11/1968 | Mclendon |
| 3,431,652 | A | 3/1969 | Leatherwood |
| 3,464,770 | A | 9/1969 | Schmidt |
| 3,470,616 | A | 10/1969 | Thompson |
| 3,475,821 | A | 11/1969 | Huddleston |
| 3,492,733 | A | 2/1970 | Leatherwood |
| 3,506,330 | A | 4/1970 | Allen |
| 3,540,256 | A | 11/1970 | Thompson |
| 3,575,085 | A | 4/1971 | McAdam, Jr. |
| 3,638,321 | A | 2/1972 | Eglin |
| 3,682,552 | A | 8/1972 | Hartman |
| 3,684,376 | A | 8/1972 | Lessard |
| 3,694,095 | A | 9/1972 | Louthan |
| 3,743,818 | A | 7/1973 | Marasco et al. |
| 3,744,133 | A | 7/1973 | Fukushima et al. |
| 3,744,143 | A | 7/1973 | Kilpatrick |
| 3,749,494 | A | 7/1973 | Hodges |
| 3,777,404 | A | 12/1973 | Oreck |
| 3,782,822 | A | 1/1974 | Spence |
| 3,785,261 | A | 1/1974 | Ganteaume |
| 3,798,796 | A | 3/1974 | Stauff et al. |
| 3,826,012 | A | 7/1974 | Pachmayr |
| 3,876,304 | A | 4/1975 | Novak |
| 3,885,861 | A | 5/1975 | Farnsworth et al. |
| 3,902,251 | A | 9/1975 | Ross |
| 3,948,587 | A | 4/1976 | Rubbert |
| 3,960,453 | A | 6/1976 | Svensson et al. |
| 3,991,500 | A | 11/1976 | Kershner et al. |
| 4,014,482 | A | 3/1977 | Esker et al. |
| 4,102,053 | A | 7/1978 | Colwell |
| 4,172,662 | A | 10/1979 | Vogel |
| 4,200,355 | A | 4/1980 | Williams, Jr. |
| 4,218,834 | A | 8/1980 | Robertsson |
| 4,247,161 | A | 1/1981 | Unertl, Jr. |
| 4,248,496 | A | 2/1981 | Akin, Jr. et al. |
| 4,255,013 | A | 3/1981 | Allen |
| 4,263,719 | A | 4/1981 | Murdoch |
| 4,285,137 | A | 8/1981 | Jennie |
| 4,385,834 | A | 5/1983 | Maxwell, Jr. |
| 4,389,791 | A | 6/1983 | Ackerman |
| 4,395,096 | A | 7/1983 | Gibson |
| 4,403,421 | A | 9/1983 | Shepherd |
| 4,404,890 | A | 9/1983 | McAlpine |
| 4,408,842 | A | 10/1983 | Gibson |
| 4,458,436 | A | 7/1984 | Bohl |
| 4,497,548 | A | 2/1985 | Burris |
| 4,531,052 | A | 6/1985 | Moore |
| 4,561,204 | A | 12/1985 | Binion |
| 4,577,962 | A | 3/1986 | de Guillenschmidt et al. |
| 4,584,776 | A | 4/1986 | Shepherd |
| 4,616,421 | A | 10/1986 | Forsen |
| 4,618,221 | A | 10/1986 | Thomas |
| 4,627,171 | A | 12/1986 | Dudney |
| 4,671,165 | A | 6/1987 | Heidmann et al. |
| 4,695,161 | A | 9/1987 | Reed |
| 4,743,765 | A | 5/1988 | Ekstrand |
| 4,777,352 | A | 10/1988 | Moore |
| 4,787,739 | A | 11/1988 | Gregory |
| 4,806,007 | A | 2/1989 | Bindon |
| H613 | H | 4/1989 | Stello et al. |
| 4,833,786 | A | 5/1989 | Shores, Sr. |
| D306,173 | S | 2/1990 | Reese |
| 4,912,853 | A | 4/1990 | McDonnell et al. |
| 4,922,801 | A | 5/1990 | Jaquard et al. |
| 4,936,190 | A | 6/1990 | Pilcher, II |
| 4,949,089 | A | 8/1990 | Ruszkowski, Jr. |
| 4,957,357 | A | 9/1990 | Barns et al. |
| 4,965,439 | A | 10/1990 | Moore |
| 4,970,589 | A | 11/1990 | Hanson et al. |
| 4,977,677 | A | 12/1990 | Troescher, Jr. |
| 5,026,158 | A | 6/1991 | Golubic |
| 5,129,309 | A | 7/1992 | Lecuyer |
| 5,157,839 | A | 10/1992 | Beutler |
| 5,171,933 | A | 12/1992 | Eldering |
| 5,181,323 | A | 1/1993 | Cooper |
| 5,194,908 | A | 3/1993 | Lougheed et al. |
| 5,208,417 | A | 5/1993 | Langer et al. |
| 5,223,560 | A | 6/1993 | Cipolli et al. |
| 5,223,650 | A | 6/1993 | Finn |
| 5,275,354 | A | 1/1994 | Minor et al. |
| 5,285,273 | A | 2/1994 | Enoch et al. |
| 5,287,644 | A | 2/1994 | Bolduc |
| 5,375,072 | A | 12/1994 | Cohen |
| 5,454,168 | A | 10/1995 | Langner |
| 5,456,157 | A | 10/1995 | Lougheed et al. |
| 5,469,414 | A | 11/1995 | Okamura |
| 5,491,546 | A | 2/1996 | Wascher et al. |
| 5,577,733 | A | 11/1996 | Downing |
| 5,616,903 | A | 4/1997 | Springer |
| 5,631,654 | A | 5/1997 | Karr |
| 5,657,571 | A | 8/1997 | Peterson |
| 5,672,840 | A | 9/1997 | Sage et al. |
| 5,686,690 | A | 11/1997 | Lougheed et al. |
| 5,771,623 | A | 6/1998 | Pernstich et al. |
| 5,781,505 | A | 7/1998 | Rowland |
| D397,704 | S | 9/1998 | Reese |
| 5,824,942 | A | 10/1998 | Mladjan et al. |
| D403,686 | S | 1/1999 | Reese |
| 5,887,352 | A | 3/1999 | Kim |
| 5,920,995 | A | 7/1999 | Sammut |
| 5,949,015 | A | 9/1999 | Smith et al. |
| 5,960,576 | A | 10/1999 | Robinson |
| 5,966,859 | A | 10/1999 | Samuels |
| 5,974,940 | A | 11/1999 | Madni et al. |
| 6,000,163 | A | 12/1999 | Gordon |
| 6,025,908 | A | 2/2000 | Houde-Walter |
| 6,032,374 | A | 3/2000 | Sammut |
| 6,041,508 | A | 3/2000 | David |
| 6,058,921 | A | 5/2000 | Lawrence et al. |
| 6,064,196 | A | 5/2000 | Oberlin et al. |
| 6,174,288 | B1 | 1/2001 | Samuels |
| 6,247,259 | B1 | 6/2001 | Tsadka et al. |

(56) References Cited

U.S. PATENT DOCUMENTS 6,252,706 B1 6/2001 Kaladgew
6,269,580 B1 8/2001 Suzuki
6,269,581 B1 8/2001 Groh
6,357,158 B1 3/2002 Smith, III
6,363,223 B1 3/2002 Gordon
D456,057 S 4/2002 Smith, III
6,445,497 B1 9/2002 Adda
6,453,595 B1 9/2002 Sammut
6,499,382 B1 12/2002 Lougheed et al.
6,516,551 B2 2/2003 Gaber
6,516,699 B2 2/2003 Sammut et al.
6,539,661 B2 4/2003 Hope
6,568,092 B1 5/2003 Brien
D475,758 S 6/2003 Ishikawa
6,574,900 B1 6/2003 Malley
6,591,537 B2 7/2003 Smith
6,681,512 B2 1/2004 Sammut
6,729,062 B2 5/2004 Thomas et al.
6,772,550 B1 8/2004 Leatherwood
6,813,025 B2 11/2004 Edwards
6,862,832 B2 3/2005 Barrett
6,871,439 B1 3/2005 Edwards
6,886,287 B1 5/2005 Bell et al.
D506,520 S 6/2005 Timm et al.
D517,153 S 3/2006 Timm et al.
D522,030 S 5/2006 Jenkinson
D532,477 S 11/2006 Zaderey et al.
D536,762 S 2/2007 Timm et al.
7,171,775 B1 2/2007 Lacorte
7,171,776 B2 2/2007 Staley, III
7,185,455 B2 3/2007 Zaderey
D542,879 S 5/2007 Zaderey
D544,511 S 6/2007 Geurts
7,237,355 B2 7/2007 Smith, III
7,325,353 B2 2/2008 Cole et al.
D567,326 S 4/2008 Pride et al.
D567,896 S 4/2008 Pride et al.
7,584,570 B2 9/2009 Smith
7,603,804 B2 10/2009 Zadery et al.
7,685,760 B1 3/2010 Neumaster
D613,363 S 4/2010 Huber
7,705,975 B1 4/2010 Farris
7,724,416 B2 5/2010 Miller
7,748,155 B2 7/2010 Cole
7,806,331 B2 10/2010 Windauer et al.
7,832,137 B2 11/2010 Sammut
7,836,626 B2 11/2010 Shepherd
7,856,750 B2 12/2010 Sammut et al.
7,937,878 B2 5/2011 Sammut et al.
7,946,073 B1 5/2011 Buck
7,946,213 B2 5/2011 Quinn
7,958,643 B1 6/2011 Wu
8,056,281 B2 11/2011 Staley, III
8,109,029 B1 2/2012 Sammut et al.
8,230,635 B2 7/2012 Sammut et al.
8,286,384 B2 10/2012 Zaderey et al.
8,353,454 B2 1/2013 Sammut et al.
D679,776 S 4/2013 Bracken et al.
D679,777 S 4/2013 Bracken et al.
D680,187 S 4/2013 Bracken et al.
8,584,944 B2 11/2013 White et al.
8,656,630 B2 2/2014 Sammut et al.
D703,784 S 4/2014 Smith et al.
8,701,330 B2 4/2014 Tubb
8,707,608 B2 4/2014 Sammut et al.
D704,295 S 5/2014 Hodge et al.
D715,394 S * 10/2014 Young ..... D22/109
D715,395 S * 10/2014 Young ..... D22/109
8,893,423 B2 * 11/2014 Tubb ..... F41G 1/38 42/122
8,893,971 B1 11/2014 Sammut et al.
8,905,307 B2 12/2014 Sammut et al.
8,959,824 B2 2/2015 Sammut
8,966,806 B2 3/2015 Sammut et al.
8,991,702 B1 3/2015 Sammut et al.
9,068,799 B1 6/2015 Wu
9,121,672 B2 * 9/2015 Tubb ..... F41G 1/38
9,250,038 B2 2/2016 Sammut et al.
9,255,771 B2 2/2016 Sammut et al.
9,574,850 B2 2/2017 Sammut et al.
9,612,086 B2 4/2017 Sammut et al.
9,784,575 B2 10/2017 Senne
D803,973 S 11/2017 Kedairy
10,060,703 B2 8/2018 Sammut et al.
10,451,385 B2 10/2019 Sammut et al.
10,488,154 B2 11/2019 Sammut et al.
2002/0124452 A1 9/2002 Sammut
2002/0129535 A1 * 9/2002 Osborn, II ..... F41G 1/38 42/122
2002/0139030 A1 10/2002 Smith
2003/0145505 A1 * 8/2003 Kenton ..... F41G 1/38 42/135
2004/0016168 A1 * 1/2004 Thomas ..... F41G 1/38 42/122
2004/0020099 A1 * 2/2004 Osborn, II ..... F41G 1/38 42/122
2004/0088898 A1 5/2004 Barrett
2004/0244262 A1 12/2004 Paige
2005/0005495 A1 1/2005 Smith
2005/0213962 A1 * 9/2005 Gordon ..... F41A 33/00 396/502
2005/0229468 A1 * 10/2005 Zaderey ..... F41G 1/38 42/122
2005/0257414 A1 * 11/2005 Zaderey ..... F41G 1/38 42/122
2006/0048432 A1 * 3/2006 Staley, III ..... F41G 1/38 42/122
2006/0201046 A1 * 9/2006 Gordon ..... F41A 33/00 42/119
2006/0236586 A1 * 10/2006 Zaderey ..... F41G 1/38 42/133
2006/0260171 A1 * 11/2006 Cole ..... F41G 1/38 42/122
2007/0022651 A1 * 2/2007 Verdugo ..... F41G 1/345 42/130
2007/0137088 A1 * 6/2007 Peters ..... F41G 1/473 42/111
2008/0098640 A1 * 5/2008 Sammut ..... F41G 3/06 42/122
2008/0202011 A1 * 8/2008 Shepherd ..... F41G 1/44 42/130
2009/0183417 A1 * 7/2009 Smith, III ..... F41G 1/38 42/122
2009/0199451 A1 8/2009 Zaderey et al.
2010/0275768 A1 * 11/2010 Quinn ..... F41A 27/28 89/41.05
2011/0089238 A1 4/2011 Sammut et al.
2011/0107649 A1 * 5/2011 Buck ..... F41G 1/473 42/130
2011/0132983 A1 6/2011 Sammut et al.
2011/0296733 A1 * 12/2011 York ..... F41G 1/38 42/131
2012/0030988 A1 * 2/2012 Windauer ..... F41G 1/38 42/119
2013/0033746 A1 * 2/2013 Brumfield ..... G02B 23/105 359/401
2013/0070239 A1 * 3/2013 Crawford ..... G01S 17/66 356/139.04
2013/0160346 A1 * 6/2013 White ..... F41G 1/38 42/130
2014/0123533 A1 5/2014 Sammut
2014/0123534 A1 5/2014 Hodnett
2017/0268850 A1 9/2017 Sammut et al.
2018/0224243 A1 8/2018 Sammut et al.
2019/0017783 A1 1/2019 Sammut et al.

FOREIGN PATENT DOCUMENTS

DE 3834924 4/1990
DE 20008101 8/2000
EP 0147329 7/1985
EP 1443354 8/2004

(56) References Cited

FOREIGN PATENT DOCUMENTS

| | | | |
|---|---|---|---|
| GB | 517390 | | 1/1940 |
| GB | 2094950 | | 9/1982 |
| GB | 2294133 | | 4/1996 |
| JP | 55036823 | | 3/1980 |
| WO | WO 1996001404 | | 1/1996 |
| WO | WO 1997037193 | | 10/1997 |
| WO | WO 1998040688 | | 9/1998 |
| WO | WO 2002103274 | A2 | 12/2002 |
| WO | WO 2006060007 | A1 | 6/2006 |
| WO | WO 2013106280 | | 7/2013 |

OTHER PUBLICATIONS

"http://www.aircav.com/cobra/ballistic.html", printed Dec. 30, 2011, Ballistics, discussion of ballistics, interior, exterior, aerial, terminal and dispersion. 7 pages.
"http://www.hnsa.org/doc/firecontrol/partc.htm", printed Dec. 30, 2011, Fire Control Fundamentals Part C, Exterior Ballistics Part C, "The Projectile in Flight-Exterior Ballistics",pp. 1-26. 26 pages.
1996 Price List for Premier Reticles, 2 pages.
Barrett Firearms Mfg, Inc., 50 Scope Reticle, SR001, Oct. 30, 1986, 1 page.
Advertisement—Angle Cosine Indicator—Sniper Tools Design Company, http://www.snipertools.com/article.htm Oct. 14, 2004, 3 pages.
Advertisement—2003 New Products, Circle 132, 1 page.
Advertisement—CheyTac Technology Over Tradition, Technical White Papers, 2001-2003, 18 pages.
Advertisement—Custom "Sammut" (Patent Pending) Long Range; Custom Ammunition/ Berger Bullets, Ballistic Program, Data & Loading Instructions, Harris Gunworks, Inc.—Precision Shooting, 1997 Newsletter #2, 4 pages.
Advertisement—Digital Hunter, 2005, 1 page.
Advertisement—Eye of the Falcon Horus Vision, a Trag User's Manual for Palm-OS (2004), 13 pages.
Advertisement—Eye of the Falcon Horus Vision, PDA Users Manual (2002), 5 pages.
Advertisement—Guns & Weapons for Law Enforcement, Jul. 2003, p. 10, 1 page.
Advertisement—Guns & Weapons for Law Enforcement, Jul. 2003, p. 36, 1 page.
Advertisement—Horus Vision Introduces the All-New Rifle Scope Featuring the Horus Vision Reticle Aiming System Technology (2001), 5 pages.
Advertisement—Horus Vision Rifle Scope 4x-16x Rifle Scope, Hand-Held ATRAG1P Module, TRAGIS5 Digital Aiming System, Rifle Shooter, FN SPR-4 (Nov./Dec. 2003), 6 pages.
Advertisement—Law and Order, Oct. 2003, p. 124, 1 page.
Advertisement—Perry-Systems, 2002, 5 pages.
Advertisement—Precision Shooting, Apr. 1999, p. 74, 1 page.
Advertisement—Precision Shooting, Apr. 2001, 2 pages.
Advertisement—Precision Shooting, Aug. 2003, p. 31, 2 pages.
Advertisement—Precision Shooting, Aug. 2003, p. 97 2 pages.
Advertisement—Precision Shooting, Dec. 1999, 2 pages.
Advertisement—Precision Shooting, Dec. 2001, p. 36, 1 page.
Advertisement—Precision Shooting, Feb. 2000, 2 pages.
Advertisement—Precision Shooting, Feb. 2004, 2 pages.
Advertisement—Precision Shooting, Jun. 2000, p. 77, 2 pages.
Advertisement—Precision Shooting, May 2002, 1 page.
Advertisement—Precision Shooting, Sep. 2000, 2 pages.
Advertisement—S.W.A.T. Magazine 2003 Archives, May Issue. 1 page.
Advertisement—Sammut Reticle/Schmidt & Bender Custom Optics, Tactical Shooter, vol. 2, No. 5 (Jun. 1999), 3 pages.
Advertisement—Special Weapons p. 98 (2003) 1 page.
Advertisement—The Varmint Hunter Magazine, Oct. 2002, Issue 44, p. 152, 1 page.
Advertisement—Unleash the Power of Your Scope—Horus Vision Introduces the Horus Vision Digital Aiming System Technology (2003), 1 page.
Advertisement—Using Only Your Scope . . . Your Point-of-Impact is Guesswork, 1 page.
Aerodynamic Jump Caused by the Wind, http://bisonballistics.com/system/uploaded_files/9/original/aerodynamicJump_target.png, Bison Ballistics, printed Dec. 30, 2011. 1 page.
BW Optic—Y Tac Reticle—Precision European Optics, dated Aug. 3, 2004, 4 pages.
Chung, Gregory K. W. K., Nagashima, Sam 0., Delacruz, Girlie C., Lee, John J., Wainess, Richard and Baker, Eva L., Review of Rifle Marksmanship Training Research, Cresst Report 783, The National Center for Research on Evaluation, Standards, and Student Testing, Jan. 2011, 105 pages.
Cutshaw, Charlie, "DPMS Panther LR .308: Long Range Accurate and Reliable at a Price that Can't Be Beat," Special Weapons, pp. 50-55 (2004), 7 pages.
Cutshaw, Charlies, "The Ed Brown Custom M702 Tactical Rifle," The Accurate Rifle, vol. 6, No. 9, pp. 38-42 (Oct. 2003) 5 pages.
Davis, American Rifleman, Mar. 1989, 1 page.
Defendants' Amended Answer to Complaint and Amended Counterclaims submitted in United States District Court, Northern District of California, San Francisco Division Case No. 3:13-cv-05460-BLF-HRL on May 19, 2014, 12 pages.
Fortier, David, "Horus—The Avenger System," S.W.A.T., pp. 24-29 (May 2003), 7 pages.
Gottfredson, Jacob, "Optics—Sammut Custom Reticle: A Sighting System for the Long-Range Specialist," Tactic Shooter, vol. 3, No. 9, pp. 34-39 (Oct. 2000) 8 pages.
Gottfredson, Jacob, "The .338 Edge By Defensive Edge," The Accurate Rifle, vol. 6, No. 9, pp. 38-42 (Oct. 2003). At Least One IDS Cites as: Gottfredson, Jacob, "The .338 Edge By Defensive Edge," The Accurate Rifle, vol. 5, No. 14-21 (Oct. 2003) 9 pages.
Gun World, pp. 15-16 (Jan. 2003) 1 page.
Johnson, Richard F., Statistical Measures of Marksmanship, USARIEM Technical Note TN-01/2, U.S. Army Research Institute of Environmental Medicine, Feb. 2001, 27 pages.
Jonathan M. Weaver, Jr., LTC, USA Ret., Infantry, System Error Budgets, Target Distributions and Hitting Performance Estimates for General-Purpose Rifles and Sniper Rifles of 7.62x51 mm and Larger Calibers, AD-A228 398, TR-461, AMSAA, May 1990, 175 pages.
Kent, R.H. and E.J. McShane, An Elementary Treatment of the Motion of a Spinning Projectile About it's Center of Gravity, Aberdeen Proving Grounds ("APG"), MD, BRL Memorandum Report No. 85, Apr. 1944, 37 pages.
Leupold Ballistic Reticle System: Varmint Hunter's Reticle, Effective Jan. 1, 2004, 1 page.
Military Handbook: Range Facilities and Miscellaneous Training Facilities Other than Buildings, http://www.everyspec.com, MIL-HDBK-1027/3A, Jan. 31, 1989, 148 pages.
Military Specification: Propellants for Small Arms Ammunition, http://www.everyspec.com, MIL-P-3984J Amendment 3, Jun. 12, 2000, 11 pages.
Military Specification: Rifle, 7.62MM, Sniper w/Day Optical Sight and Carrying Cases, M24, http://www.everyspec.com, MIL-R-71126 (AR), Sep. 24, 1992, 53 pages.
New fire-control computers entering Army service—Janes International Defense Review—first posted to http:// idr.janes.com—Aug. 21, 2003, 1 page.
Northwinds Flags, RFC-USBR Windrose, https://sites.google.com/a/wildblue.net/northwind-flags/home/Wind-Rose-2.jpg, printed Dec. 30, 2011, 1 page.
Pejsa, Art, "The Quiet Revolution in Precision Rifle Ballistics," The Varmint Hunter Magazine, Issue 50, pp. 78, 96, 105 (Apr. 2004) 4 pages.
Performance Specification: Rifle, 7.62MM; Semi-Automatic Sniper System (SASS)-M110, MIL-PRF-32316 (W/ Amendment 1), Oct. 5, 2009, 34 pages.
Polacek, Don, "Inside Product News—Leupold Illuminated Reticle Scopes," Rifle Sporting Firearms, Issue 186 (Nov. 1999), 1 page.
Precision Shooting, pp. 71-72 (Jun. 2003), 2 pages.
Press Release: Horus Vision Reticle Aiming System Eliminates Guesswork, The Varmint Hunter Magazine, Issue 44 (Oct. 2002), p. 152, 1 page.

(56) References Cited

OTHER PUBLICATIONS

Rifle Marksmanship M16A1, M16A2/3, M16A4, and M4 Carbine, C 4, FM 3-22.9, Department of the Army, Sep. 13, 2006, 116 pages.
Rifle Shooter FN SPR-4, pp. 52-53, Nov./Dec. 2003, 4 pages.
Sammut, Dennis J., "The Long Shot: A First Person Account," Accurate Rifle, vol. 3, No. 10, pp. 53-58 (Nov. 2000)—Drafted May 1, 2000, 7 pages.
Schatz, The Long Range Rifle System That Never Was, Tactical Shooter, Feb. 2000, pp. 28-33, 9 pages.
Smith, T.D., TDS Tri-Factor, "A Clear Shot; A Clear Kill," 1992. 21 pages.
The Accurate Rifle, pp. 40-41 (Oct. 2003), 2 pages.
Tradoc Bulletin 3 on the Soviet RPG-7 Antitank Grenade Launcher (Nov. 1976), 43 pages.
US Army FM-23-10, Sniper Training, United States Army Infantry School ATSH-INS3, Fort Benning, GA 31905-5596, Aug. 1994, 327 pages.
USMC MCWP 3-15.3 (formerly FMFM 1-3B), Sniping, PCN 143 000118 00, Doctrine Division (C42) US Marine Corps Combat Development Command, 2 Broadway Street Suite 210 Quantico, VA 22134-5021, May 2004, 203 pages.
Van Zwoll, Wayne, "It's a Wide-Open Field," Guns & Ammo, pp. 62-67 (May 2003), 7 pages.
Van Zwoll, Wayne, "Varmint Scopes: High-Power Optics Let You Look Rodents in the Eye," Rifle Shooter, pp. 22-25 (Jul./Aug. 2003), 5 pages.
Von Wahlde, Raymond & Metz, Dennis, Sniper Weapon Fire Control Error Budget Analysis, US Army ARL-TR-2065, Aug. 1999—arl.army.mil, pp. 1-75, 85 pages.
Defendant Leupold & Stevens, Inc.'s Disclosure of Invalidity and Non-Infringement Contentions No. 3:17-cv-01153-AC Jan. 8, 2018. 31 pages.
Defendant Leupold & Stevens, Inc.'s Amended Disclosure of Invalidity and Non-Infringement Contentions No. 3:17-cv-01153-AC Apr. 17, 2018. 23 pages.
2002 Premier Reticles, Ltd. Pricing and Information. LEUPOLD008162-LEUPOLD008182, 21 pages.
U.S. Army Human Engineering Laboratory, Sights for Light AntiTank Weapons, Technical Memorandum 11-76 ("TM 11-76") Apr. 1976. LEUPOLD008185-LEUPOLD008411, 227 pages.
War Department, Auxiliary Fire-Control Instruments (Field Glasses, Eyeglasses, Telescopes, and Watches—Technical Manual TM 9-575 ("TM 9-575") May 4, 1942. LEUPOLD007803-LEUPOLD007827, 25 pages.
War Department, Telescope Mounts M21 and M23; Panoramic Telescopes M5A3 and M12A2; Range Quadrant M4; Elbow Telescope m16; and Instrument Light M5—TM 9-1551 ("TM 9-1551") May 4, 1942. LEUPOLD008412-LEUPOLD008471, 60 pages.
Department of the Army, 90 MM Recoilless Rifle, M67—FM 23-11 ("FM 23-11") Jul. 1965. LEUPOLD007732-LEUPOLD007802, 71 pages.
Department of the Army, Operation and Organizational Maintenance Cal. 50 Spotting Rifle M8C 106-MM Rifles M40A1 and M40A1C; 105-MM Rifle Mounts T173 and M79; and Tripod T26—Technical Manual, TM9-1000-205-12 ("TM9-1000-205-12") Mar. 1959. LEUPOLD010065-LEUPOLD010067, 3 pages.
Michael Haugen, User Guide For Mil-Dot Equipped Optics ("Mil-Dot User Guide") 2002. LEUPOLD008653-LEUPOLD008670, 18 pages.
D. Andrew Kopas, Handbook of Standard Reticle Patterns by Manufacturer ("2009 Reticle Handbook") Issued Oct. 22, 2005, updated Jan. 3, 2009 Version 5. LEUPOLD008691-LEUPOLD008757, 67 pages.
Dale A. Kopas, Catalogue of Standard Reticle Patterns by Manufacturer ("2005 Reticle Handbook") Issued Oct. 22, 2005, updated Dec. 15, 2005.LEUPOLD007692-LEUPOLD007731, 40 pages.
Department of the Army, Elementary Optics and Application to Fire Control Instruments—TM 9-258 ("1977 Army Manual") Dec. 1977. LEUPOLD007830-LEUPOLD008056, 227 pages.
Bushnell, Bushnell 1969 Dealer Catalogue LEUPOLD008671-LEUPOLD008686, 16 pages.
1997 Premier Reticles, Ltd. Price List LEUPOLD008183-LEUPOLD008184, 2 pages.
Bushnell, Bushnell Bore Sighter 1969. LEUPOLD008687-LEUPOLD008690, 4 pages.
Barrett, Barrett Reticle, 1986. LEUPOLD010068, 1 page.
Type 97/99 Sniper Rifle and Reticle ("Type 97/99 Reticle") 1930s LEUPOLD010077-LEUPOLD010096, 20 pages.
Sherman Firefly Reticle,~1950s LEUPOLD010069, 1 page.
Leupould, CMR-W Grid Reticle, 2012. LEUPOLD007653, 1 page.
Horus, Horus Reticles include H1, H2, H3, H4, H5, H12, H19, H21, H25, H31, H39, H45, H48, H70, and other reticles and/or prototypes sold, offered for sale, or manufactured by Horus and associated entities. Pre-2005. LEUPOLD009797-LEUPOLD009853, 52 pages.

* cited by examiner

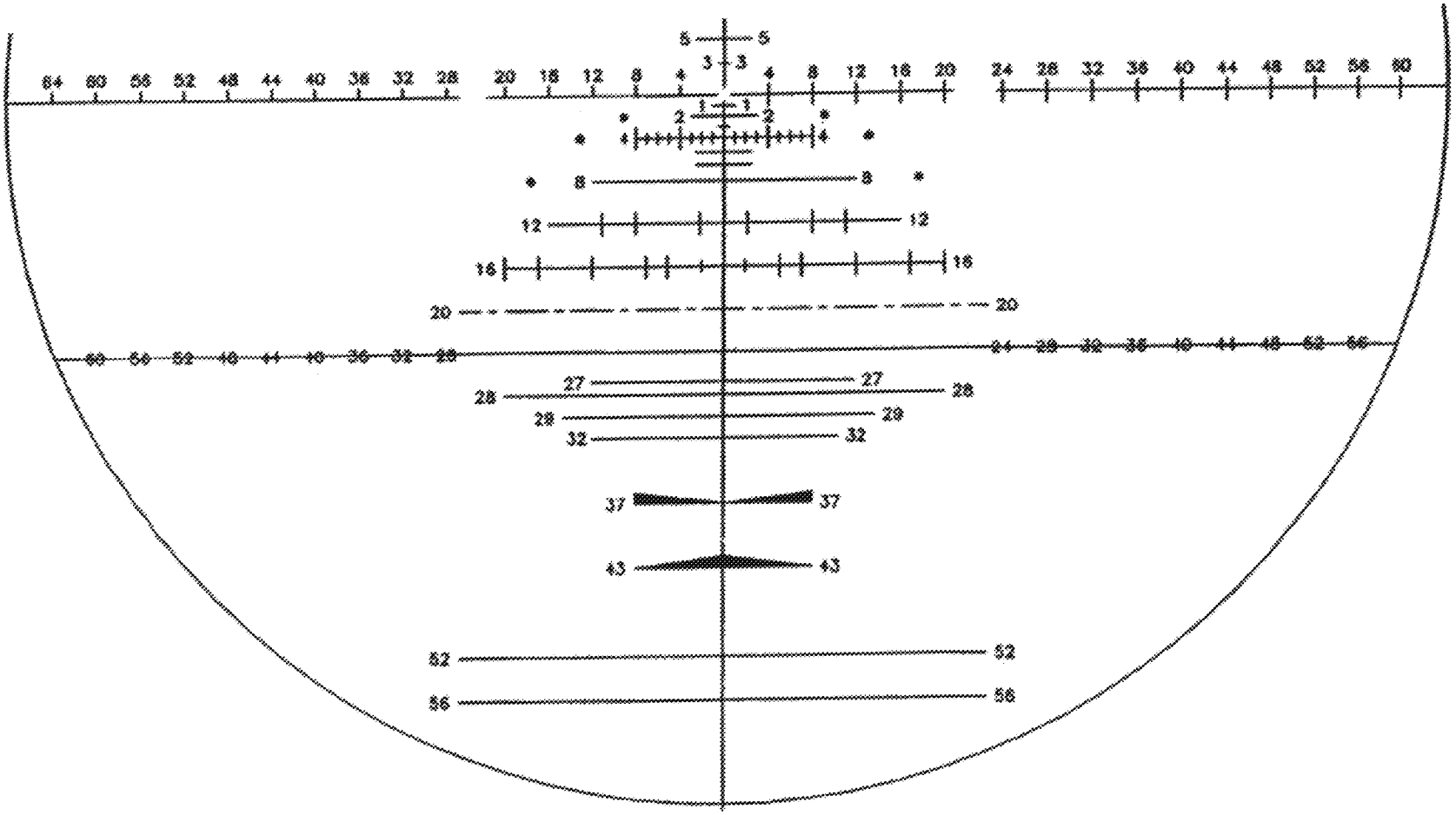
FIG. 14Aii

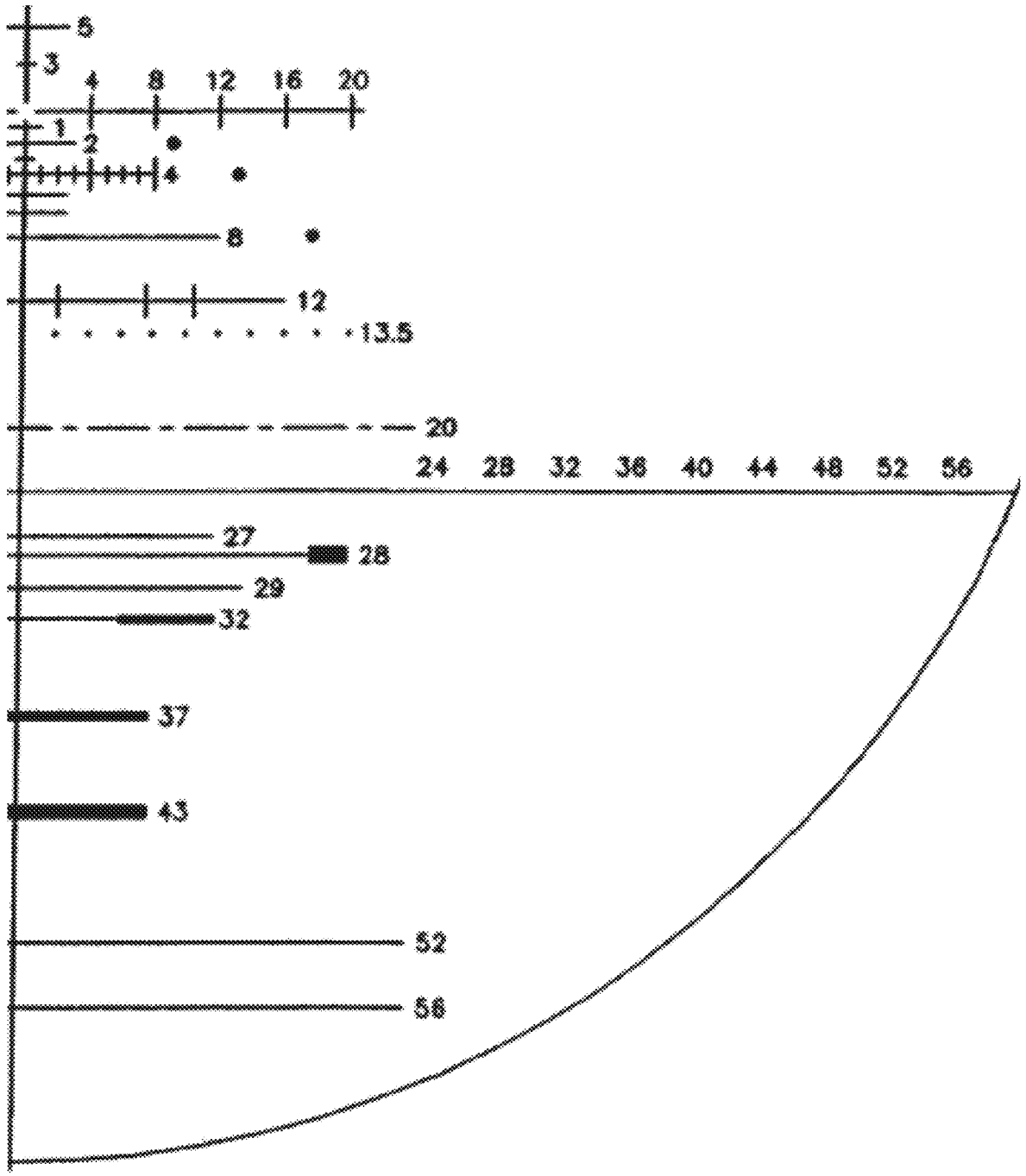
FIG. 14Bii

APPARATUS AND METHOD FOR CALCULATING AIMING POINT INFORMATION

CROSS-REFERENCE TO RELATED APPLICATIONS

This application is a continuation of U.S. patent application Ser. No. 15/685,132, filed Aug. 24, 2017, which is a continuation of U.S. patent application Ser. No. 15/477,773, filed Apr. 3, 2017, which is a continuation of U.S. patent application Ser. No. 15/018,507, filed Feb. 8, 2016, now U.S. Pat. No. 9,612,086, issued Apr. 4, 2017, which is a continuation of U.S. patent application Ser. No. 14/629,099, filed Feb. 23, 2015, now U.S. Pat. No. 9,255,771, issued Feb. 9, 2016, which is a is a continuation of U.S. patent application Ser. No. 13/800,078, filed Mar. 13, 2013, now U.S. Pat. No. 8,959,824, issued Feb. 24, 2015, which is a continuation of international patent application PCT/US2013/020534, filed on Jan. 7, 2013 designating the U.S., and claims priority to U.S. Provisional Application Ser. No. 61/585,074 filed Jan. 10, 2012, the entirety of each are incorporated by reference herein.

FIELD OF THE INVENTION

The present invention relates to target acquisition and related devices, and more particularly to telescopic gunsights and associated equipment used to achieve shooting accuracy at, for example, close ranges, medium ranges and extreme ranges at stationary and moving targets.

BACKGROUND OF THE INVENTION

All shooters, whether they are police officers, soldiers, Olympic shooters, sportswomen and sportsmen, hunters, plinkers or weekend enthusiasts have one common goal: hitting their target accurately and consistently. Accuracy and consistency in shooting depend in part on the skill of the shooter and on the construction of the firearm and projectile. At long ranges, for example, in excess of 500 yards, the skill of the shooter and the consistency of the ammunition are often not enough to insure that the shooter will hit the target. As range increases, other factors can affect the flight of the bullet and the point of impact down range.

One of these factors is "bullet drop". "Bullet drop" is caused by the influence of gravity on the moving bullet, and is characterized by a bullet path which curves toward earth over long ranges. Therefore to hit a target at long range, it is necessary to elevate the barrel of the weapon, and the aiming point, to adjust for bullet drop. Other factors, such as wind, Magnus effect (i.e., a lateral thrust exerted by wind on a rotating bullet whose axis is perpendicular to the wind direction), projectile design, projectile spin, Coriolis effect, and the idiosyncrasies of the weapon or projectile can change the projectile's path over long range. Such effects are generally referred to as "windage" effects. Therefore, for example, to hit a target at long range, it may be necessary to correct for windage by moving the barrel of the weapon slightly to the left or the right to compensate for windage effects. Thus, for example, in order to hit a target at long range, the shooter must see the target, accurately estimate the range to the target, estimate the effect of bullet drop and windage effects on the projectile, and use this information to properly position the barrel of the firearm prior to squeezing the trigger.

Conventional telescopic target acquisition devices are not generally useful at long ranges in excess of 400-800 yards. At close ranges less than 100 yards conventional target acquisition devices generally fall short when extreme accuracy is desired. Modifications to this basic system have not, thus far, enabled a skilled shooter firing at long ranges to acquire and hit a target quickly and reliably, regardless of the weapon used (assuming always that the firearm is capable of reaching a target at the desired long range). Accordingly, the need exists for a target acquisition device having a reticle which permits a skilled shooter to rapidly and accurately identify the range to any target of known or estimable size, no matter how large or small, and to make fast and accurate adjustment for projectile drop and windage.

SUMMARY OF THE INVENTION

The present invention provides reticles that provide means for selecting aiming points that accurately target an intended target at any desired range, including extreme distances. In particular, the reticles of the present invention provide markings or other indications that allow a user, for example, to associate a first aiming point of the reticle with an intended target (e.g., the aiming point created by the cross-section of primary vertical and horizontal cross-hairs), and to identify a second aiming point (e.g., identified by a generated aiming dot, an electronic aiming dot, or an aiming point created by secondary vertical and/or horizontal cross-hairs) that represents a point to insure an accurate shot to hit the target.

In one embodiment, the present invention provides a reticle for use in any target acquisition device, fixed power scope or a variable power telescopic gunsight, image amplification device, or other aiming device. In some embodiments, the reticle comprises a substantially transparent disc, although the present invention is not limited to the use of disc shaped reticles, or to substantially transparent reticles, or to electronically generated reticles. In some embodiments, the reticle has an optical center and an edge for mounting said reticle in a housing (e.g., between an objective lens and the ocular lens of a scope), one or more aiming points positioned on said reticle, wherein the aiming points are formed by a primary vertical cross-hair intersecting the optical center of the reticle, a primary horizontal cross-hair intersecting said primary vertical cross-hair to form an upper right sector (e.g., quadrant), an upper left sector, a lower right sector, and a lower left sector, a plurality of secondary horizontal cross-hairs at predetermined distances along said primary vertical cross-hair, and a plurality of secondary vertical cross-hairs at predetermined distances along at least some of said secondary horizontal cross-hairs. The cross-hairs may be of any length, any width, and may comprise contiguous lines or may have gaps. In some embodiments, the secondary horizontal and vertical cross-hairs comprise intersecting continuous lines. In other embodiments, the secondary horizontal and vertical cross-hairs comprise intersecting dis-continuous lines. In further embodiments, the cross-hairs comprise a pillar connecting, for example, the cross-hair to the circumference of the reticle with a line of different thickness. In some embodiments, at least one intersecting cross-hair crosses beyond at least one other cross-hair. In other embodiments, at least one intersecting cross-hair contacts but does not cross at least one other cross-hair. In further embodiments, primary and secondary cross-hairs comprise triangles, circles, squares, straight lines, curved lines, arcs, solid dots, hollow dots, numbers, letters, crosses, stars, solid shapes, hollow shapes, or shapes in silhouette in a linear or curvilinear orientation to one another.

In one embodiment, unique markings (e.g., numbers) identify at least some of the secondary cross-hairs. In a further embodiment, the primary horizontal cross-hair intersects that primary vertical cross-hair at the optical center of the reticle. In another embodiment, the primary horizontal cross-hair intersects that primary vertical cross-hair below the optical center of the reticle. In a preferred embodiment, the primary horizontal cross-hair intersects that primary vertical cross-hair above the optical center of the reticle. In a yet further embodiment, the plurality of secondary horizontal cross-hairs are evenly spaced at predetermined distances along the primary vertical cross-hair. In another embodiment, at least some of the secondary horizontal cross-hairs are unevenly spaced at predetermined distances along the primary vertical cross-hair. In a still further embodiment, two or more secondary vertical cross-hairs are evenly spaced at predetermined distances along at least some of the secondary horizontal cross-hairs. In another embodiment, at least some of the secondary vertical cross-hairs are unevenly spaced at predetermined distances along the primary horizontal cross-hair. In yet another embodiment, the reticle additionally includes range-finding markings on the reticle. The range finding markings may be in one of the sectors formed by the primary vertical and horizontal cross-hairs, or may be on the primary vertical or horizontal cross-hairs, or on the secondary vertical or horizontal cross-hairs. In some embodiments, the primary or secondary cross-hairs themselves are used as range-finder markings.

In still further embodiments, the reticle is optionally illuminated for day use, for twilight use, for night use, for use in low or absent ambient light, or for use with or without night vision. In yet a further embodiment, illuminated dots at, for example, even or odd Mil Radian spacing are separately illuminated in the shooter's field of vision.

In a preferred embodiment, reticles of the present invention are constructed from an optically transparent wafer or electronically generated disc having an optical center that coincides with a center of a field of vision when the wafer is mounted in a scope. In one embodiment, a primary vertical cross-hair having a predetermined thickness bisects the disc, intersecting the optical center of the disc, or intersecting at a point offset from the optical center of the disc. In another embodiment, a primary horizontal cross-hair having a predetermined thickness intersects the primary vertical cross-hair, most preferably above the optical center of the disc, to form an upper right sector (e.g., quadrant), an upper left sector, a lower right sector, and a lower left sector. Two or more secondary horizontal cross-hairs having predetermined thickness are spaced along the primary vertical cross-hair. In a particularly preferred embodiment, at least some of these secondary horizontal cross-hairs are identified with a unique identifier, to aid the shooter in calibrating the horizontal cross-hairs by range, and in locating the appropriate horizontal cross-hair to use in selecting an aiming point and to communicate with, for example, a spotter. A plurality of secondary vertical cross-hairs having predetermined thickness and configurations are spaced along at least some of said secondary horizontal cross-hairs to aid in making accurate windage adjustments. In a further embodiment separate range-finding means are positioned on the reticle to aid the shooter in determining the range to target. In a still further embodiment, the shooter uses the distance subtended by the vertical or horizontal lines to calculate the range to the target.

The reticles of the present invention may be made of any suitable material. The reticles may have any suitable markings that permit use as described above and elsewhere herein. The markings may be generated by any means, including, but not limited to, engravings, etchings, projections, wires, digital or analog imaging, raised surfaces (e.g., made of any desired material), etc. The reticles may be used in any type of device where there is use for secondary or multiple aiming points. The reticles may be used in conjunction with one or more additional components that facilitate or expand use (e.g., ballistic calculators, devices that measure exterior factors, meteorological instruments, azimuth indicators, compasses, chronographs, distance ranging devices, etc.).

In one embodiment, the present invention provides an improved target acquisition device using the reticles of the present invention. In some embodiments, the target acquisition device has one or more of a housing, a means for mounting a housing in a fixed, predetermined position relative to a gun barrel, an objective lens mounted in one end of the housing, and an ocular lens mounted in the opposite end of the housing. In some embodiments, the target acquisition device is a fixed power telescopic gunsight, or a variable power telescopic gunsight. When optics are mounted in the housing to permit the power to be varied along a predetermined range, the reticle is most preferably mounted between the objective lens and the variable power optics, although all configurations are contemplated by the present invention. The reticle may be configured in a target acquisition device in any desired focal plane (e.g., first focal plane, second focal plane, or a combination of both), or incorporated into a fixed power telescopic gunsight. In a further embodiment, the reticles of the present invention are incorporated for use in, for example, electronic target acquisition and aiming devices.

While the reticles of the present invention find use in long-range target acquisition devices they can be used with equal effectiveness at close and medium ranges. In one embodiment, the reticles of the present invention are adapted for use in a mid-range telescopic gunsight, or close range telescopic gunsight, or other device. A mid-range reticle, similar to the long-range reticle described above, is constructed in accordance with this invention. Since the mid-range reticle requires less field area, in some embodiments, the primary horizontal cross-hair can be conventionally positioned at the optical center of the reticle. The mid-range reticle can then be calibrated and used in the same manner as a long-range reticle.

In yet another embodiment, a portion of the primary vertical cross-hair or the primary horizontal cross-hair, or both, is provided with rangefinder markings to eliminate the need for a separate rangefinder means in one of the sectors formed by the intersection of the primary vertical and horizontal cross-hairs.

In one embodiment, the reticle markings are assigned range and distance values, for example, by using a computing device containing a ballistics calculator program which receives information regarding external/environmental field conditions (e.g., date, time, temperature, relative humidity, target image resolution, barometric pressure, wind speed, wind direction, hemisphere, latitude, longitude, altitude), firearm information (e.g., rate and direction of barrel twist, internal barrel diameter, internal barrel caliber, and barrel length), projectile information (e.g., projectile weight, projectile diameter, projectile caliber, projectile cross-sectional density, one or more projectile ballistic coefficients (as used herein, "ballistic coefficient" is as exemplified by William Davis, *American Rifleman*, March, 1989, incorporated herein by reference), projectile configuration, propellant type, propellant amount, propellant potential force, primer, and muzzle velocity of the cartridge), target acquisition device and reticle information (e.g., type of reticle, power of magnification, first, second or fixed plane of function, distance between the target acquisition device and the barrel, the positional relation between the target acquisition device and the barrel, the range at which the telescopic gunsight was zeroed using a specific firearm and cartridge), information regarding the shooter (e.g., the shooter's visual acuity, visual idiosyncrasies, heart rate and rhythm, respiratory rate, blood oxygen saturation, muscle activity, brain wave activity, and number and positional coordinates of spotters assisting the shooter), and the relation between the shooter and target (e.g., the distance between the shooter and target, the speed and direction of movement of the target relative to the shooter, or shooter relative to the target (e.g., where the shooter is in a moving vehicle), and direction from true North), and the angle of the rifle barrel with respect to a line drawn perpendicularly to the force of gravity).

In one embodiment, the output of a ballistics program is selected to produce aiming point information for a specific target at a known range, or multiple targets at known or estimable ranges. In a further embodiment, the target acquisition device is a conventional telescopic gunsight comprising a reticle of the present invention in which the scope is adjusted to hit a target at range by rotating horizontal and vertical adjustment knobs a calculated number of "clicks". In a further embodiment, the telescopic gunsights include all varying designs of telescopic gunsights apparent to one skilled in the art, for example, telescopic gunsights manufactured and marketed by Leupold, Schmidt-Bender, Swarovski, Burris, Bushnell, Zeiss, Nikon, Kahles Optik, and Nightforce. In a preferred embodiment, the telescopic gunsight contains a reticle of the present invention in which the specific aiming point for the target is identified by reference to the calibrated secondary horizontal and vertical cross-hairs. In some preferred embodiments, the calculator comprises means for unit conversion for any desired measurement.

In one embodiment, the reticle of the present invention comprises a plurality of primary cross-hairs separated by predetermined distances, a plurality of secondary cross-hairs at predetermined distances along said plurality of primary cross-hairs, and a plurality of lead markings indicating rate of movement of the target along at least one said cross-hair. In one embodiment, the plurality of primary-cross-hairs comprises vertical cross-hairs. In another embodiment, the plurality of primary cross-hairs comprises horizontal cross-hairs. In yet another embodiment, the plurality of primary cross-hairs comprises both vertical and horizontal cross-hairs. In a further embodiment, the plurality of secondary cross-hairs comprises vertical cross-hairs. In still further embodiment, the plurality of secondary cross-hairs comprises horizontal cross-hairs. In a preferred embodiment, the plurality of secondary cross-hairs comprises both vertical and horizontal cross-hairs. In a particularly preferred embodiment, the plurality of secondary cross-hairs comprises at least three secondary cross-hairs.

In one embodiment, lead markings are placed along at least one of the primary cross-hairs. In another embodiment, the lead markings are placed along at least one of the secondary cross-hairs. In yet another embodiment, the lead markings are placed along at least one primary cross-hair, and at least one secondary cross-hair. In a preferred embodiment, the plurality of lead markings comprises at least three lead markings. In a particularly preferred embodiment, the lead markings are secondary cross-hairs.

In one embodiment, the reticle comprises rangefinder markings. In another embodiment, the reticle comprises markings for identification of one or more of the cross-hairs. In an additional embodiment, the reticle comprises markings for identification of one or more of the lead markings. In still another embodiment, the reticle comprises an aiming dot.

In one embodiment, the reticle is configured for use in day light illumination. In some embodiments the reticle is configured for use in low light illumination.

In one embodiment, the present invention comprises a method for shooting a target comprising a target acquisition device, comprising a housing, a means for mounting said housing in a fixed, predetermined position relative to a firearm, an objective lens mounted in one end of said housing, an ocular lens mounted in the opposite end of said housing; a reticle comprising a plurality of primary cross-hairs separated by predetermined distances, a plurality of secondary cross-hairs at predetermined distances along said plurality of primary cross-hairs, and a plurality of lead markings indicating rate of movement of the target along at least one said cross-hair; selecting an aiming point on said target acquisition device that accounts for the relation of the shooter to the target, and using said aiming point to aim said firearm so as to hit said target.

In one embodiment, the present invention comprises a method for shooting a target comprising a target acquisition device comprising a housing, a means for mounting the housing in a fixed, predetermined position relative to a firearm, an objective lens mounted in one end of said housing, and an ocular lens mounted in the opposite end of said housing; a reticle comprising a plurality of primary cross-hairs separated by predetermined distances, a plurality of secondary cross-hairs at predetermined distances along said plurality of primary cross-hairs, and a plurality of lead markings indicating rate of movement of the target along at least one said cross-hair; a ballistics calculator system for computing targeting information to hit a target comprising a processor comprising a ballistics computer program embodied in a computer-readable medium for analyzing information needed to accurately aim a firearm at a target using a target acquisition device with a reticle, with the program using information regarding one or more of external conditions, the firearm being used, the projectile being used, the target acquisition device and reticle being used, the shooter, the relation of the shooter wherein said target can be greater than 1000 yards from the shooter, and the ballistics drag model and retardation coefficient being used, and selecting an aiming point on the target acquisition device that accounts for the relation of the shooter to the target, and using the targeting information displayed by the ballistics calculator system to aim the firearm so as to hit the target. In a preferred embodiment, the target is hit by holding the aiming point on the target. In a further embodiment the ballistics calculator system projects a reticle specific for information regarding one or more of the firearm being used, the projectile being used, and the target acquisition device being used.

In some embodiments, reticles of the present invention comprise a primary horizontal cross-hair, a primary vertical cross-hair that intersects said primary horizontal cross-hair, two or more mil lines of graduated length on said primary horizontal cross-hair, two or more mil lines of graduated length on said primary vertical cross-hair, two or more offset mil lines subtending the gap between the third and the fourth mil lines on the primary horizontal cross-hair and the primary vertical cross hair to the left, to the right, and above the intersection of the primary horizontal cross-hair and the primary vertical cross-hair, two or more range markings along the primary vertical cross-hair below the intersection of the primary horizontal cross-hair and the primary vertical cross-hair, two or more wind markings to the left and to the right of the primary vertical cross-hair below the intersection of the primary horizontal cross-hair and the primary vertical cross-hair, two or more simultaneously visible secondary horizontal cross-hairs at predetermined distances on said primary vertical cross-hair, and two or more simultaneously visible secondary vertical cross-hairs at predetermined distances on said simultaneously visible secondary horizontal cross-hairs, wherein an intersection of at least one of said two or more simultaneously visible secondary vertical cross-hairs and at least one of said two or more simultaneously visible secondary horizontal cross-hairs provides an aiming point.

In some embodiments, the two or more mil lines of graduated length on the primary horizontal cross-hair and the two or more mil lines of graduated length on the primary vertical cross-hair are graduated in length in a replicated pattern. In further embodiments, the two or more mil lines of graduated length on the primary horizontal cross-hair and the two or more mil lines of graduated length on the primary vertical cross-hair are successively 0.5 mils, 0.6 mils, 0.7 mils, 0.8 mils and 0.9 mils in length in a pattern that is replicated thereafter along the primary horizontal cross-hair and the primary vertical cross-hair.

In some embodiments, the two or more offset mil lines subtending the gap between the third and the fourth mil lines on the primary horizontal cross-hair and the primary vertical cross hair to the left, to the right and above the intersection of the primary horizontal cross-hair and the primary vertical cross-hair are offset in a V-shape. In other embodiments, the two or more offset mil lines subtending the gap between the third and the fourth mil lines on the primary horizontal cross-hair and the primary vertical cross hair to the left, to the right and above the intersection of the primary horizontal cross-hair and the primary vertical cross-hair are successively spaced at 3.5, 3.6, 3.7, 3.8 and 3.9 mils.

In some embodiments, the two or more range markings along the primary vertical cross-hair below the intersection of the primary horizontal cross-hair and the primary vertical cross-hair comprise a gap. In other embodiments, the gap corresponds to a predetermined dimension of a target at a predetermined range. In further embodiments, the two or more range markings along the primary vertical cross-hair below the intersection of the primary horizontal cross-hair and the primary vertical cross-hair comprise an oval. In still further embodiments, the longest diameter of the oval corresponds to a predetermined dimension of a target at a predetermined range.

In some embodiments, the two or more wind markings to the left and to the right of the primary vertical cross-hair below the intersection of the primary horizontal cross-hair and the primary vertical cross-hair are selected from a group consisting of a dot, a cross, an uninterrupted line, an interrupted line, a number and a line comprising two or more numbers. In other embodiments, the two or more wind markings to the left and to the right of the primary vertical cross-hair below the intersection of the primary horizontal cross-hair and the primary vertical cross-hair are calibrated for the velocity of a target, properties of a projectile, properties of a firearm, or properties of the environment. In further embodiments, the properties of the environment comprise density altitude, wind speed, wind direction, and wind angle. Further embodiments comprise velocity-of-a-target-markings above or below the primary horizontal cross-hair. In some embodiments, the wind markings to the left and to the right of the primary vertical cross hair are arranged in vertically curvilinear lines.

In some embodiments, the primary horizontal cross-hair is a line. In other embodiments, the line is a straight line. In still other embodiments, the straight line is an uninterrupted straight line. In further embodiments, the primary horizontal cross-hair has a predetermined thickness. In some embodiments the predetermined thickness is a single thickness along the primary horizontal cross-hair. In other embodiments, the primary vertical cross-hair is a line. In some embodiments the line is a straight line. In further embodiments the straight line is an uninterrupted straight line. In some embodiments, the primary vertical cross-hair has a predetermined thickness. In further embodiments, the predetermined thickness is a single thickness along the primary vertical cross-hair. In preferred embodiments, the primary horizontal cross-hair and said primary vertical cross-hair physically cross at an intersection point. In certain embodiments, at least one of the two or more secondary horizontal cross-hairs is an uninterrupted straight line. In other embodiments, at least one of the two or more secondary horizontal cross-hairs is a predetermined thickness. In some embodiments, the predetermined thickness is a single thickness along the at least one of the two or more secondary horizontal cross-hairs. In other embodiments, the at least one of the two or more secondary horizontal cross-hairs is shorter in length than the primary horizontal cross-hair. In still other embodiments, the at least one of the two or more secondary vertical cross-hairs is an uninterrupted straight line. In some embodiments, at least one of the two or more secondary vertical cross-hairs is a predetermined thickness. In some embodiments, the predetermined thickness is single thickness along the at least one of the two or more secondary vertical cross-hairs. In other embodiments, at least one of the two or more secondary vertical cross-hairs is shorter in length than the primary vertical cross-hair. In some embodiments, a plurality of the two or more secondary vertical cross-hairs are evenly spaced. In certain embodiments, the two or more wind markings are evenly spaced on at least one of said two or more simultaneously visible secondary horizontal cross-hairs. In other embodiments, the two or more wind markings are evenly spaced at intervals that differ between at least two of said two or more simultaneously visible secondary horizontal cross-hairs. In still further embodiments, the rangefinder markings and the wind markings are identified by numbers. Some embodiments comprise a zero aiming point at the intersection of the primary vertical cross-hair and the primary horizontal cross-hair. Other embodiments comprise at least one simultaneously visible straight line secondary horizontal cross-hair on the primary vertical cross-hair above the primary horizontal cross-hair.

Other embodiments will be evident from a consideration of the drawings taken together with the detailed description of the invention.

BRIEF DESCRIPTION OF THE DRAWINGS

A better understanding of the invention and its advantages will be apparent from the detailed description taken in conjunction with the accompanying drawings in which:

FIG. 14Ai is an enlarged portion of a front view of reticle markings of the present invention as shown in FIG. 14A;

FIG. 14Aii is an enlarged portion of a front view of reticle markings of the present invention as shown in FIG. 14A;

FIG. 14Bi is an enlarged portion of a front view of reticle markings of the present invention as shown in FIG. 14B;

FIG. 14Bii is an enlarged portion of a front view of reticle markings of the present invention as shown in 14B;

DETAILED DESCRIPTION OF THE INVENTION

Figure 1:
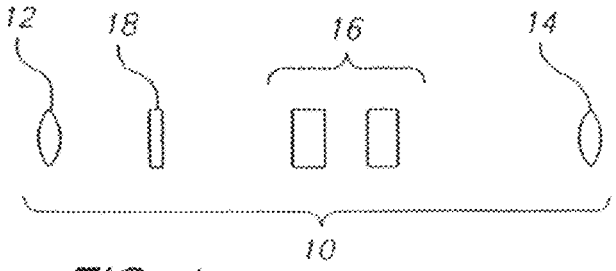
FIG. 1 is a diagram showing the optical components of a telescopic gunsight of the present invention.
Figure 3:
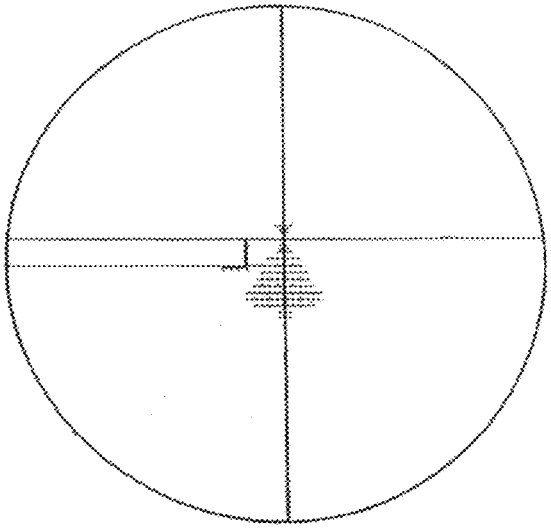
FIG. 3 is a front view of a reticle of the present invention, showing the markings as viewed through a zoom telescopic gunsight at low power.

The present invention relates to target acquisition and related devices, and more particularly to telescopic gunsights and associated equipment used to achieve shooting accuracy at, for example, close ranges, medium ranges and extreme ranges at stationary and moving targets. Certain preferred and illustrative embodiments of the invention are described below. The present invention is not limited to these embodiments.

As used herein, the term "firearm" refers to any device that propels an object or projectile, for example, in a controllable flat fire, line of sight, or line of departure, for example, handguns, pistols, rifles, shotgun slug guns, muzzleloader rifles, single shot rifles, semi-automatic rifles and fully automatic rifles of any caliber direction through any media. As used herein, the term "firearm" also refers to a remote, servo-controlled firearm wherein the firearm has auto-sensing of both position and directional barrel orientation. The shooter is able to position the firearm in one location, and move to a second location for target image acquisition and aiming. As used herein, the term "firearm" also refers to chain guns, belt-feed guns, machine guns, and Gattling guns. As used herein, the term firearm also refers to high elevation, and over-the-horizon, projectile propulsion devices, for example, artillery, mortars, canons, tank canons or rail guns of any caliber.

As used herein, the term "internal barrel caliber" refers to the diameter measured across the lands inside the bore, or the diameter of the projectile. As used herein, the term "internal barrel diameter" refers to a straight line passing through the center of a circle, sphere, etc. from one side to the other and the length of the line used in ballistics to describe the bore of the barrel.

As used herein, the term "cartridge" refers, for example, to a projectile comprising a primer, explosive propellant, a casing and a bullet, or, for example, to a hybrid projectile lacking a casing, or, for example, to a muzzle-loaded projectile, compressed gas or air-powered projectile, or magnetic attraction or repulsion projectile, etc. In one embodiment of the present invention, the projectile travels at subsonic speed. In a further embodiment of the present invention, the projectile travels at supersonic speed. In a preferred embodiment of the present invention, the shooter is able to shift between subsonic and supersonic projectiles without recalibration of the scope, with reference to range cards specific to the subsonic or supersonic projectile.

As used herein, the term "target acquisition device" refers to an apparatus used by the shooter to select, identify or monitor a target. The target acquisition device may rely on visual observation of the target, or, for example, on infrared (IR), ultraviolet (UV), radar, thermal, microwave, or magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to the shooter by the target acquisition device may be unaltered, or it may be enhanced, for example, by magnification, amplification, subtraction, superimposition, filtration, stabilization, template matching, or other means finding use in the present invention. In some embodiments, the target image presented to the shooter by the target acquisition device is compared to a database of images stored, for example, on a medium that is readable by the ballistics calculator system of the present invention. In this fashion, the ballistics calculator system performs a match or no-match analysis of the target or targets. The target selected, identified or monitored by the target acquisition device may be within the line of sight of the shooter, or tangential to the sight of the shooter, or the shooter's line of sight may be obstructed while the target acquisition device presents a focused image of the target to the shooter. The image of the target acquired by the target acquisition device may be, for example, analog or digital, and shared, stored, archived, or transmitted within a network of one or more shooters and spotters by, for example, video, physical cable or wire, IR, radio wave, cellular connections, laser pulse, optical, 802.11b or other wireless transmission using, for example, protocols such as html, SML, SOAP, X.25, SNA, etc., Bluetooth™, Serial, USB or other suitable image distribution method.

Figure 4:
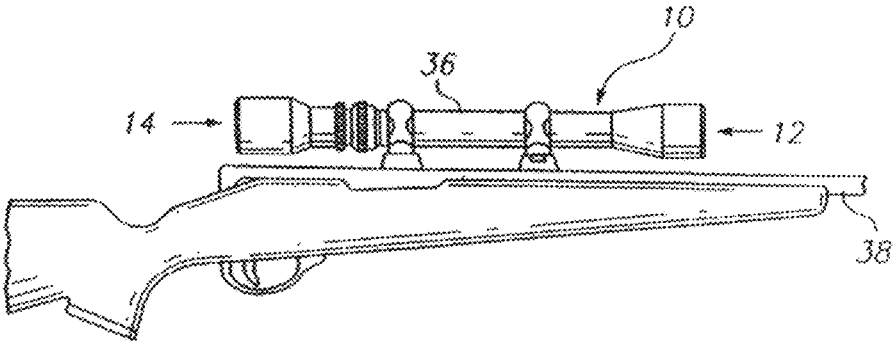
FIG. 4 is a partial side view of an example of a firearm showing a telescopic gunsight mounted on the barrel.

As exemplified in FIG. 4, a target acquisition telescopic gunsight 10 (also referred to herein as a "scope") includes a housing 36 which can be mounted in fixed relationship with a gun barrel 38. Housing 36 is preferably constructed from steel or aluminum, but can be constructed from virtually any durable, substantially rigid material that is useful for constructing optical equipment. Mounted in housing 36 at one end is an objective lens or lens assembly 12. Mounted in housing 38 at the opposite end is an ocular lens or lens assembly 14.

As used herein, the term "lens" refers to an object by means of which light rays, thermal, sonar, infrared, ultraviolet, microwave or radiation of other wavelength is focused or otherwise projected to form an image. It is well known in the art to make lenses from either a single piece of glass or other optical material (such as transparent plastic) which has been conventionally ground and polished to focus light, or from two or more pieces of such material mounted together, for example, with optically transparent adhesive and the like to focus light. Accordingly, the term "lens" as used herein is intended to cover a lens constructed from a single piece of optical glass or other material, or multiple pieces of optical glass or other material (for example, an achromatic lens), or from more than one piece mounted together to focus light, or from other material capable of focusing light. Any lens technology now known or later developed finds use with the present invention. For example, any lens based on digital, hydrostatic, ionic, electronic, magnetic energy fields, component, composite, plasma, adoptive lens, or other related technologies may be used. Additionally, moveable or adjustable lenses may be used. As will be understood by one having skill in the art, when the scope 10 is mounted to, for example, a gun, rifle or weapon 38, the objective lens (that is, the lens furthest from the shooter's eye) 12 faces the target, and the ocular lens (that is, the lens closest to the shooter's eye) 14 faces the shooter's eye.

Other optical components that may be included in housing 36 include variable power optical components 16 for a variable power scope. Such components 16 typically include magnifiers and erectors. Such a variable power scope permits the user to select a desired power within a predetermined range of powers. For example, with a 3-12×50 scope, the user can select a lower power (e.g., 3×50) or a high power (e.g., 12×50) or any power along the continuous spectrum in between.

Reticles of the present invention are typically (but not necessarily) constructed using optical material, such as optical glass or plastic, or similar transparent material, and takes the form of a disc or wafer with substantially parallel sides. The reticle may, for example, be constructed from wire, spider web, nano-wires, an etching, or may be analog or digitally printed, or may be projected (for example, on a surface) by, for example, a mirror, video, holographic projection, or other suitable means on one or more wafers of material. In one embodiment, illuminated reticles are etched, with the etching filled in with a reflective material, for example, titanium oxide, that illuminates when a light or diode powered by, for example, a battery, chemical or photovoltaic source, is rheostatically switched on compensating for increasing (+) or decreasing (−) light intensity. In a further embodiment, the illuminated reticle is composed of two or more wafers, each with a different image, for example, one image for daylight viewing (that is, a primary reticle), and one image for night viewing (that is, a secondary reticle). In a still further embodiment, if the shooter finds it undesirable to illuminate an entire reticle, since it might compromise optical night vision, the secondary reticle illuminates a reduced number of dots or lines. In yet another embodiment, the illuminated primary and secondary reticles are provided in any color. In a preferred embodiment, the illuminated reticle of the shooter's aiming device is identical to one or more spotter target acquisition devices such that the spotting device independently illuminates one or both of the reticles.

In a particularly preferred embodiment, the illuminated reticles of the present invention are used in, for example, low light or no light environments using rheostat-equipped, stereoscopic adaptive binoculars. With one eye, the shooter looks through a target acquisition device equipped with an aiming reticle of the present invention. With the opposite eye, the shooter observes the target using a night vision device, for example, the PVS 14 device. When the reticle and night vision device of the binocular are rheostatically illuminated, and the binocular images are properly aligned, the reticle of the target acquisition device is superimposed within the shooter's field of vision upon the shooter's image of the target, such that accurate shot placement can be made at any range in low light or no light surroundings.

In one embodiment, the reticle of the present invention is electronically projected on a viewing screen comprising the shooter's image of the target. As used herein, the term "image" refers to data representation of a physical object or space. In another embodiment, an electronic image receptor receives an image from lenses made of, for example, plastic, glass or other clear material. In a further embodiment, the electronic image receptor is permanently affixed to the target acquisition device. In a preferred embodiment, two or more electronic image receptors are simultaneously or sequentially available to the shooter for acquisition of different spectral images including, for example, IR, thermal, visible light, ultra-violet light (UV), radiation including X-ray, gamma ray, isotope and particle radiation, microwave, night vision, radar, vibrational receptors including ultra-sound, sound pulse, sonar, seismic vibrations, magnetic resonance, gravitational receptors, broadcast frequencies including radio wave, television and cellular receptors, etc. In an additional embodiment, the electronic image receptor is a replaceable component of the target acquisition device. In some embodiments, the reticle of the present invention is a thick or thin line-weight reticle.

In one embodiment, the electronic image is projected from the shooter's target image acquisition device to a ballistics calculator processing unit by, for example, physical cable, IR, Bluetooth™, radio wave, cellular connections, laser pulse, optical, 802.11b or other wireless transmission using, for example, protocols such as html, SML, SOAP, X.25, SNA, etc., and may be encrypted for security. The processing unit may be any sort of computer, for example, ready-built or custom-built, running an operating system. In preferred embodiments, manual data is input to the processing unit through voice recognition, touch screen, keyboard, buttons, knobs, mouse, pointer, joystick, or analog or digital devices. In a further embodiment, the reticle of the present invention is electronically projected on a viewing screen comprising one or more spotter's image of the target. In a still further embodiment, the electronic image of the spotter's target image acquisition device is projected to the ballistics calculator by, for example, cable, IR, Bluetooth™, or other wireless transmission. In a particularly preferred embodiment, viewing screens of the ballistics calculator system comprising, for example, aiming dots, ghost rings and targeting data are projected on one or more shooter's and one or more spotter's viewing screens. In some embodiments the visual display includes LCD, CRT, holographic images, direct corneal projection, large screen monitors, heads up display, and ocular brain stimulus. In other embodiments, the display is mounted, for example, on the scope, in portable head gear, on glasses, goggles, eye wear, mounted on the firearm, or in a portable display standing apart from the firearm.

In some embodiments, the shooter is able to use the processing unit of the ballistics calculator system to electronically select the color of the reticle or image, and, through electronic enhancement of the target image, for example, to defeat mirage, to increase or decrease the brightness and contrast of the reticle, to increase or decrease the brightness and contrast resolution of the target image, to stabilize the image, to match the image with an electronic library of stored images, to electronically amplify the target image through pixel replication or any other form of interpolation, to sharpen edge detection of the image, and to filter specific spectral elements of the image. In other embodiments, image types can be combined by the processing unit of a ballistic calculating system to assist in resolving images, for example, performing digital combinations of visible spectrum with thermal imaging, overlapping ultraviolet images with X-ray images, or combining images from an IR scope with night optics. The processing unit gathers all data on, for example, target size, angles and locations of spotters and shooters, and constructs an accurate position of the target in relation to the shooter. In a further embodiment, the ballistics calculator displays the electronic image observed by the shooter's or spotter's target image acquisition devices. In a preferred embodiment, after the firearm is discharged the targeting grid of the electronic target image acquisition device and ballistics calculator system is adjusted so that the point of impact is matched to the targeting grid, thereby establishing a rapid zero aiming point. In yet another embodiment, firearm and telescopic aiming device are zeroed electronically.

In one embodiment, the target acquisition device is not mounted on a firearm. An advantage of not having the target acquisition device image receptor be mounted on the scope or firearm is that much larger, more powerful and more sensitive imaging components can be deployed, making it easier to acquire better images without burdening the shooter with additional bulk and weight. In addition, a stand-apart image receptor is not exposed to recoil from the firearm. In the stand-apart ballistics calculating system shooters, spotters and other interested parties view the target via a target image acquisition device, for example, a thermal imaging device, that projects an image on a video monitor or glasses, goggles, an eye-piece, a contact lens, a headset, or on the retina of the viewer. In some embodiments, the image receptor is in a spotting scope beside the firearm. In another embodiment, the image receptor is mounted on a nearby firearm. In a preferred embodiment, the image receptor is at a separate location, or remote site. In a particularly preferred embodiment, the image receptor is in an airborne vehicle, drone, or satellite. In a further embodiment, the image is available as previously stored information. In another embodiment, the one or more shooters use multiple or composite image receptors.

In one embodiment of the present invention, the reticle is projected on glasses, goggles, an eye-piece, a contact lens, a headset, or on the retina of the shooter. In another embodiment, the reticle is superimposed on any suitable image of the target, for example an optical image, a thermal image, an ultrasonic image, a sonar image, a radar image, a night vision image, a magnetic image, an infrared image, an enhanced image of any kind, or a holographic projected electronic image. In still further embodiment, the reticle is superimposed on the intended target and the aiming point is illuminated by a laser. Where the markings on a reticle are generated or moveable, in some embodiments, the markings may be modified to account for changes in the environment and/or desired function. For example, the position, size, spacing of cross-hairs, etc. may be automatically or manually adjusted to improve function.

In an additional embodiment, the reticle is provided with a circumscribing ring visible through the target acquisition device, to aid in centering the eye relative to the target acquisition device. This ring helps reduce shooting inaccuracy caused by the misalignment of the shooter's line of sight through the target acquisition device. The ring assures a repeatable check weld to the firearm that is beneficial to repeatable shooting. By providing a visual means to align the reticle within the target acquisition device, the shooter is able to produce more accurate and more repeatable results. In one embodiment, the reticle of the present invention further comprises a substantially transparent disc having an optical center and an edge for mounting said disc, and a ring positioned optically between said optical center and said edge, said ring spaced from said edge and circumscribing said optical center and one or more aiming points, whereby said ring can be visually centered in a field of view for aligning a line of sight through the target acquisition device. In some embodiments, the ring-equipped reticle allows the shooter to rapidly discriminate the ring in the target acquisition device's field of view. The shooter thereby naturally and subconsciously focuses on the center of the ring. In further embodiments, a central dot is used for finer or more precise targeting as time allows. As used herein, a "central dot" refers to any geometric shape, for example, a circle, a square, a cross, or a diamond. In some embodiments, the central dot is solid. In other embodiments, the central dot is hollow. In further embodiments, the central dot is indicated by interrupted lines. In some embodiments, the reticles of the present invention comprise two or more rings. In further embodiments, at least one ring is within another ring. In still further embodiments, a circumscribing ring is differentially illuminated from at least one component of the reticle. In some embodiments, the ring diameter is suitable for use at a near, an intermediate or a distant target. More accurate results can be achieved if a shooter centers the reticle while looking through the target acquisition device. However, aligning the user's eye with the optical center of the target acquisition device is not always easy. The present invention can also be provided with a "ghost ring". The ghost ring is a visible ring which has as its center the optical center of the scope, and which circumscribes that markings on the reticle. The ghost ring aids shooters by helping them align their sight with respect to the target acquisition device and reticle. By insuring that the ghost ring is centered within the field of view of the target acquisition device, the reticle will likewise be centered. In additional embodiments, the ring-equipped reticle gives the shooter the ability to rapidly acquire and engage targets at very close distances to plus or minus 300 yards. When a target is spotted, and time is of the essence, the central ring that encases all or part of the reticle gives the shooter the ability to quickly discriminate the object to be targeted. When speed is an essential factor, the reticle of the present invention gives the shooter a safety factor equated in time. The ring-equipped reticle of the present invention allows the shooter to strike the target first, thereby dramatically increasing odds of survival. In some embodiments, for extended range targets up to 1000 yards and beyond, the shooter uses the reticle of the present invention contained wholly or partially within all or part of the ring. In some embodiments the ring is designed with a thick line, for example a line that subtends, or covers, 5 MOA at 100 yards. In other embodiments, a thinner line is employed compatible with, for example, specific target acquisition devices, preferred magnification powers, weapons of choice, or assigned missions. In some embodiments, the area subtended by the ring is selected depending on targeting and weapon requirements. In preferred embodiments, the area of the ring on an electronic reticle is selected by programming the ballistics calculator system.

In some embodiments, the ring is partitioned into 4 equal quadrants by horizontal and vertical cross-hairs. In other embodiments, the quadrants bounded by horizontal and vertical cross-hairs are unequal in area. In another embodiment, the ring is a geometric shape, for example an oval or diamond, positioned at the center of the optical field of view. In other embodiments, the ring is a geometric shape, for example an oval or a diamond, located at the point that the horizontal and vertical cross-hairs physically intersect. In specific embodiments, the ring may take any geometric shape for example, a circle, a rhombus, a diamond, a triangle, and the like. In still other embodiments, the ring is a geometric shape, for example an oval or a diamond, located at the point that interrupted horizontal and vertical cross-hairs intersect if linearly projected. In some embodiments, the geometric shape of the ring subtends 5 MOA at exactly 100 yards. In one embodiment, the geometric shape of the ring is continuous. In another embodiment, the geometric shape of the ring is interrupted. In yet further embodiments, the size and shape of the ring is selected depending on the mission, weapon and type of ammunition.

An aiming dot can, for example, be included as an aid for rapid acquisition of moving targets, and for centering the shooter's eye in the field of view of the scope. The dot can be any diameter, but is most preferably about 5 inches of angle in diameter, and is superimposed over the optical center of the reticle. A dot is most preferably circular, but it may also be other shapes such as square, rectangular, oval, and the like. The aiming dot can be a predetermined size that covers a predetermined area of the target at a given range according to a scaling of the reticle, such as inches of angle, centimeters of angle, or conventional scaling means as mentioned previously. The preferred arrangement of a ghost ring in combination with aiming dot enhances the eye's natural tendency to center the ring in the center of the field of view of the target acquisition device. By looking directly along the target acquisition device, the shooter is more likely to have accurate and repeatable shooting. The ghost ring and dot can be part of the reticle. Preferably the ring and the dot are etched onto one side of the disc. However, the ring and the dot can, for example, also be provided using other conventional methods such as, for example, printing, etching, or applying hairs or wires to the transparent disc, or to other optical components of the target acquisition device. In one embodiment, the etched rings and dots are filled with luminescent material such that the rings and dots may be illuminated if desired. Preferably rings and aiming dots are etched onto one side of the disc, but can also be provided using other conventional methods such as, for example, printing or applying hairs or wires to the disc or to other optical components of the scope. In a further embodiment, the ghost ring is projected and mobile on the reticle, thereby preserving rapid aiming properties while not fixed only to the center of the reticle.

In a fixed power scope, in preferred embodiments, the reticle is mounted anywhere between the ocular lens 14 and the objective lens 12 of FIG. 1. In a variable power scope, the reticle is most preferably mounted between the objective lens 12 and the optical components 16. In this position, the apparent size of the reticle when viewed through the ocular lens will vary with the power. The reticle of the present invention may be mounted in a variable power target acquisition device, for example a variable power telescopic gunsight such as those manufactured by Schmidt & Bender GmbH & Co. KG of Biebertal, Germany, or U.S. Optics because of their excellent optics. The variable power scope may magnify over any suitable range and objective lens diameter, for example a 3-12×50, a 4-16×50, a 1.8-10×40, 3.2-17×44, 4-22×58 telescopic gunsight, etc.

When the reticle is mounted between the objective lens and the variable power optical components 16, the selected aiming point (as described in more detail below) on the reticle of the present invention does not vary as the shooter zooms the scope in and out to find the most desirable power for a particular shot. The reticle of the present invention is thus in the first focal plane so that the reticle markings scales are proportional to the image when viewed through the scope. Thus, a unit of measure is consistent no matter the magnification. In one embodiment, since magnification is proportional on a linear scale through the power range, when the reticle is in the second plane (that is, the markings stay the same size visually against a growing or shrinking image when the power changes (i.e., because the relationship is linear), and when the power to which the scope is set is known, the scale value against the image at a known distance when seen through the scope is calculated. In a further embodiment, a "click" stop at fixed intervals on the power ring assists the user's ability to set the power at a known stop. In a preferred embodiment, these calculations are performed by the ballistics calculator.

For example, taking as input:

1. the power ($P_z$) that the reticle pattern is "true" (i.e. 10×)
2. the value worth ($V_z$) of the reticle pattern marks when "true" (i.e 1 Mil, or 10 cm at 100 meters)
3. the distance for the zero value ($D_z$) (100 meters)

4. the current power ($P_c$) setting (e.g., 14)
5. the current distance ($D_t$) of the object being viewed (let's say 600 yards)

Expressed as:

$$(V_z)\times(D_t/D_z)\times(P_z/P_c)=\text{current drop}$$

or, for example $$(10\text{ cm})\times(600m/100m)\times(10/14)=42.86\text{ cm drop}$$

The same calculation can be applied to range finding as well.

Figure 2:
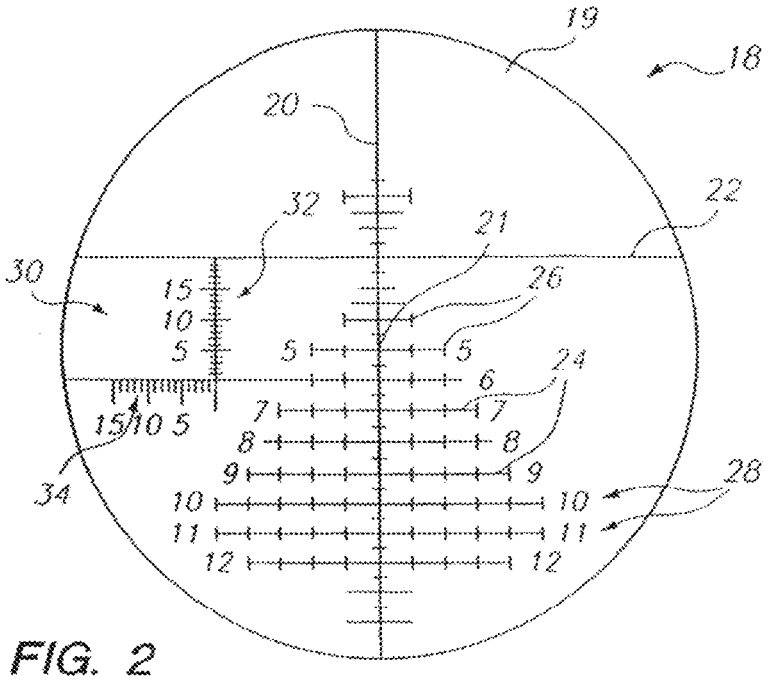
FIG. 2 is a front view of a reticle of the present invention, showing the markings as viewed through a zoom telescopic gunsight at high power, the spacing of the markings based upon a "shooter's minute of angle" or "inch of angle" (IOA™) scale.
Figure 5:
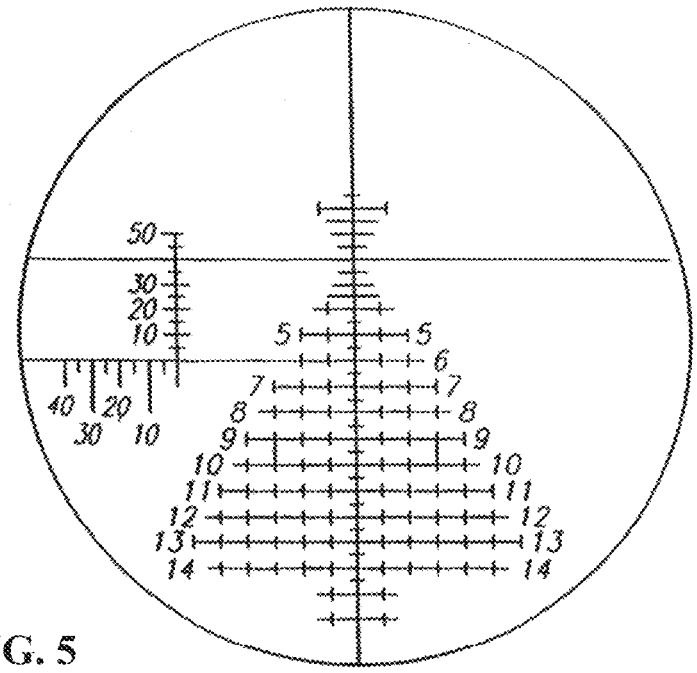
FIG. 5 is an example of a reticle of the present invention based upon a "centimeter of angle" (COA™) scale.
Figure 6A:
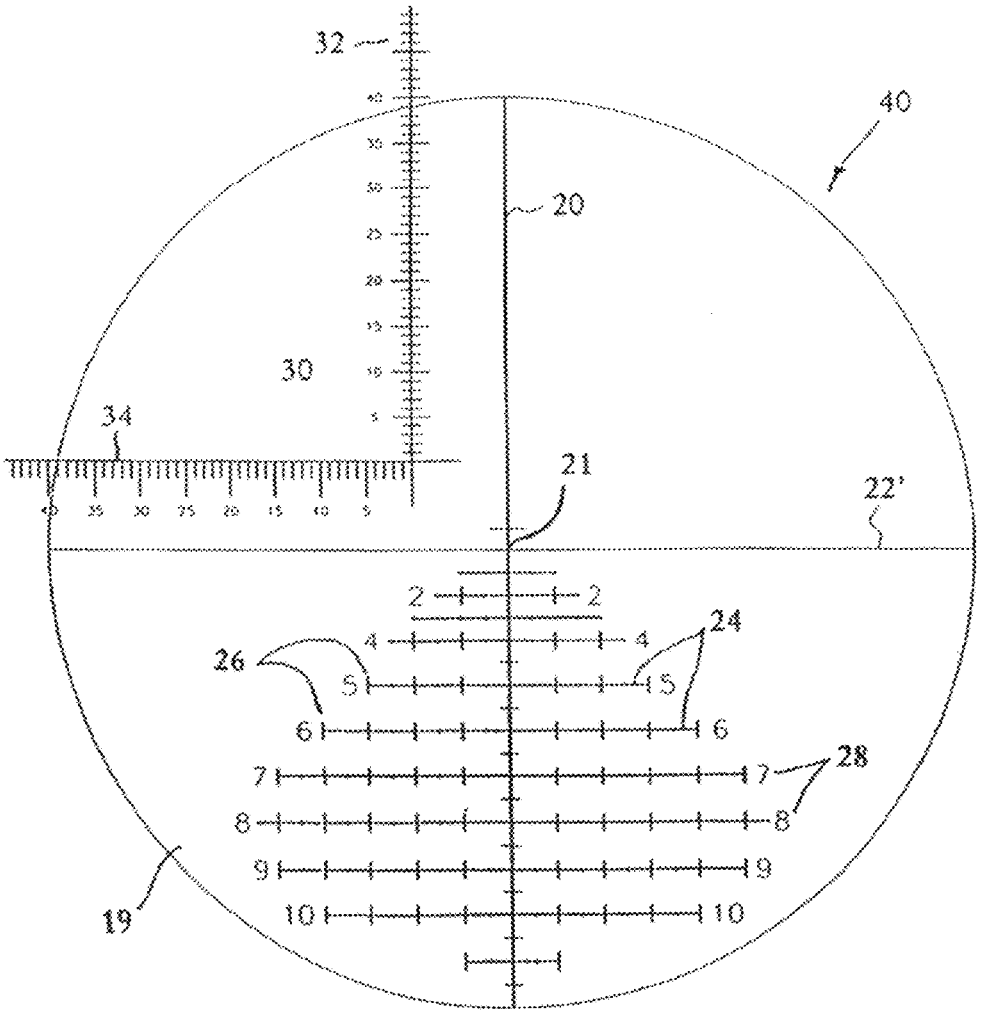
FIG. 6A is a front view of an example of a mid-range reticle of the present invention. The spacing of the markings are based upon an "inch of angle" (IOA™) scale.
Figure 6B:
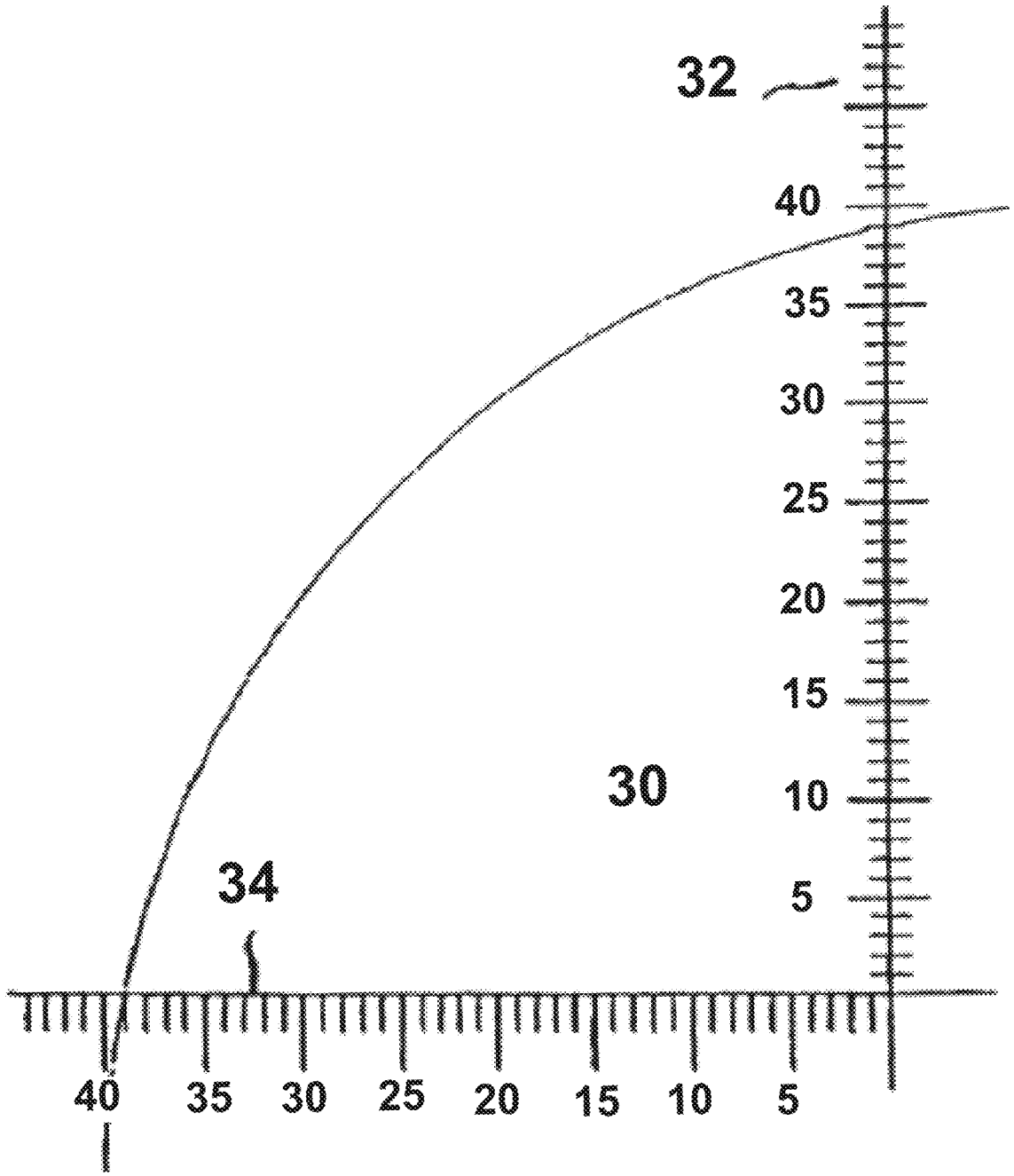
FIG. 6B is an enlarged portion of a front view of the example of a mid-range reticle of the present invention as shown in FIG. 6A.
Figure 7:
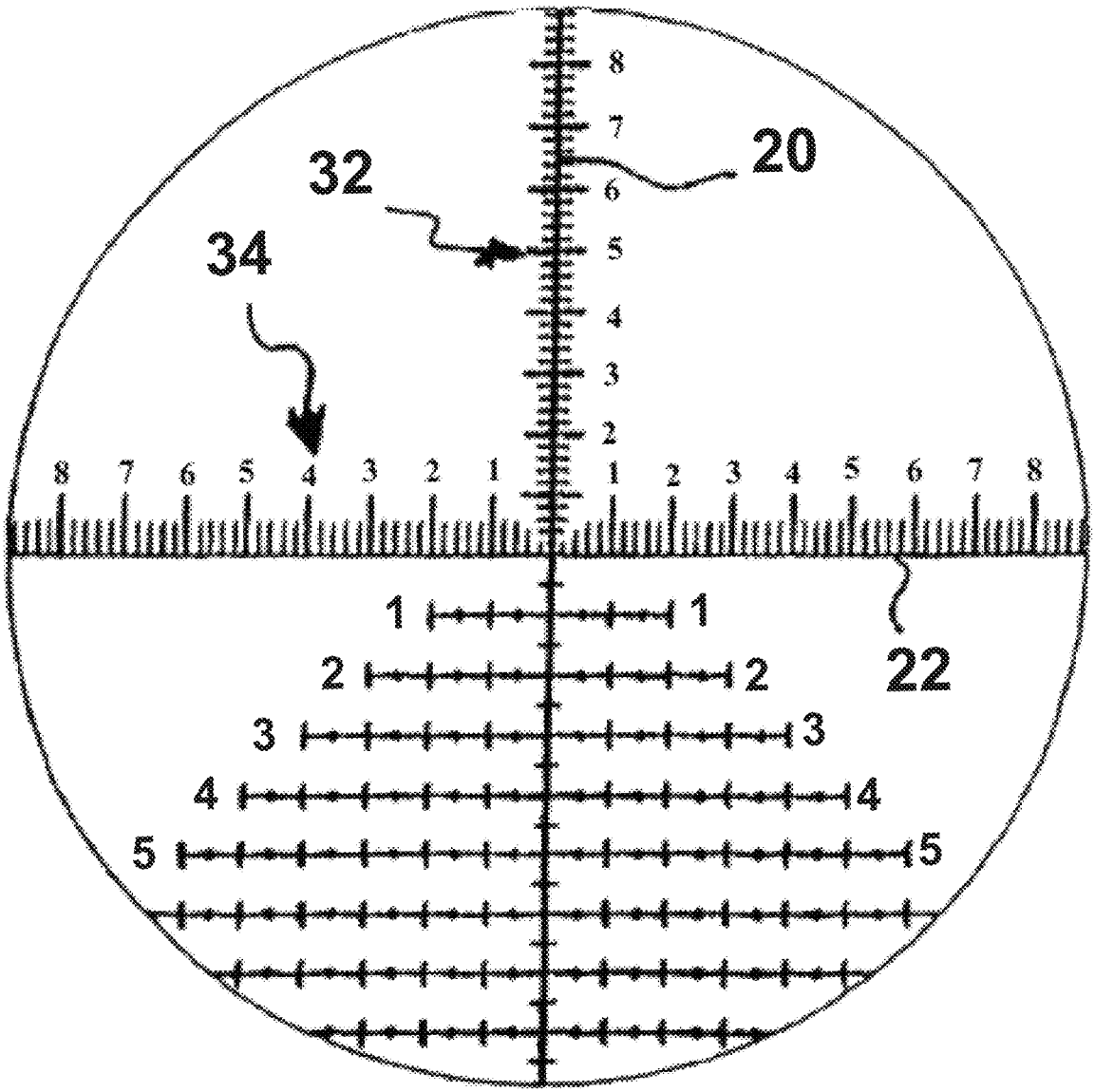
FIG. 7 is a front view of a reticle of the present invention in which the upper portion of the primary vertical cross-hair and the primary horizontal cross-hair have been provided with rangefinder markings of a United States Marine Corps mil Radians scale, (where a circle equals 6,283 mils/circle); or it may be calibrated in United States Army mil scale (6,400 mils/circle), or other mil scale (e.g. 6000 mil/circle, 9000 mil/circle), or European, Russian, or other variations of the mil scale.
Figure 8:
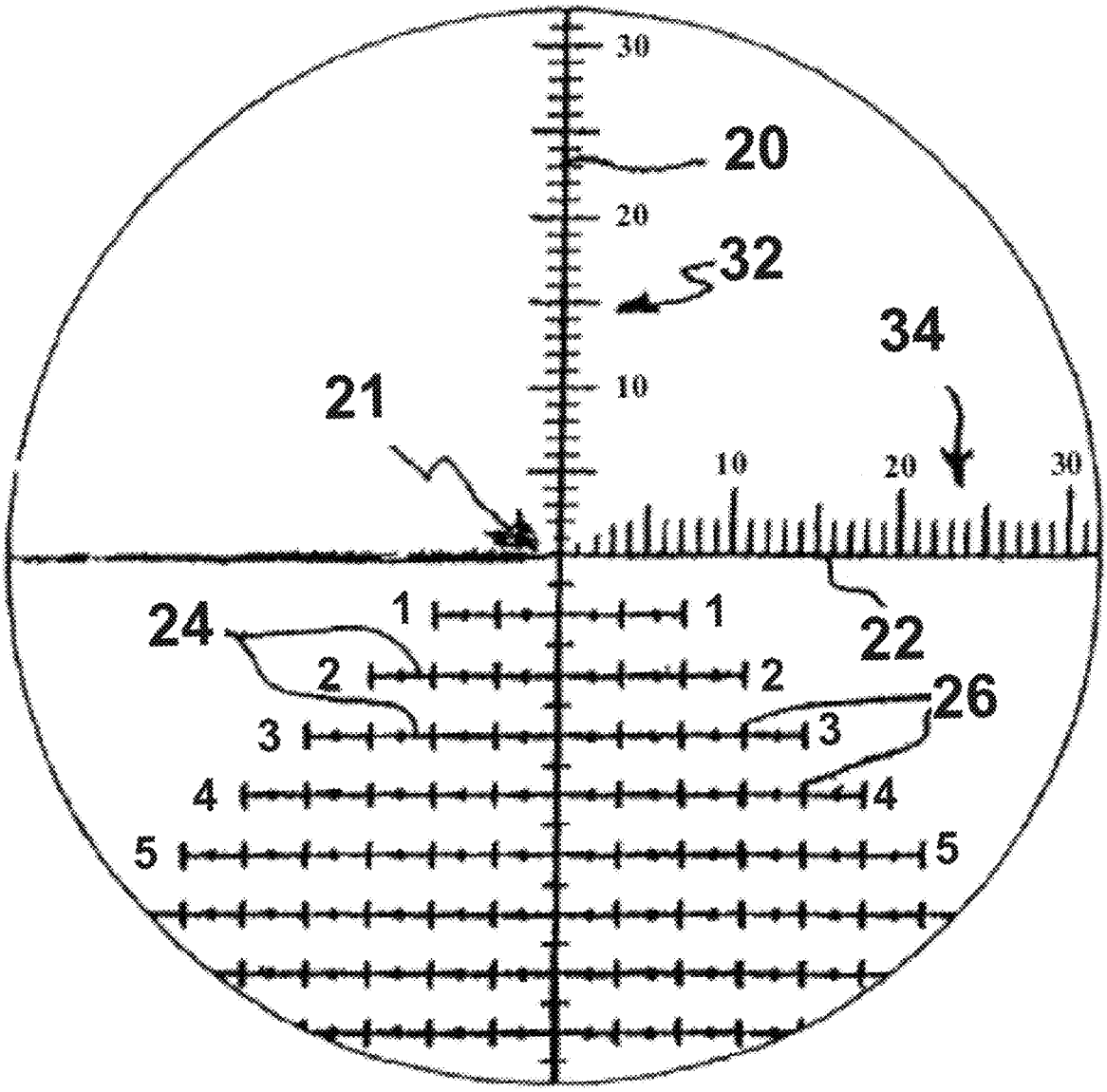
FIG. 8 is a front view of a reticle of the present invention in which the upper portion of the primary vertical cross-hair and the primary horizontal cross-hair have been provided with rangefinder markings of an "inches of angle" (IOA™) scale.

As shown in FIG. 2, a reticle 18 of the present invention is formed from a substantially flat disc or wafer 19 formed from substantially transparent optical glass or other material suitable for manufacturing optical lenses. Disc 19 has two, substantially parallel, sides. A primary vertical cross-hair 20 is provided on one side of said disc 19 using conventional methods such as, for example, etching, printing, engraved by machine or burned by laser, or applying hairs or wires of known diameter. Etching is preferred. Primary vertical cross-hair 20 preferably bisects the disc 19 and intersects the optical center 21 of reticle 18. A primary horizontal cross-hair 22 is also provided, and most preferably intersects the primary vertical cross-hair at a position well above the optical center 21. Positioning the primary horizontal cross-hair in this way provides the necessary additional field of view necessary to shoot accurately at long ranges without reducing the magnifying power of the scope. Thus, the primary vertical cross-hair and the primary horizontal cross-hair form four sectors: an upper right sector (e.g., quadrant), an upper left sector, a lower left sector, and a lower right sector, when viewed through a scope properly mounted to a gun barrel as shown in FIG. 4.

A plurality of secondary horizontal cross-hairs 24 are provided along the primary vertical cross-hair 20, preferably both above and below the primary horizontal cross-hair 22 to aid in range adjustments and for locating an appropriate aiming point on the reticle with respect to the distance to the target. In one embodiment, the secondary, horizontal cross-hairs are evenly spaced. Some of these secondary, horizontal cross-hairs are provided with unique symbols 28 which are useful in quickly locating a particular horizontal cross-hair. Symbols 28 can be numbers, as shown in FIG. 2, letters or other symbols. In one embodiment the at least some of the secondary, horizontal cross-hairs are evenly spaced. In a further embodiment, at least some of the secondary horizontal cross-hairs are unevenly spaced.

A plurality of secondary vertical cross-hairs or "hash-marks/hack-marks" 26 are provided on at least some of the secondary horizontal cross-hairs 24, to aid the shooter in making adjustments for windage and for locating an appropriate aiming point on the reticle with respect to both windage and range. In one embodiment the at least some of the secondary, vertical cross-hairs are evenly spaced. In a further embodiment, the at least some of the secondary, vertical cross-hairs are unevenly spaced.

Also provided on the reticle is a means for determining range. As shown in FIG. 2, the rangefinder 30 can be provided in one of the sectors formed by the primary vertical and horizontal cross-hairs, and can include a vertical arm 32 and an intersecting horizontal arm 34. Vertical arm 32 is provided with a plurality of evenly-spaced horizontal cross-hairs which intersect vertical arm 32; horizontal arm 34 is provided with a plurality of evenly-spaced, preferably downwardly extending cross-hairs. At least some of the range-finding cross-hairs are marked to correspond to a scale useful for determining range.

The spacing between the range-finding cross-hairs can be based upon a scale, which can be referred to as the "inches of angle" (IOA™) scale. An "inch of angle" is defined as the angle made (or the distance on the reticle) which covers, bounds, or subtends, exactly one inch at 100 yards—which is referred to as a "shooter's minute of angle" (SMOA™). On the reticle shown in FIG. 2, an inch of angle is the distance between any two adjacent rangefinder cross-hairs. That is, the space between any two adjacent rangefinder cross-hairs will cover or exactly contain a one-inch target at 100 yards. A similar scale for metric shooters, which is called a "centimeters of angle" (COA™) scale, can also be used, with a centimeter of angle being the distance on the reticle that covers exactly one centimeter at 100 meters. Conventional scales, such as the "minute of angle" scale (true minute/angle) or mil Radian scale (6,283 mils/circle, 6,400 mils/circle, or any other mils/circle system), can also be used.

In one embodiment, the spacings between secondary cross-hairs on the primary vertical and horizontal cross-hairs are also determined with reference to the scale used for a rangefinder. In a further embodiment, the spacings between secondary cross-hairs on the primary vertical and horizontal cross-hairs are independent with reference to the scale used for the rangefinder. In a preferred embodiment, the spacings between secondary cross-hairs on the primary vertical and horizontal cross-hairs are in USMC mils, and the rangefinder is in IOA™. For the reticle as shown in FIG. 2, it can be seen by reference to the rangefinder that the spacing between the secondary horizontal cross-hairs labeled 5 and 6 is 5 inches of angle. A shorter secondary horizontal cross-hair appears between horizontal cross-hairs 5 and 6, at a position 2.5 inches of angle from either secondary horizontal cross-hair 5 or 6. The secondary vertical cross-hairs 26, as shown in FIG. 2, are spaced apart by 5 inches of angle.

The thicknesses of the lines may be determined with reference to the range-finding scale used. Line thickness may vary with intended use with a variety of thicknesses selected in accord with use. For example, in long-range varmint scopes line thickness may subtend only 0.1" at 100 yards. In the embodiment shown in FIG. 2, the thickness of the primary vertical cross-hair 20 and primary horizontal cross-hair 22 is 0.5 inches of angle and the thickness of the secondary horizontal and vertical cross-hairs are 0.25 inches of angle. The rangefinder arms 32, 34 and the marked (5, 10, 15) rangefinder cross-hairs are preferably 0.25 inches of angle thick, and the intermediate range-finding cross-hairs are preferably 0.1 inches of angle thick. Line thicknesses may vary between reticles. In one embodiment, a single reticle may have a variety of line thicknesses.

To use a target acquisition device and reticle of the present invention, it is preferred that the shooter becomes familiar with the characteristics of the firearm, projectile and ammunition to be used. The target acquisition device and reticle can be calibrated to work with almost any type of firearm, for example, handguns, pistols, rifles, shotgun slug guns, muzzleloader rifles, single shot rifles, semi-automatic rifles and fully automatic rifles of any caliber, air rifles, air pistols, chain guns, belt-feed guns, machine guns, and Gattling guns, to high elevation or over the horizon projectile devices, artillery, mortars, or canons or rail guns of any caliber. The target acquisition device and reticle can be calibrated to work with any type of ammunition, for example, a projectile comprising a primer, powder, a casing and a bullet, a hybrid projectile lacking a casing, a muzzle-loaded projectile, gas or air-powered projectile, or magnetic projectile.

Calibration of the Target Acquisition Device and Reticle

To calibrate the target acquisition device and reticle, in some preferred embodiments, the shooter first determines the ballistics based upon the characteristics of the weapon and ammunition to be used. Calibration for range and distance to target can follow many methods. For example, manual methods of calibration require no computer, involve trial and error by the shooter, and provide back up when higher technology-based methods fail or are not available. Computer-based calibration of the target acquisition device and reticle may be performed, for example, on desktop, laptop, and handheld personal computing systems.

The target acquisition devices and reticles of the present invention may also be calibrated using second shot methods without the shooter taking his or her eye off the target, or the rifle from the shoulder. For example, if the shooter misses on the first shot due to misjudgment of windage effect, range-to-target or other factors, the shooter may use the reticle for second-shot correction to fire a quick second shot, putting the bullet on target without calculations, and without adjustment of the target acquisition device's windage or elevation knobs. Using this method, on taking the second shot the shooter repeats the first shot exactly with reference to shooting position, sight picture, and trigger control. The only difference will be the point of targeting on the reticle. After the first shot, the shooter must remember the elevation marker line employed for the first shot, the site held on the target for the first shot, and the point where the first bullet impacted in relation to the target on the first shot. Looking through the scope, the shooter then puts the cross-hairs on the original aiming point, and notes where the bullet impacted in reference to the grid. That point of impact on the grid becomes the new targeting point for a quick and accurate second shot.

For example, as shown in FIGS. 13*a-f*, a shooter is aiming at a long-range target, using dead center of Line 8 on the reticle of the present invention for drop compensation. After firing, and missing the bull's eye, the shooter notes where the bullet struck the target. Looking through the scope, the shooter then puts the dead center of Line 8 on the target. Without moving off the target, the shooter notes on the grid where the bullet struck. Suppose, for example, the bullet struck on Line 7, and 2 hack-marks to the right of center. Line 7, 2 hack-marks to the right then becomes the new aiming point (cross-hair) for the second shot. Placing the target on Line 7, 2 hack-marks to the right, the shooter squeezes the trigger and hits the aiming point.

After a range table is generated for a set of conditions, and a shot is taken based on the solution at a given distance at, for example, 5 horizontal marks down and 2 vertical marks to the right at 800 yards, but the shot misses two more marks down and one more mark right, instead of back tracking to find which input parameter may be in error, the shooter rapidly inputs this additional adjustment into the ballistics calculator, and the calculator will make the appropriate corrections across the entire range table based on the input.

In additional embodiments, reticles of the present invention comprise lead markings. In some embodiments, lead markings on the reticle are used to aid the shooter in determining the direction and rate of movement of the target in relation to the shooter in order to target a moving object. As used herein, "rate of movement" refer to a unit of distance traveled per unit time. Any unit of distance and any unit of time are suitable for indicating rate of movement. In some embodiments, units of distance include, for example, inches, feet, yards, miles, centimeters, meters, or kilometers. In some embodiments, units of time include, for example, milliseconds, seconds, minutes, hours, days, weeks, months or years. Lead markings may occupy any position in relation to primary and secondary vertical or horizontal cross-hairs. In some embodiments, lead markings occupy positions, for example, above a cross-hair, below a cross-hair, upon a cross-hair, between cross-hairs, or at the end of a cross-hair.

In one embodiment, lead markings are evenly spaced. In other embodiments, lead markings are unevenly spaced. In further embodiments, lead markings are spaced according to average rates of movement. In some embodiments, lead markings are projected on the reticle by a ballistics calculator system. In other embodiments, projected lead markings are spaced on the reticle by a ballistics calculator system to account, for example, for the target's distance from the shooter, the target's direction of movement, the target's velocity of movement, the target's rate of acceleration, the reaction time of the shooter, or the lock time of the firearm.

As used herein, "lead markings" may take any shape or configuration. In some embodiments, lead markings may be, for example, triangles, circles, squares, straight lines, curved lines, arcs, dots, numbers, letters, crosses, stars, solid shapes, or shapes in silhouette. Lead markings may be any color, in some embodiments, for example, black, white, red or blue in color. In other embodiments lead markings serve more than one purpose serving, for example, as identification markings or range-finding markings as well as lead markings. In one embodiment, the lead markings are along at least one of the primary cross-hairs. In another embodiment, the lead markings are along at least one of the secondary cross-hairs. In yet another embodiment, the lead markings are along at least one primary cross-hair, and at least one secondary cross-hair. In a preferred embodiment, the plurality of lead markings comprises at least three lead markings. In particularly preferred embodiments, the lead markings are secondary vertical cross-hairs on a primary and secondary horizontal cross-hair. In one embodiment, lead markings are arcs along a primary and secondary horizontal cross-hair. In another embodiment, lead markings are solid circles along a primary and secondary horizontal cross-hair. In still another embodiment, lead markings are solid triangles along a primary and secondary horizontal cross-hair. In yet another embodiment, lead markings are located along a primary and secondary horizontal cross-hair in a reticle equipped with a circle as a ring for aiding users in aligning line of sight. In a further embodiment, lead markings are located along a primary and secondary horizontal cross-hair in a reticle equipped with a diamond as a ring for aiding users in aligning line of sight.

In one embodiment, reticles of the present invention comprise secondary horizontal cross-hairs along secondary vertical cross-hairs, with markings for identification purposes, of use, for example, in targeting a moving object. In one embodiment, the secondary horizontal cross-hairs are evenly spaced. In a particularly preferred embodiment, the secondary vertical cross-hairs are angled from the primary vertical cross-hair. In some embodiments, the angled secondary vertical cross-hairs are evenly spaced. In further embodiments, the angled secondary vertical cross-hairs are unevenly spaced. In still further embodiments, spacing between secondary vertical cross-hairs varies along the length of the secondary vertical cross-hairs.

Figure 14A:
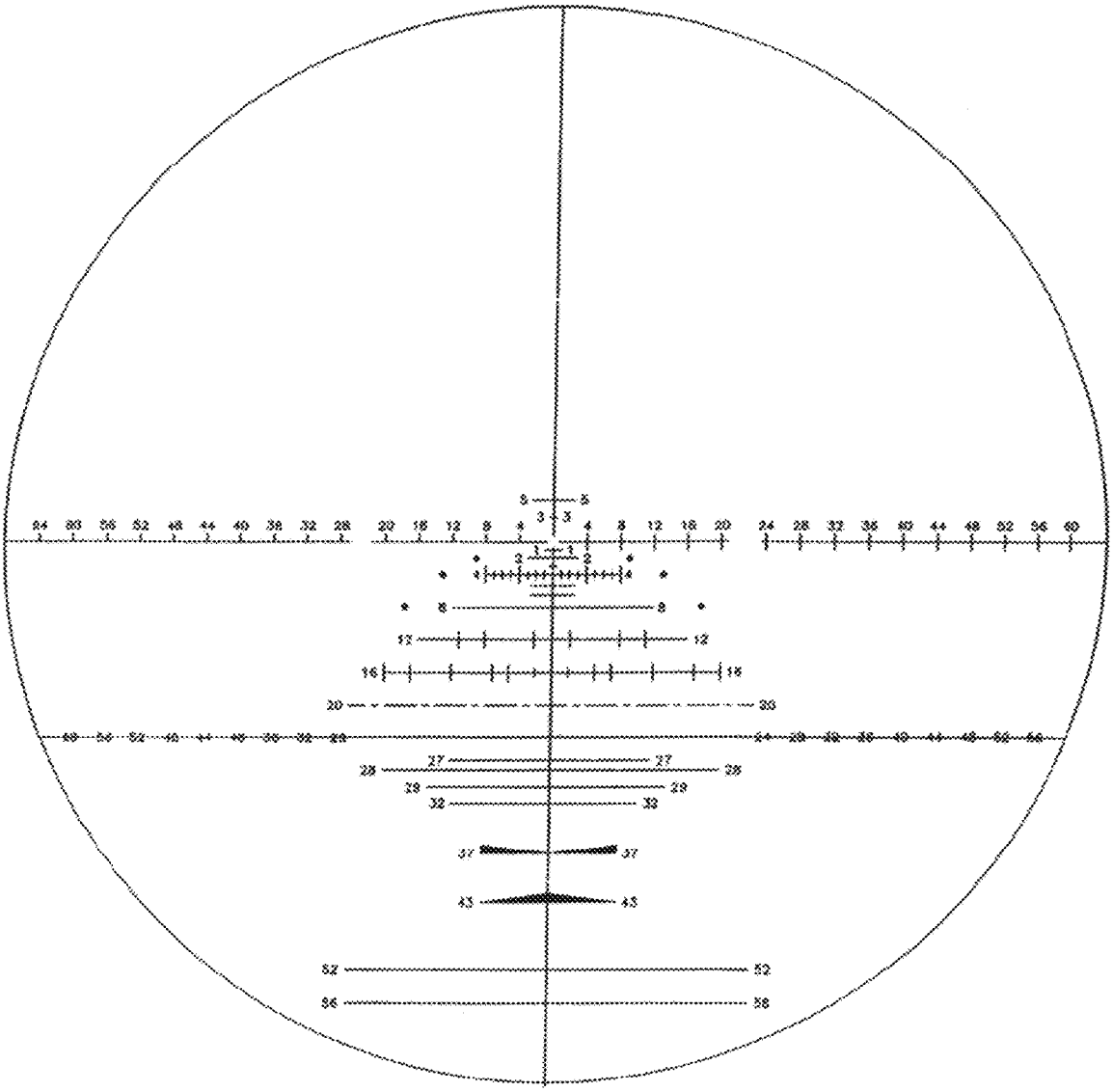
FIG. 14A is a front view of reticle markings of the present invention, showing the markings as viewed through a zoom telescopic gunsight at high power.
Figure 14A:
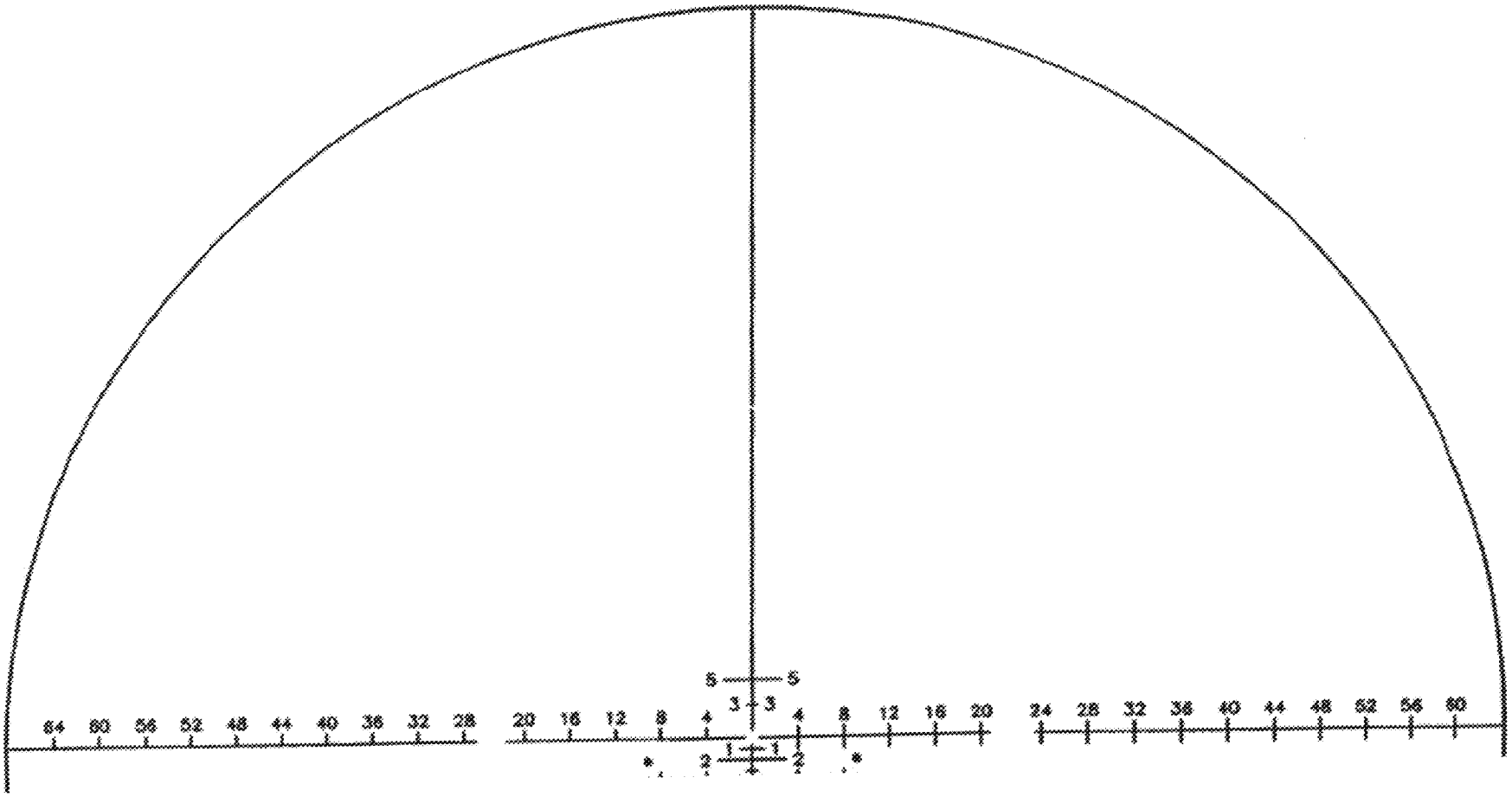
Figure 14B:
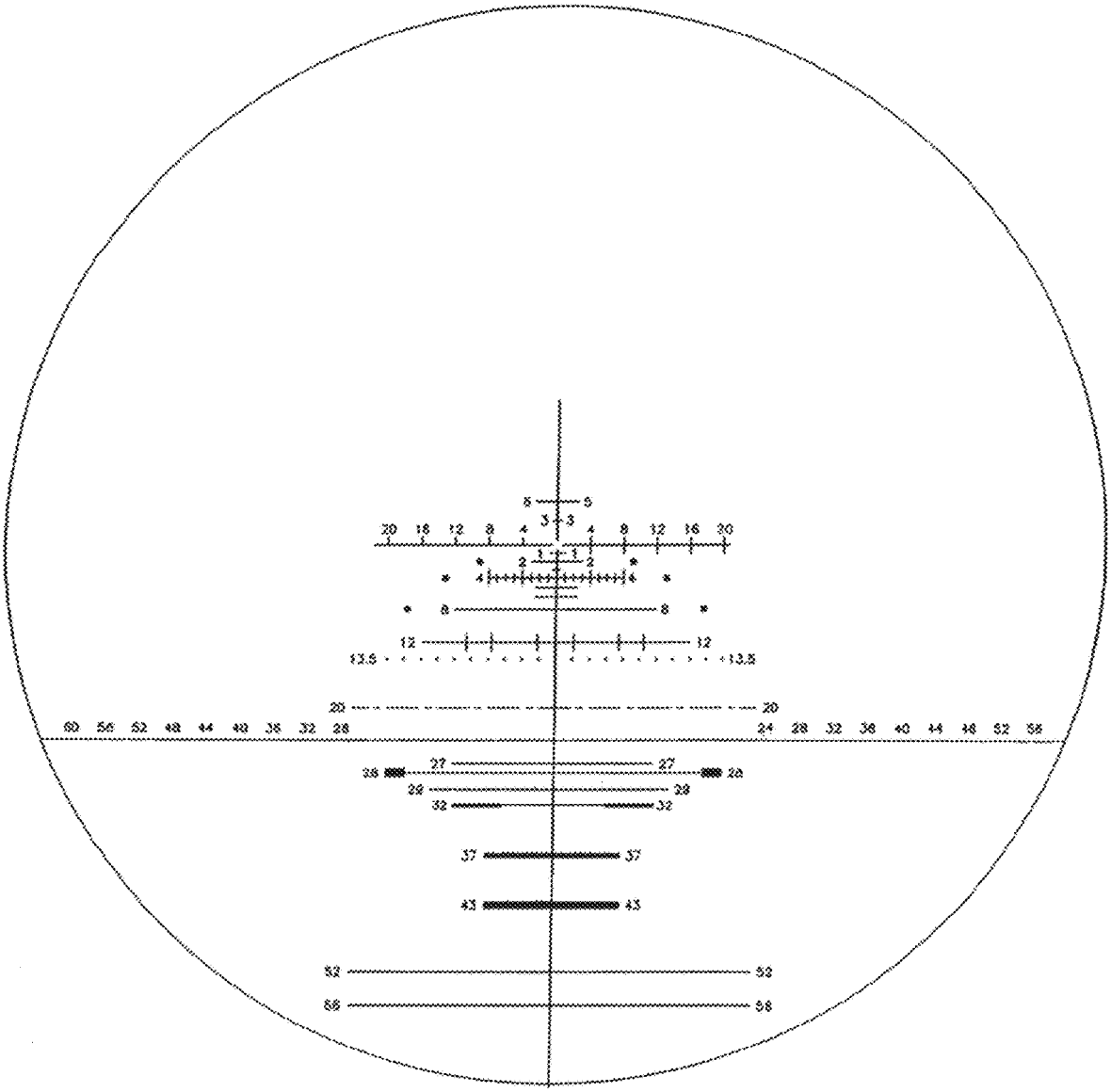
FIG. 14B is a front view of reticle markings of the present invention, showing the markings as viewed through a zoom telescopic gunsight at high power.
Figure 14B:
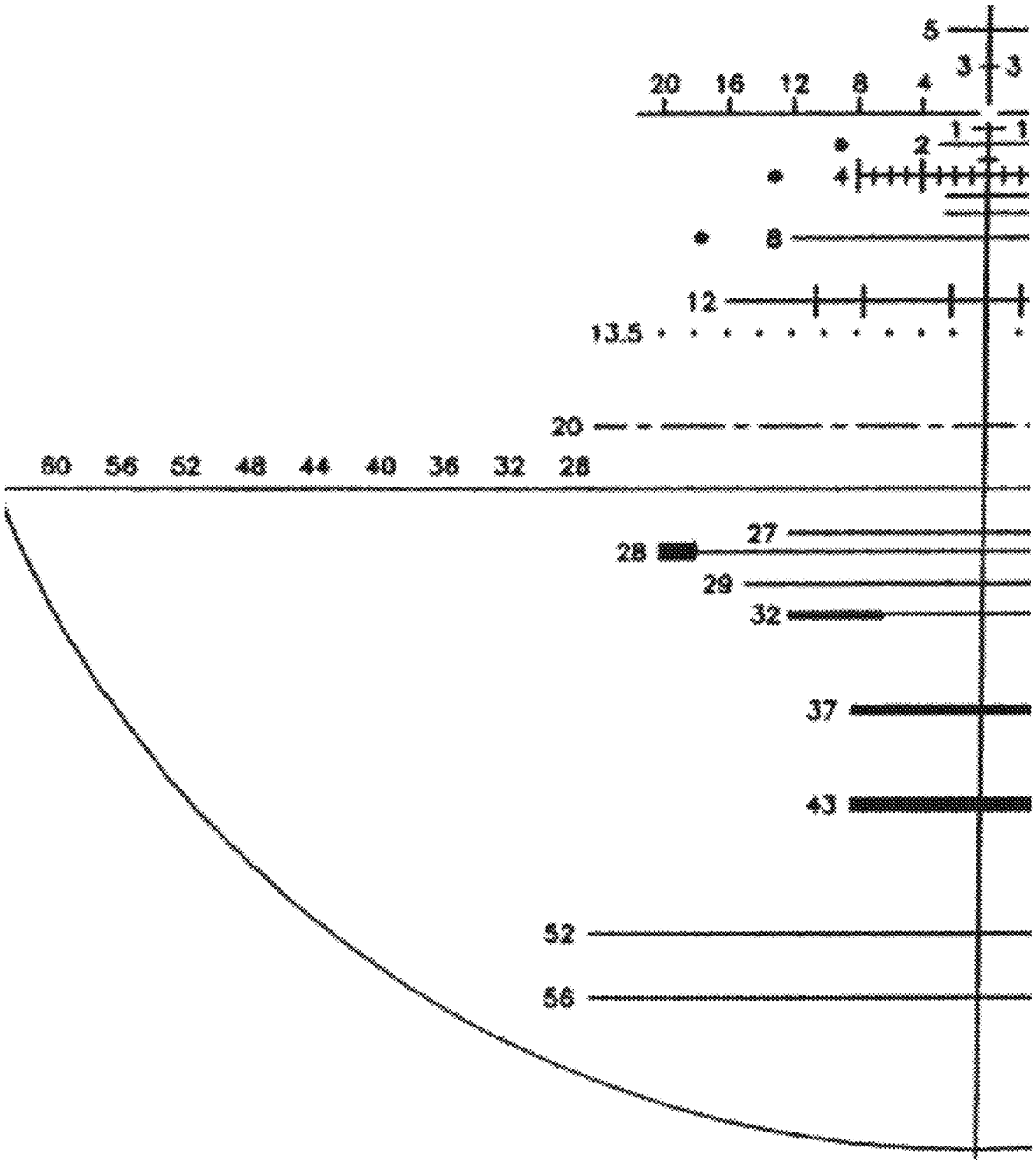

Reticles of the present invention, whether etched on glass, projected, or generated by computer over time in response to learned behavior by the shooter, or selected preferences of the shooter, may have a diversity of markings and features. FIGS. 14*a* and 14*b* demonstrate some exemplary features, any one or more of which can be applied to a given reticle. As exemplified in FIG. 14*a*, in one embodiment, reticles of the present invention comprise cross-hairs that are, for example, lines, straight lines, uninterrupted lines and interrupted lines. In other embodiments, cross-hairs that are interrupted lines are interrupted, for example, by spaces of equal length, by spaces of unequal length, or by lines of shorter length. The present invention is not limited by the nature of the cross-hairs. Numerous cross-hairs are known in the art, for example, U.S. Pat. No. 3,948,587 to Rubbert, U.S. Pat. No. 1,190,121 to Critchett, U.S. Pat. No. 3,492,733 to Leatherwood, U.S. Pat. No. 4,403,421 to Shepherd, U.S. Pat. No. 4,263,719 to Murdoch, herein incorporated by reference. In some embodiments, cross-hairs are interrupted at least once. In further embodiments, interrupted cross-hairs would intersect if segments of the interrupted cross-hairs were linearly connected along their lengths. In still further embodiments, the intersection is located, for example, at the optical center of the reticle, above the optical center of the reticle, below the optical center of the reticle, at the optical periphery of the reticle, or both the optical center and the optical periphery of the reticle.

As exemplified in FIG. 14*a*, in some embodiments, reticles of the present invention comprise cross-hairs that are of a predetermined thickness, for example a single thickness, a thickness increasing along the length of the cross-hair, or a thickness decreasing along the length of the cross-hair. As shown in FIG. 14*b*, in some embodiments, a reticle of the present invention comprises cross-hairs of single unequal thicknesses. In other embodiments, as shown in FIG. 14*b*, a reticle of the present invention comprises cross-hairs that vary in thickness along their length in steps. As shown in FIG. 14*a* and FIG. 14*b*, in still other embodiments, reticles of the present invention comprise solid cross-hairs of varying thickness. In further embodiments, as shown in FIG. 14, in some embodiments reticles of the present invention comprise hollow cross-hairs of varying thickness.

Figure 14C:
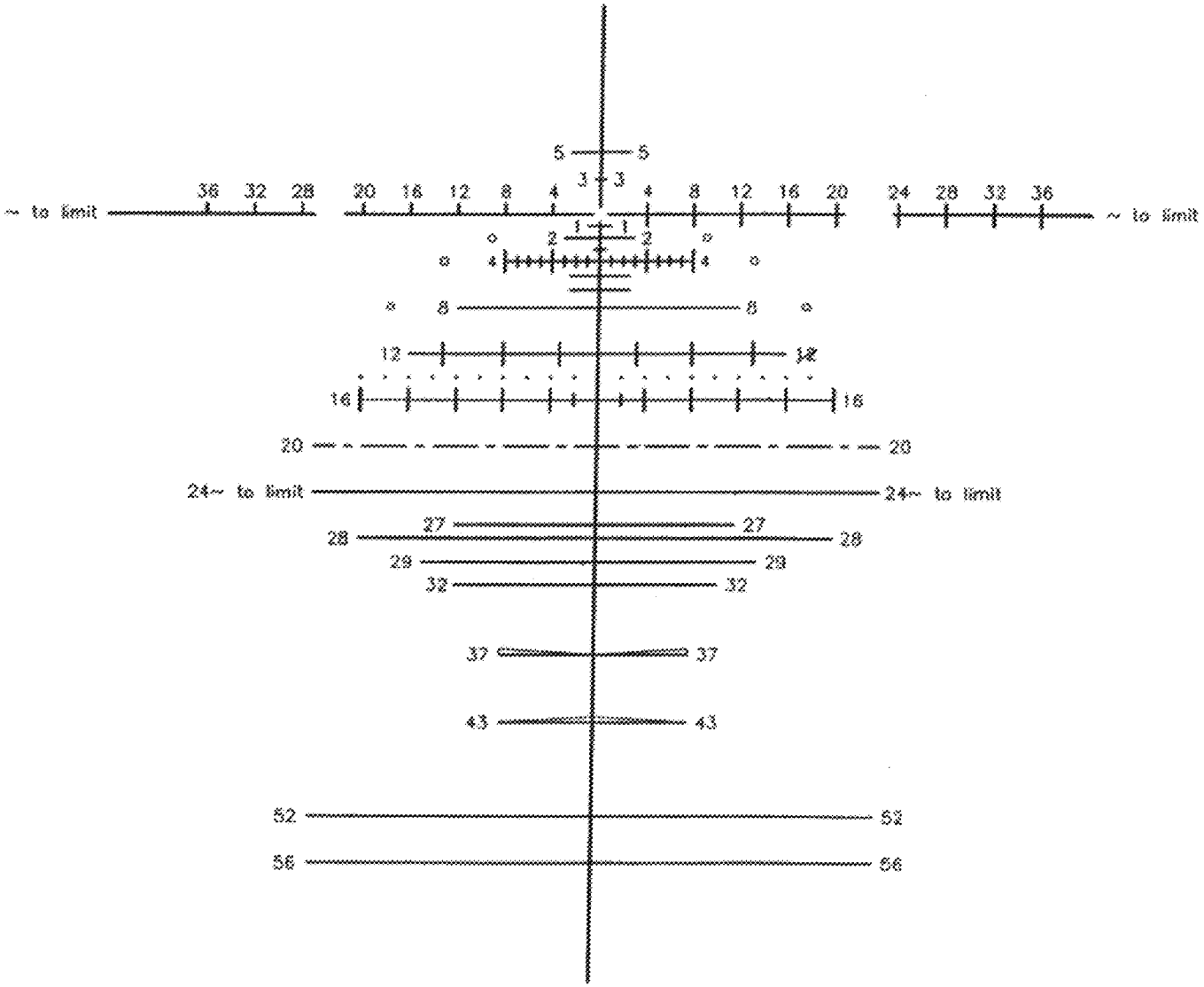
FIG. 14C is a front view of reticle markings of the present invention, showing the markings as viewed through a zoom telescopic gunsight at high power.

As exemplified in FIGS. 14*a*, 14*b* and 14*c*, in some embodiments, reticles of the present invention comprise cross-hairs that are evenly spaced. In other embodiments, reticles of the present invention comprise cross-hairs that are unevenly spaced.

In one embodiment, the reticle of the present invention comprises rangefinder markings. In another embodiment, the reticle comprises markings for identification of one or more of the cross-hairs. As used herein, "markings for identification" refers to, for example, numbers, letters, symbols, words, geometric shapes, hollow shapes, or solid shapes, located, for example on a cross-hair, above a cross-hair, below a cross-hair, at end of a cross-hair, or upon a cross-hair. In some embodiments, markings for identification vary along the same cross-hair. As shown in FIG. 14*a*, in some embodiments, identification markings are, for example, above a cross-hair, at the end of a cross-hair or superimposed upon a cross-hair. In other embodiments, as shown in FIG. 14*b*, reticles of the present invention comprise identification markings between cross-hairs. In one embodiment, as shown in FIG. 14*a*, identification markings are numbers. In other embodiments, as exemplified by FIG. 14*c*, identification markings are, for example, a letter, a word or a symbol. As shown in FIG. 14*a*, identification markings in some embodiments comprise solid dots. As shown in FIG. 14*b*, identification markings in other embodiments comprising solid dots vary in size. In other embodiments as shown in FIG. 14*c*, identification markings comprise hollow dots located, for example, at the end of at least one cross-hair.

In some embodiments, reticles of the present invention are configured for the shooter who must engage a target in the shortest possible elapsed time necessary to observe the target, range the target, and engage the target using reticle markings to correct, for example, for bullet drop or gravitational influence. In other embodiments, reticles of the present invention are used for short to medium range engagements. In additional embodiments, reticles of the present invention may be configured in a target acquisition device in any desired focal plane (e.g., first focal plane, second focal plane, or a combination of both), or incorporated into a fixed power telescopic gunsight. In other embodiments, reticles of the present invention are configured for use in a variable power scope with a low magnification range, for example, 1.5×7.5 with extended lead markings and large miles per hour numerical markings. In some embodiments, reticles of the present invention are configured for use without a priori knowledge of the range to the target to 600 meters. In some embodiments, reticles of the present invention are used to target stationary objects. In other embodiments, reticles of the present invention are used to target moving objects. In some embodiments, trainees using reticles of the present invention are taught to rapidly master and accurately hit moving targets at ranges in excess of 600 yards. A rifleman using an AR-15 style weapon mounted with a scope with a conventional MIL-DOT or similar reticle design often requires a range, or "holdover" card. The range card shows the values of leads for moving targets and the drop of the bullet due to gravity. To make a shot on a moving target at, for example, 500 yards the rifleman consults a range card and, if necessary, must adjust the turrets on his riflescope. Or the rifleman might opt for an educated guess regarding where to place the target in the field of view of the riflescope based on the information obtained from the range card.

Figure 9A:
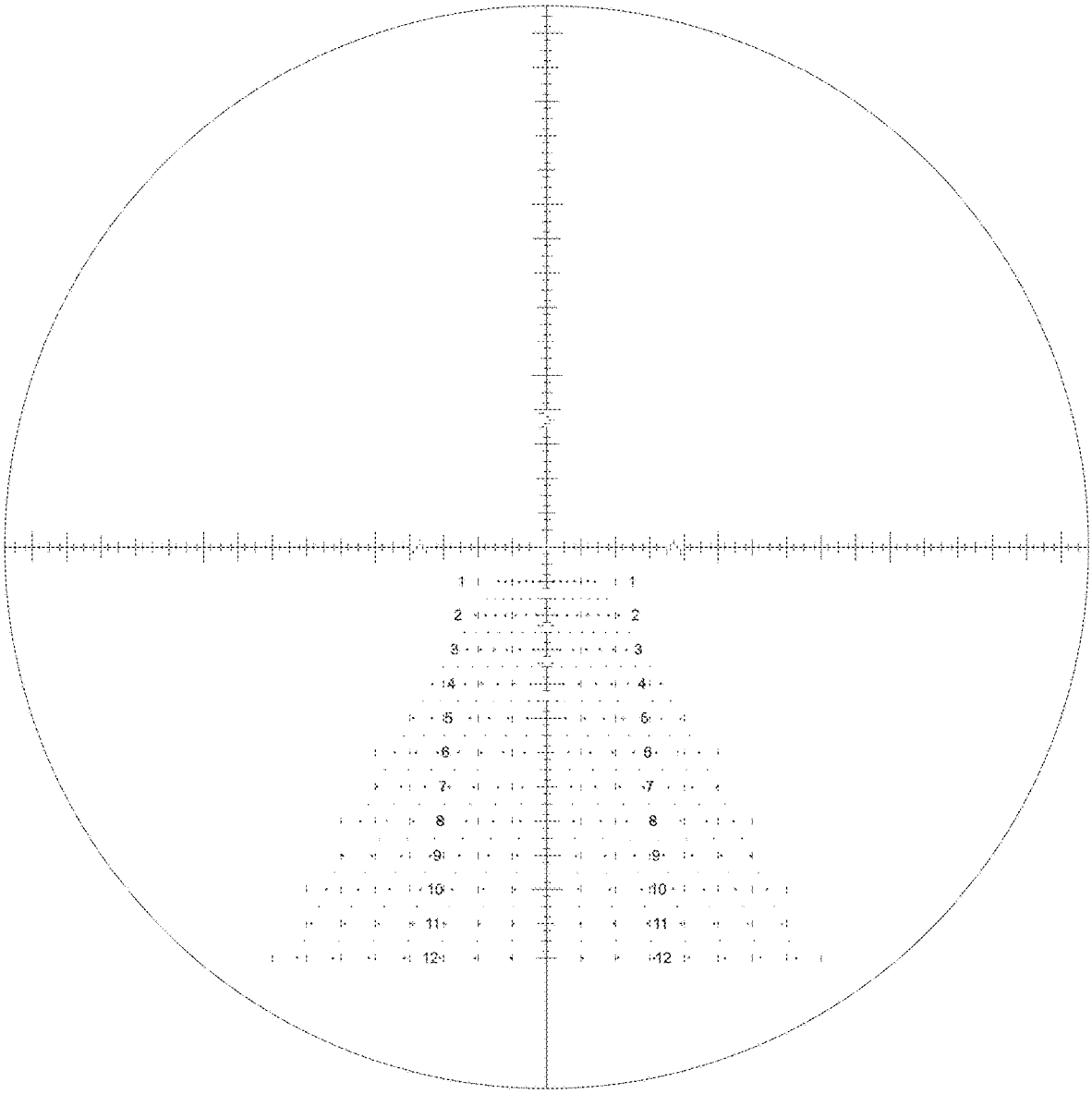
FIG. 9A is a front view of a reticle of an embodiment of the present invention, showing the markings as viewed through a zoom telescopic gunsight at intermediate power with rangefinder markings between at least one pair of secondary horizontal cross-hairs on a primary vertical cross-hair and between at least one pair secondary vertical cross-hairs on a primary horizontal cross-hair, with secondary horizontal and secondary vertical cross-hairs of predetermined incremental lengths along a primary horizontal and primary vertical cross-hair respectively, with one or more secondary vertical cross-hairs along one or more secondary horizontal cross-hairs, with gaps along a primary vertical cross-hair that correspond to a predetermined dimension of a target (e.g., 12 inches) at varying ranges, with lead markings for correction for wind and motion of a target provided by wind dots and a vertical alignment of ordered numbers suitable for use, for example, in tactical, military, police and sporting applications.
Figure 9B:
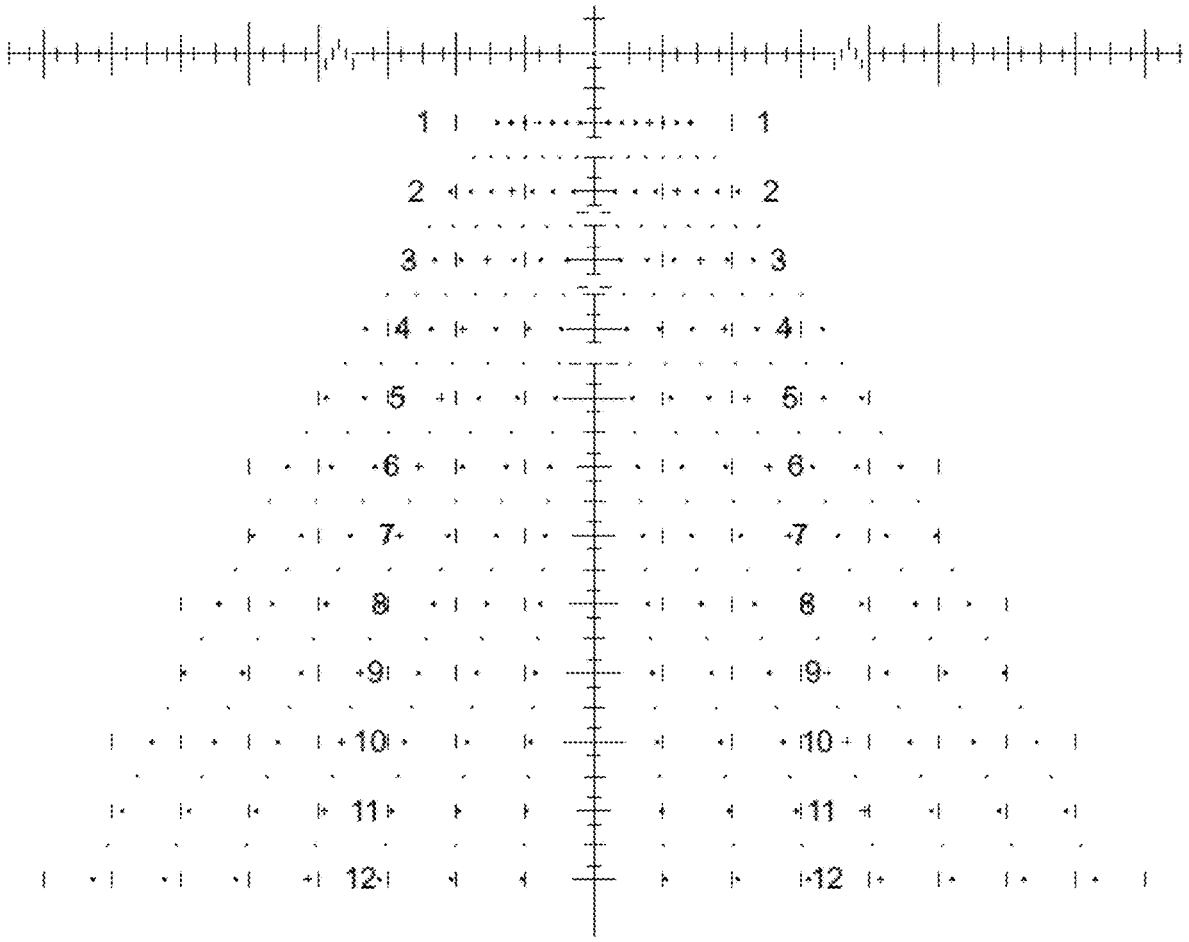
FIG. 9B is an enlarged portion of a front view of a reticle of an embodiment of the present invention as shown in FIG. 9A.
Figure 10A:
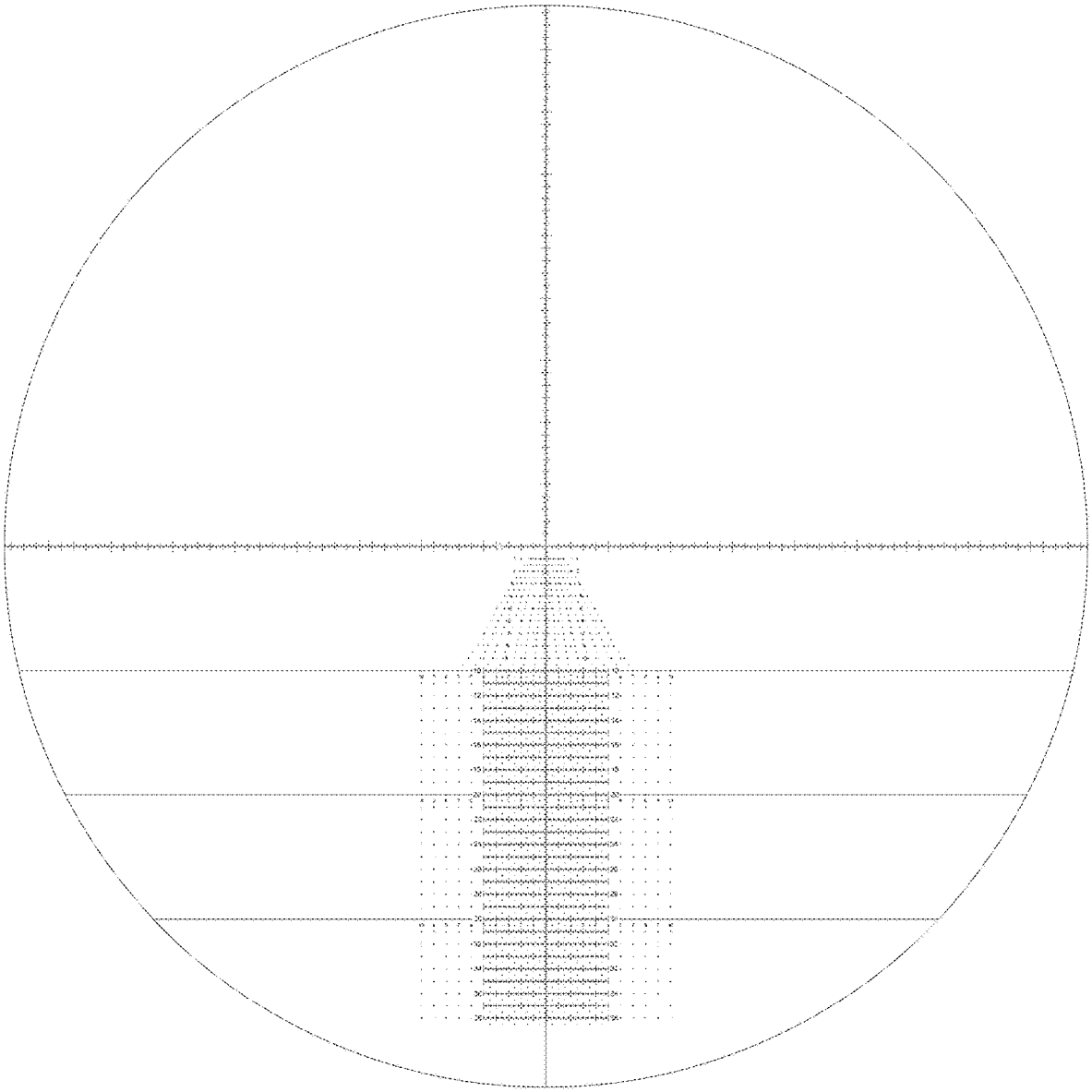
FIG. 10A is a front view of a reticle of an embodiment of the present invention, showing the markings as viewed through a zoom telescopic gunsight at intermediate power with rangefinder markings between at least one pair of secondary horizontal cross-hairs on a primary vertical cross-hair and between at least one pair secondary vertical cross-hairs on a primary horizontal cross-hair, with one or more secondary vertical cross-hairs along one or more secondary horizontal cross-hairs, with secondary horizontal and secondary vertical cross-hairs of predetermined incremental lengths, with gaps along a primary vertical cross-hair that correspond to a predetermined dimension of a target (e.g., 12 inches) at varying ranges, with lead markings for correction for wind and motion of a target provided by wind dots and a vertical alignment of ordered numbers, and secondary vertical cross-hairs along secondary horizontal cross hairs numbered from 10 to 38 suitable for use, for example, in tactical, military, police and sporting applications.
Figure 10B:
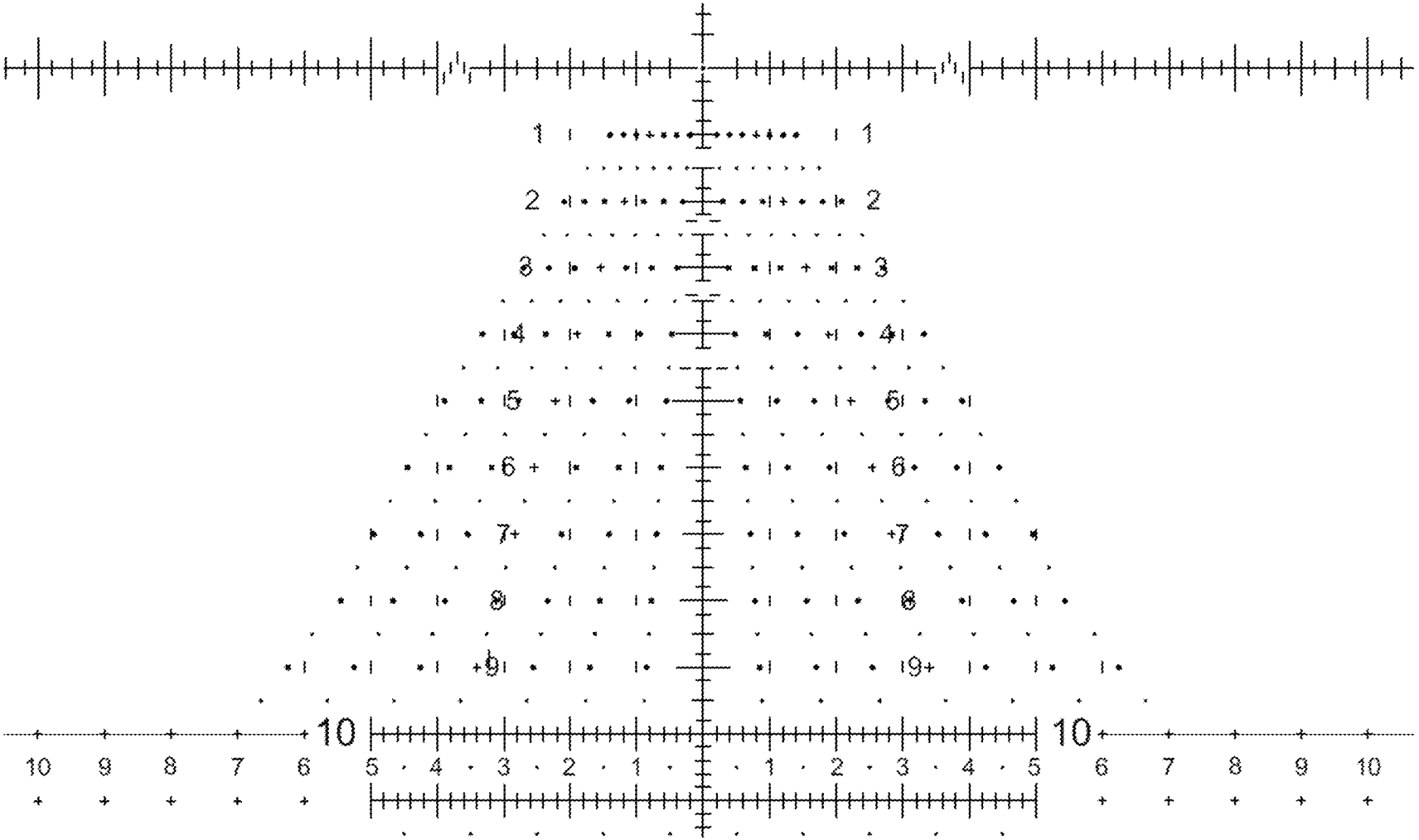
FIG. 10B is an enlarged portion of a front view of a reticle of an embodiment of the present invention as shown in 10A.
Figure 10C:
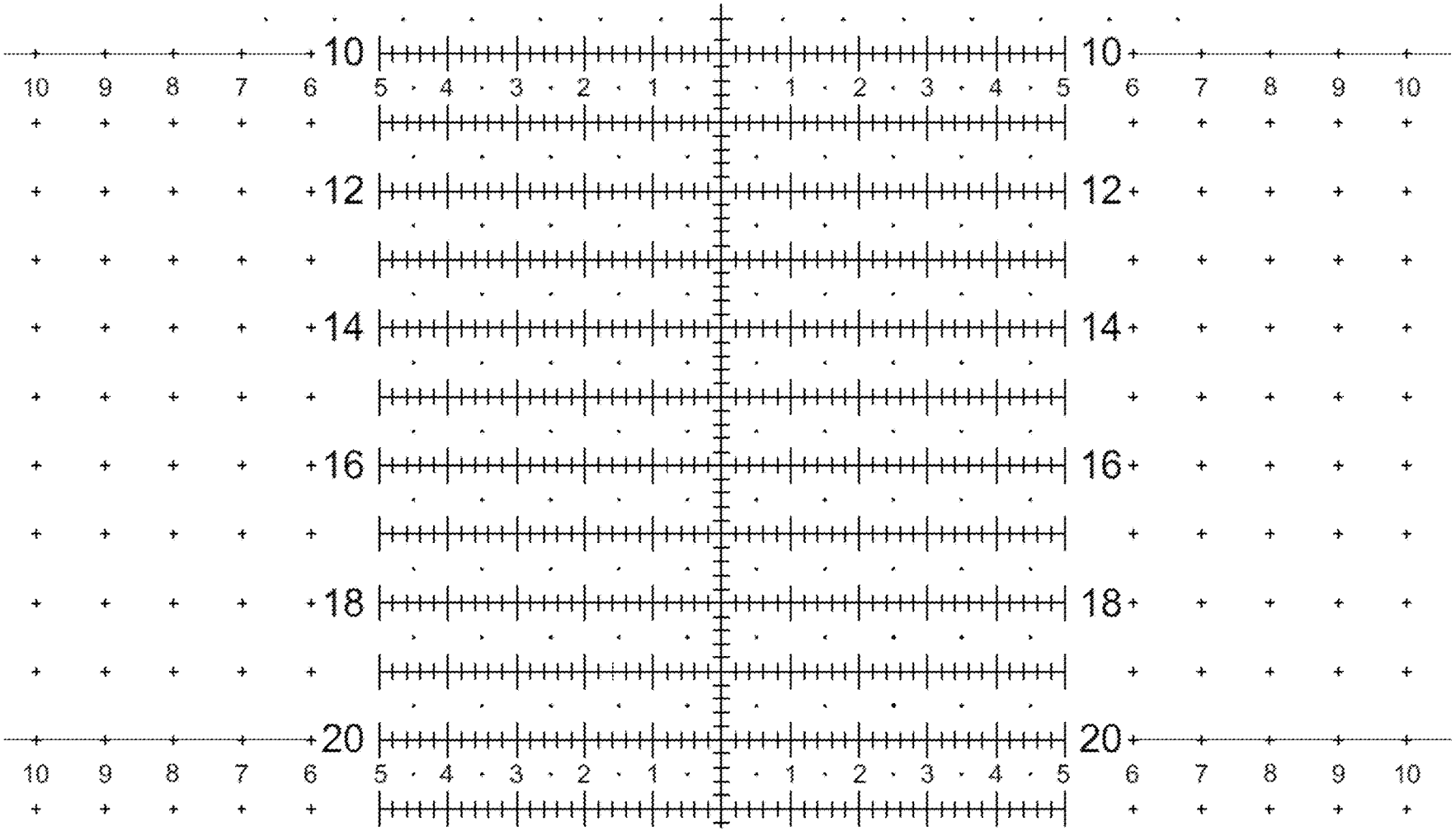
FIG. 10C is an enlarged portion of a front view of a reticle of an embodiment of the present invention as shown in 10A.
Figure 10D:
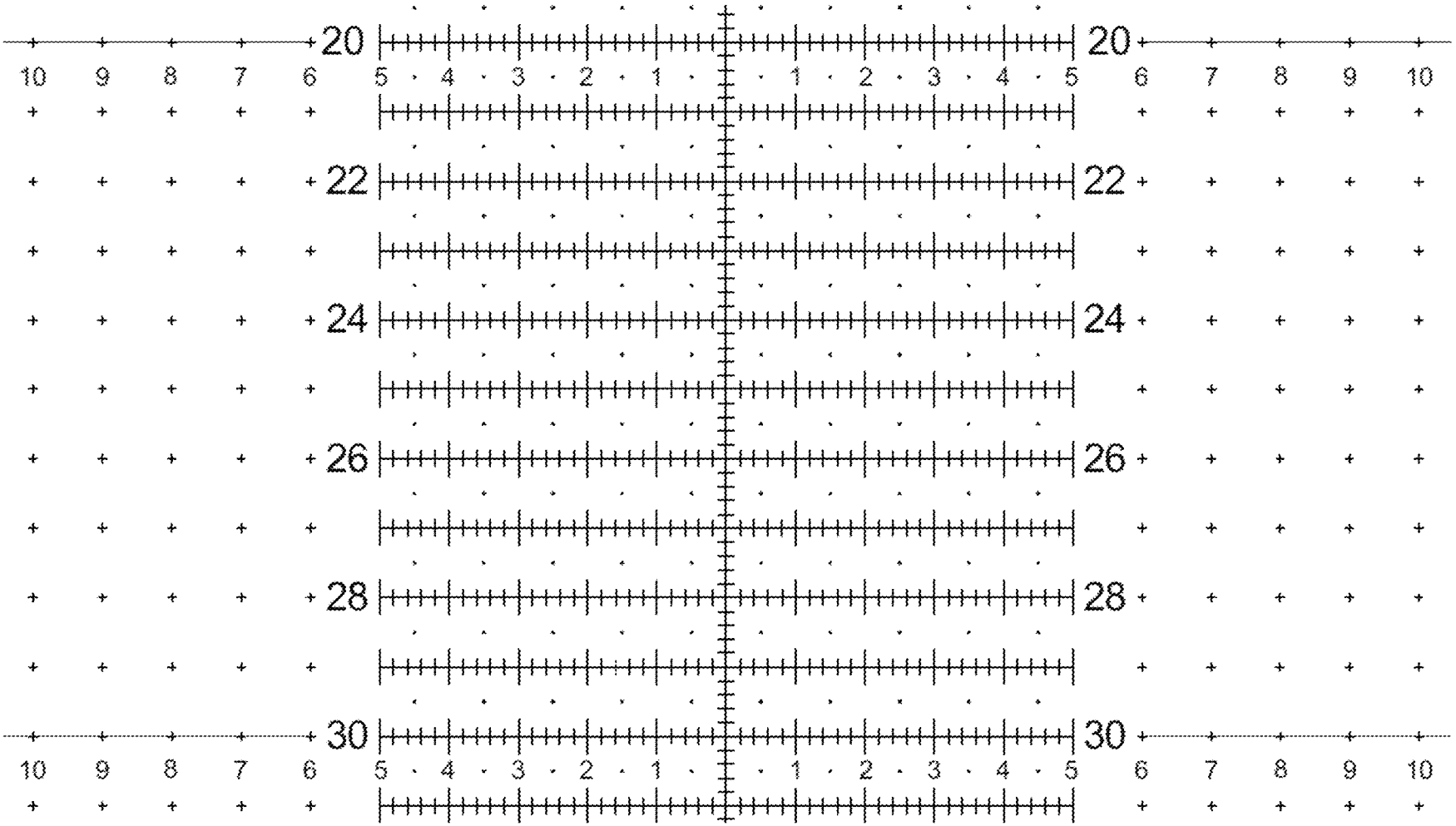
FIG. 10D is an enlarged portion of a front view of a reticle of an embodiment of the present invention as shown in 10A.
Figure 10E:
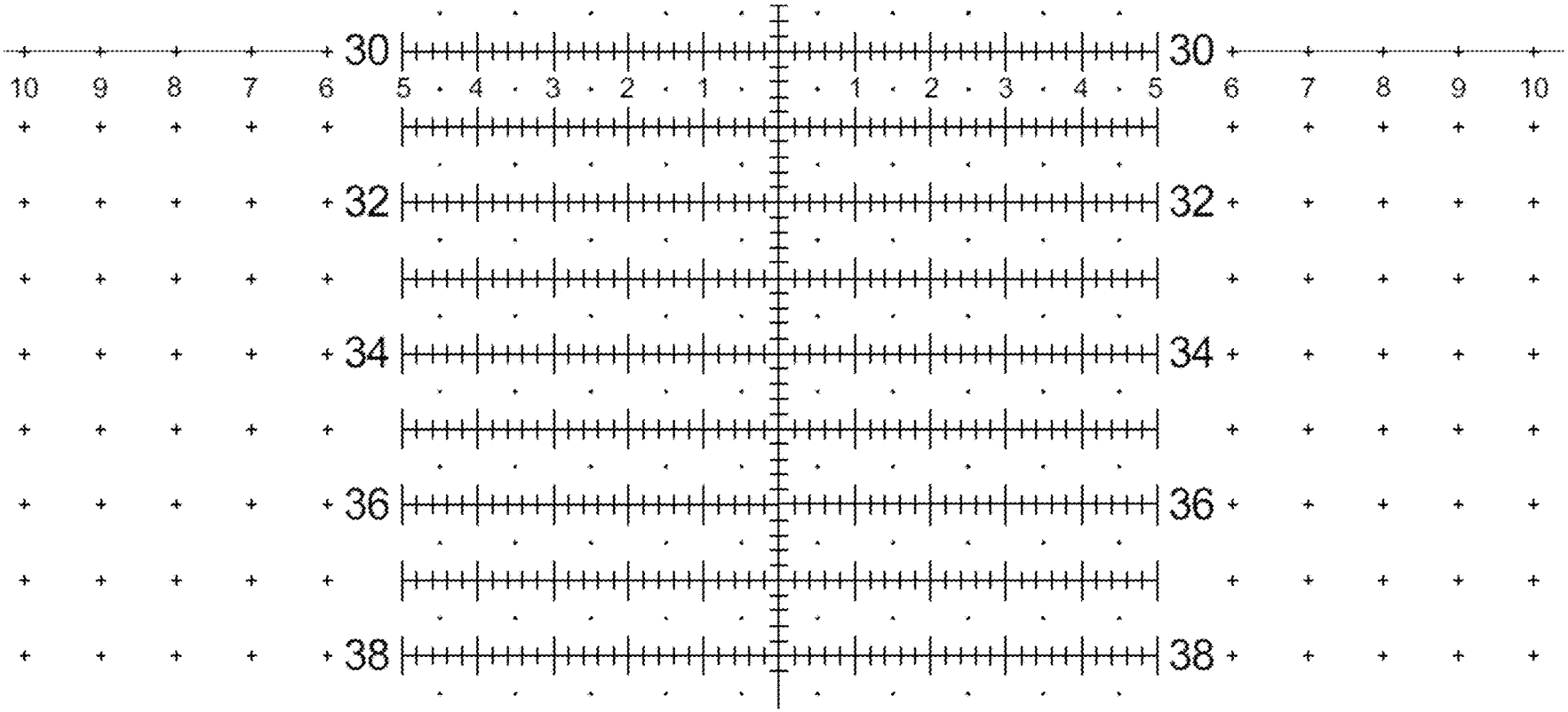
FIG. 10E is an enlarged portion of a front view of a reticle of an embodiment of the present invention as shown in 10A.
Figure 11:
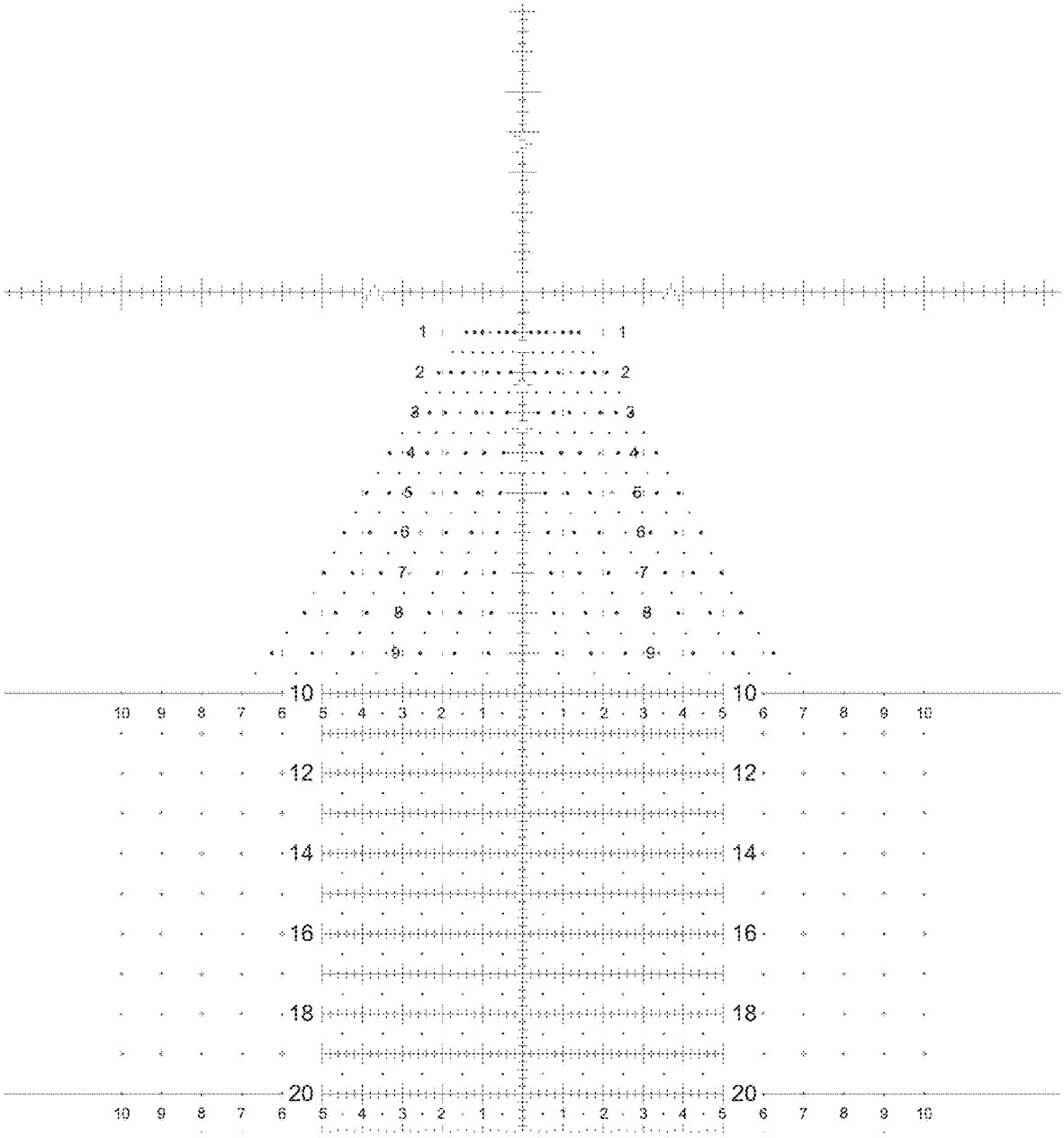
FIG. 11 is a front view of a reticle of an embodiment of the present invention, showing the markings as viewed through a zoom telescopic gunsight at high power with rangefinder markings between at least one pair of secondary horizontal cross-hairs on a primary vertical cross-hair and between at least one pair secondary vertical cross-hairs on a primary horizontal cross-hair, with one or more secondary vertical cross-hairs along one or more secondary horizontal cross-hairs, with secondary horizontal and secondary vertical cross-hairs of predetermined incremental lengths, with gaps along a primary vertical cross-hair that correspond to a predetermined dimension of a target (e.g., 12 inches) at varying ranges, with lead markings for correction for wind and motion of a target provided by wind dots and a vertical alignment of ordered numbers, and secondary vertical cross-hairs along secondary horizontal cross hairs numbered from 10 to 20 suitable for use, for example, in tactical, military, police and sporting applications.

As exemplified in FIGS. 9, 10 and 11 in some embodiments, reticles of the present invention comprise "mil lines" that are different in length. For example, a first mil line to the left or right of the intersection of a primary horizontal cross-hair and a primary vertical cross-hair may be 0.5 mils in length with successive "major mil lines" (i.e., graduated longer mil lines preceded and followed by interposed shorter lines of consistent length) thereafter 0.1 mil longer until the $5^{th}$ mil line which is 0.9 mils long. The $6^{th}$ mil line resumes at 0.5 mils in length and graduates repetitively as above. This pattern of graduated mil lines permits a shooter to use the lines in "mil-ing" the target i.e., for range estimation to the $1/10^{th}$ mil). With a target of known size, and measuring target size with the mil lines of reticles embodied herein, it is possible to estimate the range of the target. Using reticles embodied herein it is possible to measure 0.1 miles. If the target size is just over, or just under, the 0.1 mil subtension (i.e., 0.1 mil marking) the target size may be estimated within 0.03 mils. For example, if a 12" target is measured (i.e., is "milled") at 0.4 mils, the target is a 762 meters. If the target is measured at 0.43 mils using reticles herein the target range is close to 710 meters, and a missed shot may be avoided. Graduated mil lines over 5 mils, and then reiterating the length back to 0.5 mils, in length repetitively enables the shooter to rapidly orient the reticle by reference to the size of the mil lines.

As exemplified in FIGS. 9, 10 and 11, in some embodiments, reticles of the present invention comprise a V-shaped, or chevron, configuration of a mil lines pattern between, for example the $3^{rd}$ and $4^{th}$ mil lines above, and to the left and right of the intersection of the primary horizontal cross-hair and primary vertical cross-hair. In some embodiments, the spacing of the offset mil lines is 3.5, 3.6, 3.7, 3.8, 3.9 mils to the $4^{th}$ mil line. These markings enable the shooter to mil within a $1/10^{th}$ of a mil. If a shooter is able to identify a $1/10^{th}$ of a mil separation, a 0.05 mil can then be extrapolated, thereby providing high resolution in measuring the image size of a target in mils for range estimation.

As exemplified in FIGS. 9, 10 and 11, in some embodiments, reticles of the present invention comprise a gap, for example, between the 1.2 and 1.5 mil lines. In some embodiments, the gap is present to the $5^{th}$ mil along the primary vertical cross hair beneath the intersection of the primary vertical cross-hair and the primary horizontal cross-hair, thereby enabling a "speed shooting formula" to be used.

A shooter using a 5.56 or .308 caliber, or any weapon with similar ballistics, at a target that is 12" in size (for example, the distance between the top of the head and the shoulder of a human, of a coyote from the knee to the back, or of a deer from the back to the elbow joint), may use this portion of the reticle. For example, a hunter in a deer stand observes a javilina at the edge of a farm. The hunter doesn't know the exact range to the target. He places the $3^{rd}$ secondary horizontal mil line below the cross-hair on the belly of the pig. He then measures up to the two separated horizontal lines in the gap that indicates the speed mil-ing portion of the reticle. He sees that the back of the pig touches the two separated lines that indicate the speed portion of the reticle. The hunter need not perform any math, or even know the distance to the animal. The size of the target in mils has been placed at the correct position in the reticle for the shooter to take the shot. The shooter then places the $3^{rd}$ secondary horizontal mil line at the aiming point where he desires the bullet to strike the target. This process may be used for each of the areas in the reticle that have a gap between the 0.5 and 0.8 mil secondary horizontal cross hairs below the primary horizontal cross-hair (also referred to as "stadia"). A 12" target of any origin or source may be targeted using this method with reticles of the present invention.

If the shooter uses a different caliber of firearm, for example a 300 Winchester Magnum, she would then mover her aiming point up and use the mil line above the gap where the target fits in size to the "speed portion" of the reticle. For example, a hunter with a 300 Winchester Magnum, lays prone on an outcropping of a mountain. She observes a deer at a distance, but doesn't know the range. She places her reticle on the target and moves it through the speed mil-ing portion of the scope. She finds that by placing the $4^{th}$ mil line at the elbow of the deer, the back of the deer touches the two horizontal lines that are 0.1 above the 3.5 mil mark in the scope indicating that the target "mils" 0.6 in size at that range. Instead of calculating 12"/0.6×25.4 to identify the number of meters the target is distant from her position, she places the $3^{rd}$ mil line on the target where she desires the bullet to strike. If she were to use a .308 or 5.56 caliber, she would have held the $4^{th}$ mil line on the target. Accordingly, in some embodiments, the reticles and methods of the present invention enable the use of the "speed formula" for range estimation in a mil association method.

As exemplified in FIGS. 9, 10 and 11, in some embodiments, reticles of the present invention comprise time-of-flight-based wind deflection dots upon, for example, a mil-based reticle. This enables the rapidity of use of a ballistic reticle for wind correction, while preserving the capacity of the reticle to be used with any caliber rifle. Many targets are missed because of wind. Many wind correction formulas are not corrected for Density Altitude (Da). In some embodiments, wind correction formulas require use of a calculator. By placing wind directly within the reticles of the present invention, the shooter determines the strength of the wind and holds the correct wind value dot on the target without need for the calculation of wind formulas, thereby providing rapidity and accuracy of wind correction estimates. Wind dots of the reticles of the present invention may be calibrated for Da(density altitude), for example, with the use of a ballistic computer or Kestrel/Horns system, which will correct the value of the dot based on the ballistic coefficient of the bullet (Bc), muzzle velocity (Mv) and Density Altitude (Da). In preferred embodiments, dots are positioned for wind deflection based on the time of flight of a projectile, and are placed on mil lines.

For example, using a.308 or 300 Winchester Magnum, each wind dot is designated 4 mph. Conversely, a shooter using a 5.56 caliber rifle would use 3 mph for every dot. For example, a competition shooter determines that he needs to hold 7.5 mils of elevation for the target he wishes to shoot. With the use of a Kestrel handheld weather station, and by looking at mirage in his spotting scope, he determines that the wind speed is 12 mph. He now places the 7.5 mil elevation hold on the target, holds the cross-hair into the wind, and places the third dot on the target and pulls the trigger. For example, a hunter wishes to shoot a deer at 660 meters. His hold is 6 mils. He decides to dial up 5 mils on the elevation turret of his riflescope, and then hold 1 mil on the target. By dialing 5 mils on the elevation turret, he has now made the value of each wind dot half of what it was. The wind is blowing 8 mph and normally he would hold the $2^{nd}$ dot, but now, since he has made each dot worth 2 mph by dial the elevation turret up 5 mils, he hold the $4^{th}$ wind mark on the target at the elevation of the $1^{st}$ mil and takes his deer. The reticles and methods of the present invention enable a shooter improved appreciation of the value of the wind on the target's aiming point. The shooter is able to observe, for example, if the wind is blowing from 6 to 8 mph, how the wind brackets on the target, and how it may be corrected for in mph.

Figure 12:
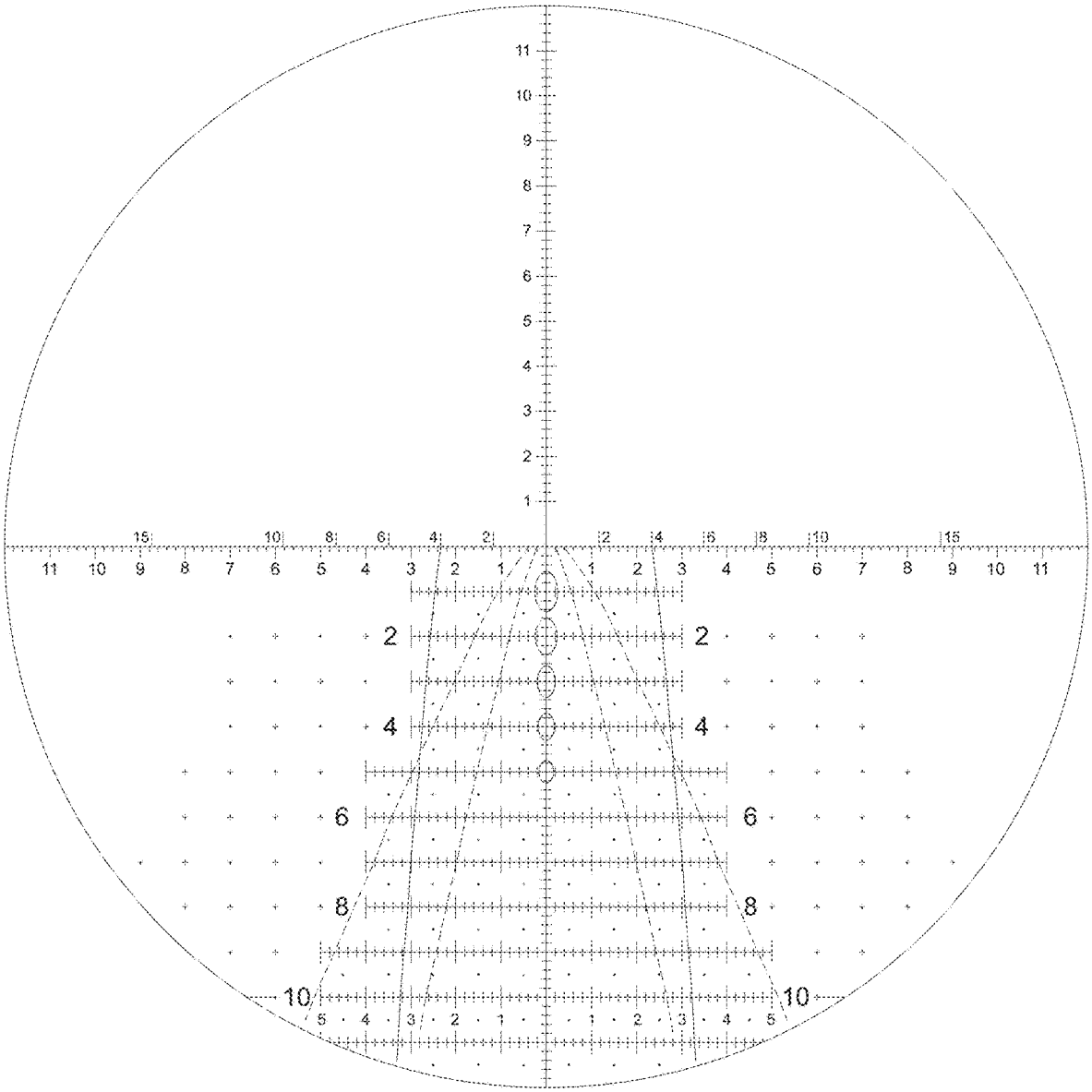
FIG. 12 is a front view of a reticle of an embodiment of the present invention showing the markings as view through a zoom telescopic gunsight at high power with one or more secondary vertical cross-hairs along one or more secondary horizontal cross-hairs, with ovals along a primary vertical cross-hair that correspond to a predetermined dimension of a target (e.g., 12 inches) at varying ranges, with lead markings for correction for wind and motion of a target provided by markings (e.g., crosses) and angled oblique lines, and with numbers above a primary horizontal cross-hair that correspond to a constant rate of motion of a target suitable for use, for example, in tactical, military, police and sporting applications.
Figure 13A:
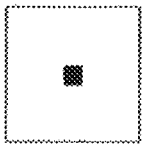
FIG. 13A illustrates a representative target for use of the reticle of the present invention for a second shot correction of a missed first shot.
Figure 13B:
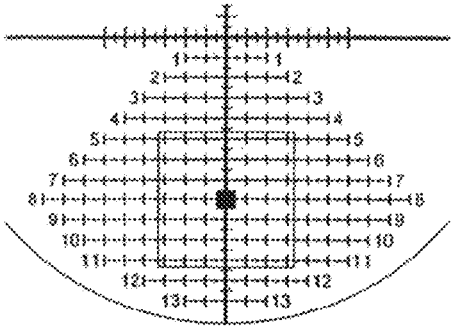
FIG. 13B illustrates a range call for using line #8 for drop compensation. For the first shot the target is placed on line #8 and the shot taken.
Figure 13C:
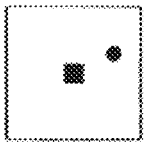
FIG. 13C illustrates that the shot taken in FIG. 13B misses the bull's eye with an impact high and to the right of the target.
Figure 13D:
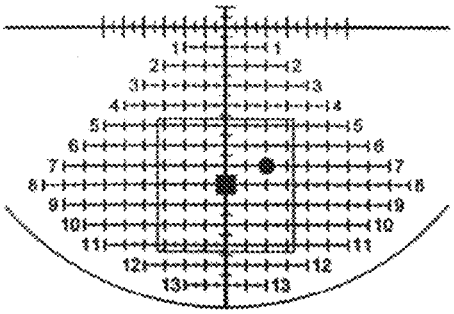
FIG. 13D illustrates that when the reticle of the target acquisition device is aligned so that the bull's eye and original aiming point are aligned (at the central cross-hair of line #8), the actual bullet impact is at line #7, 2 hack-marks to the right.
Figure 13E:
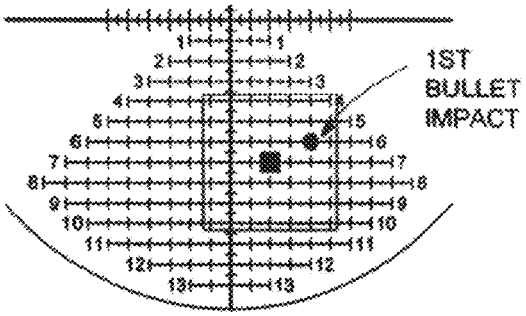
FIG. 13E illustrates that line #7 2 hack-marks (i.e., secondary vertical cross-hairs) to the right is used for the main targeting cross-hair aligned with the bull's eye for the second shot.
Figure 13F:
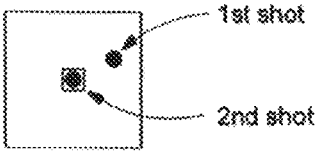
FIG. 13F illustrates that the second shot impacts the bull's eye using the impact point of the first shot on the reticle as the aiming point for the second shot.

As exemplified in FIG. 12, in some embodiments, reticles of the present invention comprise ovals on a primary vertical cross hair that correspond to a target that is 12" in size (for example, the distance between the top of the head and the shoulder of a human, of a coyote from the knee to the back, or of a deer from the back to the elbow joint) at varying ranges. For example, on arrival in theater a soldier is issued an Armalite AR 10 rifle using a 7.62×51 (.308 Winchester) cartridge, with a Harris bipod and non-sloped Picatinney rail. The soldier adds a 3.2–17×44 first focal plane scope fitted with a reticle as shown in FIG. 12 and a PVS-22 night vision device. At the range, using 175 grain ammunition, the soldier achieves a 100 meter zero of the rifle. The soldier engages numerous combatants simultaneously and sequentially in combat. Taking a prone position, the soldier identifies a target behind a vehicle, and fits the top of the head to the shoulder of the target to the oval of the reticle providing a best fit, aims and shoots. Additional combatants are ranged and targeted using ovals provided. The soldier identifies a further target moving from the left to the right of the soldier at 4 miles per hour across an open field. Using the ovals to best fit the target establishes the correct range and bullet drop. The soldier moves his aiming point to the left of the secondary horizontal cross-hair comprising the chosen oval until it intersects the 4 miles per hour lead line, and uses the intersection as the aiming point. The soldier identifies another target with a 10 mile per hour wind gusting to 19 miles per hour from 270 degrees left to right from the soldier's position. The soldier selects the preferred oval as above, and uses the secondary horizontal cross-hair upon which it is found to move his aiming point to the right until it intersects with the interrupted oblique 10 miles per hour wind line of, for example, the reitcle of FIG. 12. When the gust calms to 10 miles per hour the target is engaged. A further target comprises a vehicle moving right to left at 15 miles per hour 90 degrees to the soldier's position. The soldier uses the primary horizontal cross-hair of the reticle of FIG. 12, and places the 15 miles per hour marker on the right side of the primary vertical cross-hair upon the target in the vehicle and engages the target.

A second soldier employs an M-24 sniper rifle in .308 caliber equipped with a 4-20×50 riflescope in the first focal plane comprising a reticle as shown, for example, in FIG. 12. The rifle is sighted in at 100 meters. To engage one or more targets from the low angle of fire at which he is positioned and at 700 meters distance, the soldier does not require the ballistic ovals, wind markings or lead markings of the reticle of FIG. 12. The soldier identifies a target at 868 meters using a Vectronix PLFR 10 at an angle slope of 32 degrees of fire. The soldier enters this data into a ballistics calculator, for example a Trimble Recon, and is provided a solution of 6.84 mils elevation to engage the target at the estimated distance, correcting for the Density Altitude (Da) and ballistic parameters of the rifle.

As exemplified in FIGS. 9, 10 and 11, in some embodiments lead markings comprise secondary vertical cross-hairs upon a primary horizontal cross-hair used to aid the shooter in determining the direction and rate of movement of a target in relation to a shooter. In some embodiments, lead markings are both evenly and unevenly spaced. In further embodiments, lead markings are spaced according to average rates of movement of an object. In some embodiments, reticles of the present invention comprise numbers for identification of lead markings. In preferred embodiments, numbers for identification of lead markings correspond to average rates of movement of an object. Any unit of distance and any unit of time are suitable for numerically indicating rate of movement. In some embodiments, units of distance include, for example, inches, feet, yards, miles, centimeters, meters, or kilometers. In some embodiments, units of time include, for example, milliseconds, seconds, minutes, hours, days, weeks, months or years. In some embodiments, lead markings are evenly spaced. In other.

As exemplified in FIGS. 9, 10 and 11, in some embodiments, reticles of the present invention may be used to target an object 12" in size i.e., the average height of a man's head above his shoulders. For a target 12" in size, a specific mil size of the image corresponds to a preferred mil hold:

| Target image (Mils) | Hold |
|---|---|
| 1.2 Mils | 1 mil hold |
| 1.0 Mil | between 1 and 2 Mils hold |
| 0.8 Mils | 2 mil hold |
| 0.7 Mils | 3 mil hold |
| 0.6 Mils | 4 mil hold |
| 0.5 Mils | 5 mil hold |

In other embodiments, reticles of the present invention may be used to target objects of multiple sizes. For example, an elk measures 24" from top of its back to the bottom of its belly i.e., 12"×2=24". If the mil image of the elk is 1.6 mils, the hunter divides 1.6 mils by 2 to arrive at an image size of a 0.8 (i.e., for the image size of a 12" target). 10-8 (i.e., 0.8 free of the decimal) provides a mil hold of 2 for the elk target, and the shooter uses secondary horizontal cross-hair #2 to hold 2 mils for elevation. For a coyote 9" from the top of its back to the bottom of its belly, if a hunter fits the image of the coyote to 0.6 (i.e., the target's 9" back to belly distance best fits the distance between the horizontal line rangefinder marking and the primary horizontal cross-hair at secondary vertical cross-hair upon the primary horizontal cross-hair #8), the hunter then determines that a 12" measurement at that distance would fit the rangefinder marking a mil 0.8, and again would use a 2 mil hold for the coyote i.e., secondary horizontal cross-hair #2.

As exemplified in FIGS. 9, 10 and 11, in some embodiments reticles of the present invention comprise multiple different targeting solutions within a single reticle of use, for example, in a single outing or mission. The value of ballistic dots of conventional ballistic reticles may be limited because their placement is determined for use with a specific caliber, muzzle velocity, ballistic coefficient and density altitude. A change in one or more of these factors may make the ballistic dots errant for a given range. A shooter may adjust the elevation turret of a riflescope to compensate for a change in density altitude, but that may only correct the reticle for a specific range. Another calculation and adjustment must often be made to engage a target accurately at a different distance at that same density altitude, thereby impairing the accuracy and speed of the conventional ballistics reticle. As well, use of a conventional ballistics reticle with weapons of another caliber is limited, since the ballistic dots will not be shared with the ballistics of other weapon systems.

In some embodiments reticles of the present invention are configured for use of the reticle with an A-TRAG ballistic computer thereby giving the marksman an exact firing solution which allows a more accurate aiming point in all environments and shooting situations. In some embodiments, reticles of the present invention comprise secondary horizontal cross-hair mil lines along a primary vertical cross-hair above a primary horizontal cross-hair. In some embodiments, the secondary cross-hair mil lines provide a measured adjustment for a second shot correction. In other embodiments, secondary horizontal cross-hair mil line provide 10 mph wind hold lead markings at their outer ends.

As exemplified in FIGS. 9, 10 and 11, in some embodiments, reticles of embodiments of the present invention provide speed and accuracy in determination of aiming points at near ranges (i.e., less than 600 meters) and long ranges extending to the effective range of the weapon. In preferred embodiments, reticles of the present invention provide speed and accuracy in determination of aiming points without the requiring adjustment of riflescope elevation and windage turret knobs, for example, to compensate for changes in air density with changes in altitude. In some embodiments, reticles of the present invention comprise aiming dots of use, for example, with bullets of multiple muzzle velocities. In other embodiments, reticles of the present invention comprise lead markings of use in determination of aiming points with moving targets.

In further embodiments, reticles of the present invention are configured to provide an accurate aiming point with weapons having multiple bias values on a rail or on scope rings, thereby providing the shooter with the option of zeroing on one of two points on the reticle. For example, not all firearms have a rail base to which scope rings may be attached. Some firearms, for example, the Rugger M77 bolt action rifle, have attachment points for scope rings milled into the rifle's action. In some embodiments, reticles of the present invention are configured for use with firearms configured with scope ring attachment points that are on a bias. In preferred embodiments, a shooter who has zeroed his rifle and riflescope on the uppermost end of the primary vertical cross-hair uses use the numerical values of the secondary horizontal cross-hairs on the left side on the reticle below the primary horizontal cross-hair. In other embodiments, a shooter who has zeroed his rifle and riflescope on the intersection of the primary vertical cross-hair and the primary horizontal cross-hair uses use the numerical values of the secondary horizontal cross-hairs on the right side of the reticle below the primary horizontal cross-hair. In further embodiments, reticles of the present invention offer shooters the ability to change zero at any time to either of two or more zero points, and to have an accurate aiming point to use with different measurements for each in a single reticle.

In some embodiments reticles of the present invention comprise improved ranging capabilities, improved second shot accuracy, improved aiming points for high wind speeds and moving targets, but without the need for riflescope turret adjustments for long range shooting. As well, in some embodiments, reticles of the present invention enable the marksman to use multiple bullet weights and configurations with exact hold points on a single reticle in multiple density altitudes. In some embodiments an upper region of the reticle may be used alone for near range shooting, an upper region may be used together with a lower right quadrant region for near and long range shooting, and a lower left quadrant region may be used alone for near and long range shooting together with, for example, A-TRAG ballistics software.

In some embodiments, reticles of the present invention provide ballistics aiming reference markings for multiple caliber projectiles. Because magnum caliber ballistic trajectories are close to one another at short ranges, one aiming reference marking may be shared between calibers if it is limited to ranges, for example, under 600 meters. Similarly, one aiming reference marking may be shared between other calibers with similar trajectories to other non-magnum calibers in ranges out to 500 meters, for example, the .308 caliber. In preferred embodiments, reticles of the present invention comprise two zero points with one, for example, at the intersection of a primary vertical cross-hair and a primary horizontal cross-hair, and a second zero point at the uppermost end of the primary vertical cross-hair. Alternative zero points are desired, for example, when a shooter determines the exact hold needed and zeroes the scope and weapon at the primary cross-hair intersection, but also wishes to retain exact holds in high winds or with moving targets using a zero point at the end of the vertical cross-hair. In other embodiments, reticles of the present invention enable a marksman to use a scope mount with a bias, for example of 30 minutes of angle or more, and also be able to shoot weapons with a scope mount with a flat base, weapons with bias on the scope rail, and weapons with a rail with no bias.

In some embodiments, the range at which the upper region of reticles of the present invention enables the shooter to engage is up to 500 meters with calibers that have similar ballistics to a .308, or to 600 meters with magnum calibers. In other embodiments, reticles of the present invention may be configured for use with a specific caliber of the rifleman's choice, for example a .223 caliber, a .308 Win caliber, a .300 Ultra Mag caliber, or a .338 Lapua Magnum caliber. As well, in some embodiments reticles of the present invention provide winds holds for both ballistic indicators depending on the ballistics of the specific caliber. In some embodiments, beyond 500 to 600 meters for example, lower portions of the reticle comprising secondary vertical cross-hairs on secondary horizontal cross-hairs are used giving the shooter the capability to use exact holds for the extent of these ranges. In some embodiments, reticles of the present invention comprise ease of use and speed in operation of value for use, for example, during training and in stressful environments. In preferred embodiments, reticles of the present invention are mil-based reticles thereby offering a marksman a facile transition from conventional MIL-DOT reticles, and enabling a marksman to use aiming point holds instead of dialing adjustments to the riflescope. In other embodiments, reticles of the present invention are true minute of angle based reticles, shooter's minute of angle based reticles or, for example, yards, meters, rods or other measure of distance reticles.

Reticles of the present invention provide the benefits of a ballistic reticle together with improvements for use at ranges in which errors occur due to density altitude changes. Accordingly, in some embodiments reticles of the present invention provide new advantages, for example, the use of two zero points, and the ability to utilize any bias mount system. The addition of rangefinder markings and lead markings for speed shooting provides fast and accurate determination of aiming points without the need for a priori knowledge of the range of the engagement. In turn, extended wind dots offer precise lead markings for wind holds and moving targets, without making the scope visually cluttered. Lead markings numbered in miles per hour provide a clear indication of exact holds, and providing these above lead markings on a primary horizontal cross-hair offers more information to the shooter in a less cluttered reticle.

In some embodiments, reticles of the present invention may be used in multiple environments, with multiple varieties of ammunition. In some embodiments, reticles of the present invention are used with A-TRAG software to determine and assign values to reticle markings, for example, lead markings. In other embodiments, a region of the reticle above a primary horizontal cross-hair may be used to engage targets to 500 meters without targeting software. In some embodiments, the intersection of a primary vertical and primary horizontal cross-hair comprises a zero point. In other embodiments, reticles of the present invention comprise two zero points, for example, at the intersection of the primary vertical cross-hair and the primary horizontal cross-hair, and at the uppermost end of a primary vertical cross-hair.

In some embodiments, secondary horizontal cross-hairs above the intersection of a primary vertical and horizontal cross-hair are evenly spaced. In preferred embodiments, secondary horizontal cross-hairs along a primary vertical cross-hair above the intersection of a primary vertical and primary horizontal cross-hair are evenly spaced Mil cross-hairs. In other embodiments, secondary horizontal cross-hairs above the intersection of a primary vertical and horizontal cross-hair are unevenly spaced.

In some embodiments, reticles of the present invention comprise lead markings used to aid a shooter in determining the direction and rate of movement of a target in relation to a shooter. In some embodiments, lead markings comprise secondary vertical cross-hairs upon a primary horizontal cross-hair. In some embodiments, reticles of the present invention are configured to provide a aiming points for multiple cartridges regardless of bullet weight and construction (for example, a 40 grain .22 Long Rifle, a 130 grain .270 Winchester, a 200 grain .30-378 Weatherby, a 300 grain .338 Lapua Magnum), and are not confined to the use of a single cartridge. In some embodiments, reticles of the present invention are configured to provide aiming points with multiple meteorologic and atmospheric conditions for example, from Death Valley, Calif. at about 278 feet below sea level to the top of Mount Everest at about 29,000 feet above sea level. In some embodiments, reticles of the present invention allow the targeting range to be adjusted by the rifleman from a near point blank position target range to 1000 meters, 1500 meters, 2000 meters, 2500 meters and beyond. In some embodiments, reticles of the present invention provide aiming points in compensation for changes in the ballistic coefficient caused by changes when a bullet shifts from super-sonic flight, to trans-sonic flight, and to sub-sonic flight.

In some embodiments reticles of the present invention, comprise precision mil-marking clusters interspersed throughout the reticle enable fast and accurate measurements at 0.1, 0.2, 0.5 and 1.0 mil increments. In other embodiments, reticles of the present invention further provide embodiments of an Accuracy First Speed Shooting Formula™ (aka: Accuracy First 12" Drill) with features for adjustments to a range of 600 meters and beyond. This system reduces the need for calculations, ranging, or knowing distance to target. In certain embodiments, peed-shooting markers are embedded into the reticle's main vertical stadia (i.e., primary vertical cross-hair) at the elevation holds, thereby enabling rapid bullet drop adjustments wherein the act of sizing a target automatically places it behind the correct bullet drop cross-hair. Similarly, reticles of the present invention provide fast and easy windage adjustments by embedding windage dots directly into drop hold secondary cross-hairs. Accordingly, there is less need for the shooter to sight in at one spot and then transpose downward for an adjustment.

In addition to speed-shooting features, reticles of the present invention provide the grid adjustments beyond 600 meters in some embodiments. Additionally, reticles of the present invention in further embodiments comprise unobtrusive dots for wind and elevation guides. The dots extend hold markings beyond the grid-based reticles, while allowing for a clear uncluttered view.

Figure 15:
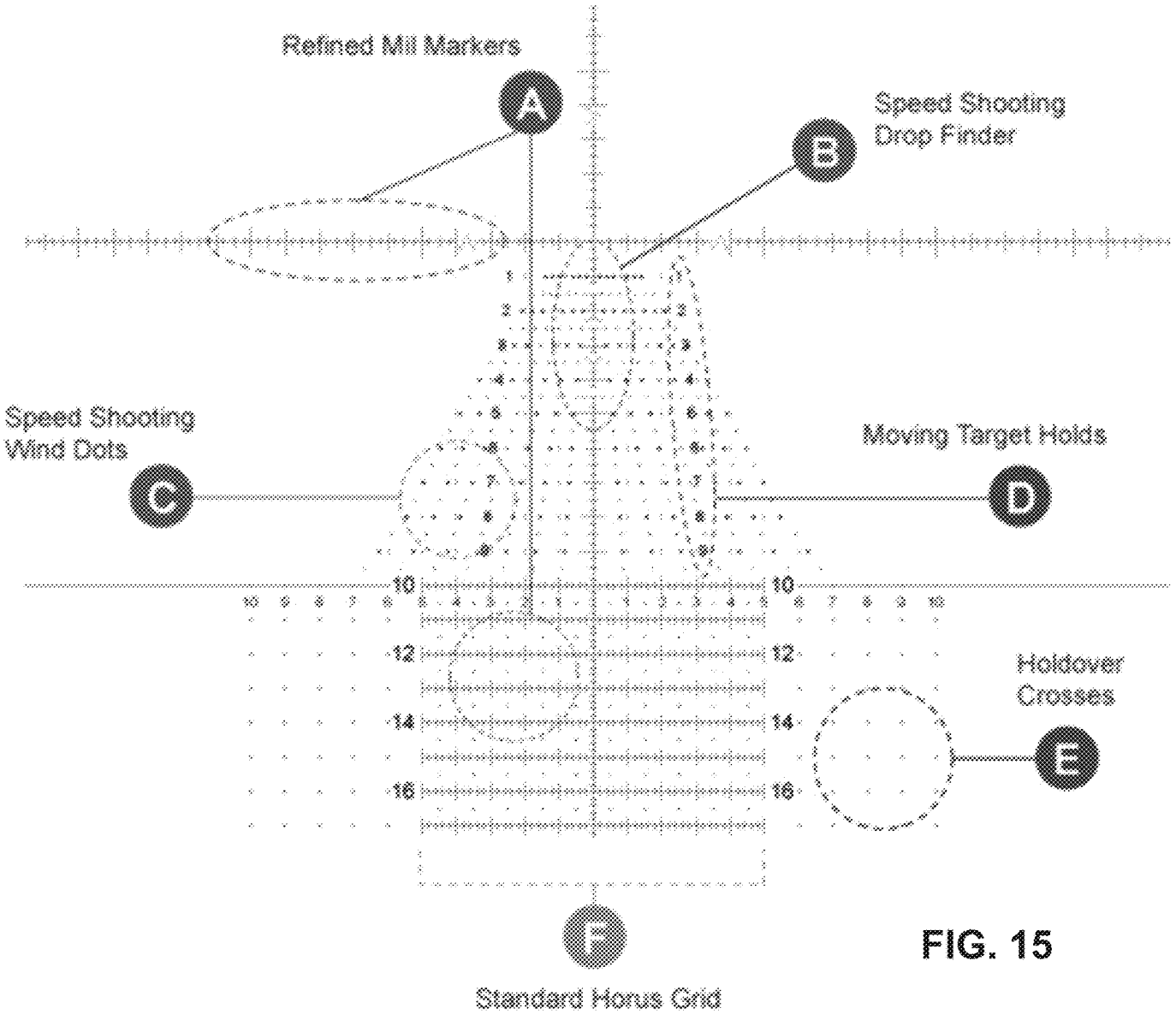
FIG. 15 is a front view of a reticle of the present invention showing mil markers, speed shooting wind dots, speed shooting drop finder markings, moving target hold markings, and hold over cross markings.
Figure 16:
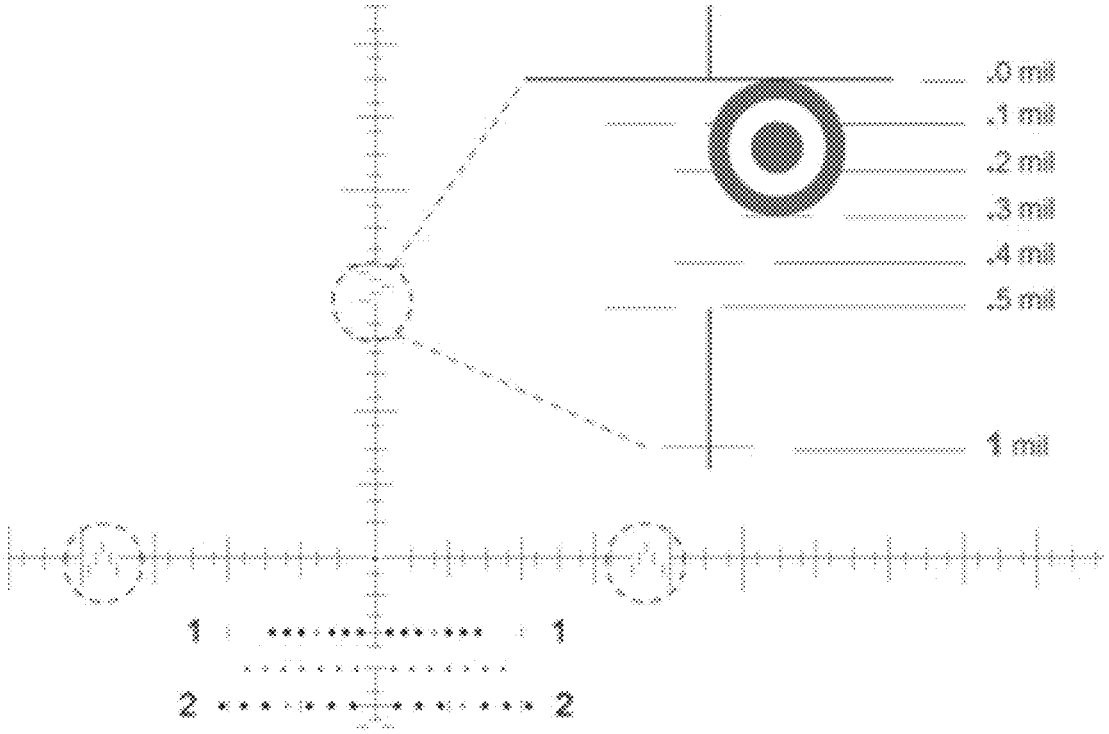
FIG. 16 shows chevron clusters on the primary horizontal and vertical cross-hairs of reticles of the present invention.

In some embodiments, reticles of the present invention comprise refined mil markers, speed-shooting features, moving target holds, speed-shooting wind dots and holdover crosses. (FIG. 15) In some embodiments, reticles of the present invention provide refined mil markings throughout the reticle for measuring targets and milling distances. In further embodiments, these mil markers are arranged in clusters throughout the reticle, thereby providing fast intuitive measuring guides in 0.1, 0.2, 0.5 and 1.0 mil increments. For example, in some embodiments, the reticles of the present invention provide clusters of refined nil-markers arranged in bird-flock shaped chevron patterns. These bird-flock chevrons allow refined milling of targets at 0.1, 0.2, 0.3, 0.4 and .5 mils. In still further embodiments, such clusters are embedded within the reticle's primary horizontal and primary vertical cross-hair (stadia). (FIG. 16) In certain embodiments, three bird-flock clusters of refined mil markers are embedded into primary horizontal and vertical cross-hairs of the present invention. Each cluster may be comprised of five 0.1 mil increments, enabling rapid measuring from 0.1 to 0.5 mils. FIG. 16 shows a target measuring 0.3 mils.

Figure 17:
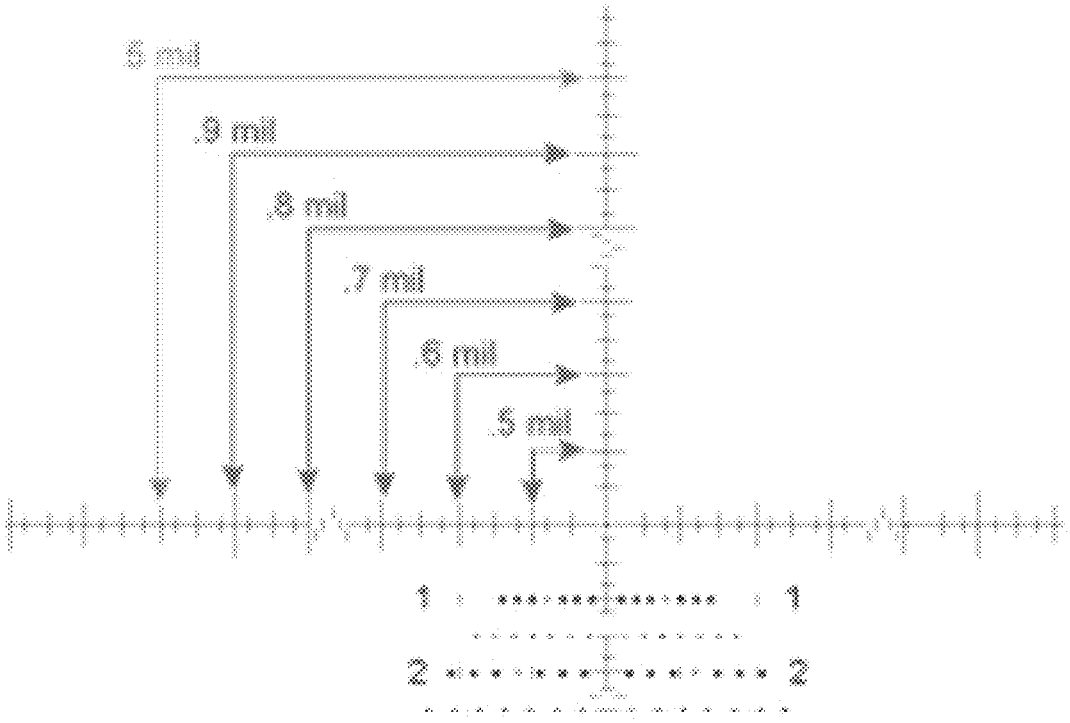
FIG. 17 shows a pattern of lengthening measuring markers embedded into the primary horizontal and vertical cross-hairs of the present invention.
Figure 18:
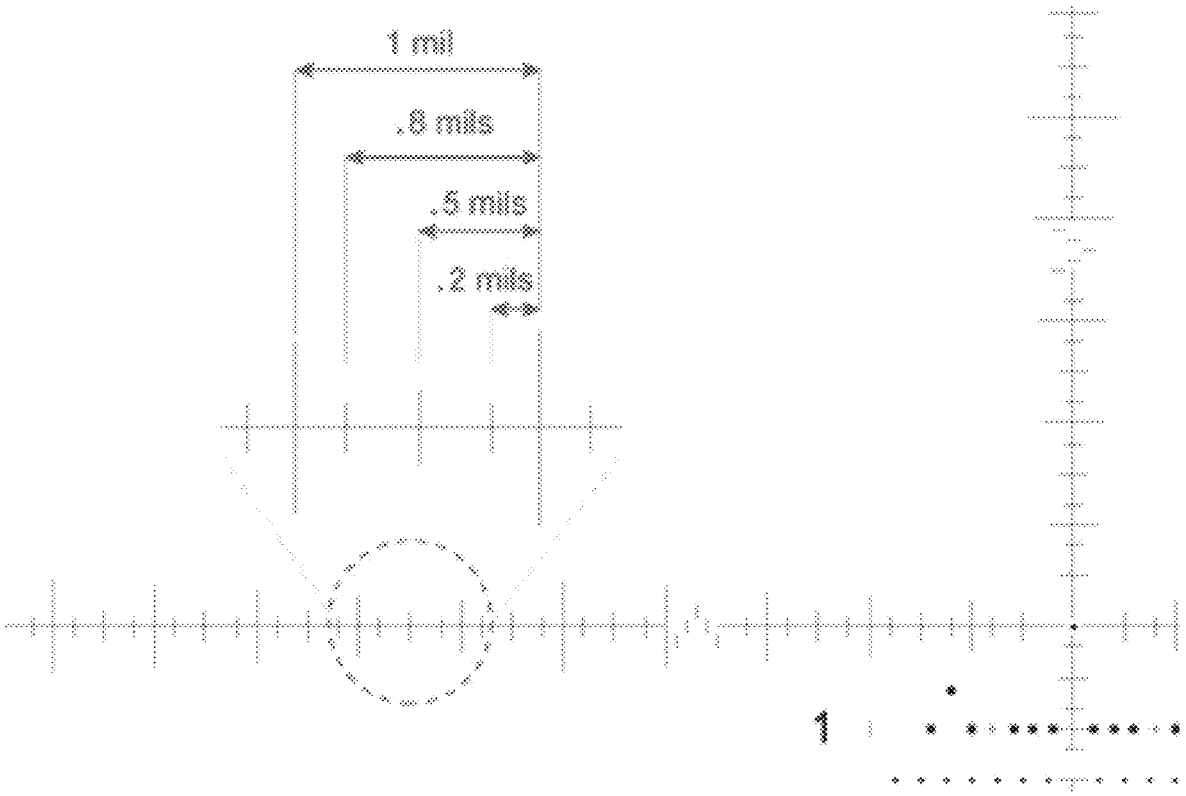
FIG. 18 shows a repeating pattern of hash marks (i.e., hack marks, or secondary vertical cross-hairs) along primary horizontal cross-hair and vertical cross-hairs of reticles of the present invention.

In some embodiments, the reticle's primary horizontal and vertical cross-hairs are intersected by hash marks (i.e., hack marks or secondary vertical cross-hairs) at 1-mil increments. In preferred embodiments, the lengths of three hash marks lengthens from 0.5 mils, to 0.6, to 0.7, 0.8, and 0.9 mils in order. This pattern then repeats itself. In particularly preferred embodiments, the repeating pattern of expanding lengths provides a means for precisely measuring targets along the reticle's two primary cross-hairs, but does not appear along the portion of the reticle's primary vertical cross hair contained within the aiming grid grid. FIG. 17 shows the pattern of lengthening markers aligned on a reticle's primary vertical and horizontal cross-hair. At 0.9 mil, the pattern begins again at 0.5 mil, as indicated. In some embodiments, reticles of the present invention comprise primary horizontal and vertical cross-hairs that are incremented with repeating patterns of hash marks. In further embodiments, the larger of the hash marks are spaced at 1.0 mil increments. In certain embodiments, the 1.0 mil increments are subdivided by a repeating pattern of smaller hash marks. The smaller repeating pattern provides fast milling at 0.2, 0.5, 0.8 and 1.0 mil increments in a pattern that repeats throughout the reticle's primary horizontal and vertical cross-hairs above the 10.0 mil drop line. In some embodiments, the pattern does not occur within the aiming grid. FIG. 18 shows an exemplary embodiment of a repeating pattern of hash marks along the primary horizontal and vertical cross-hairs that provides 0.2, 0.5, 0.8 and 1.0 mil measurements.

Figure 19:
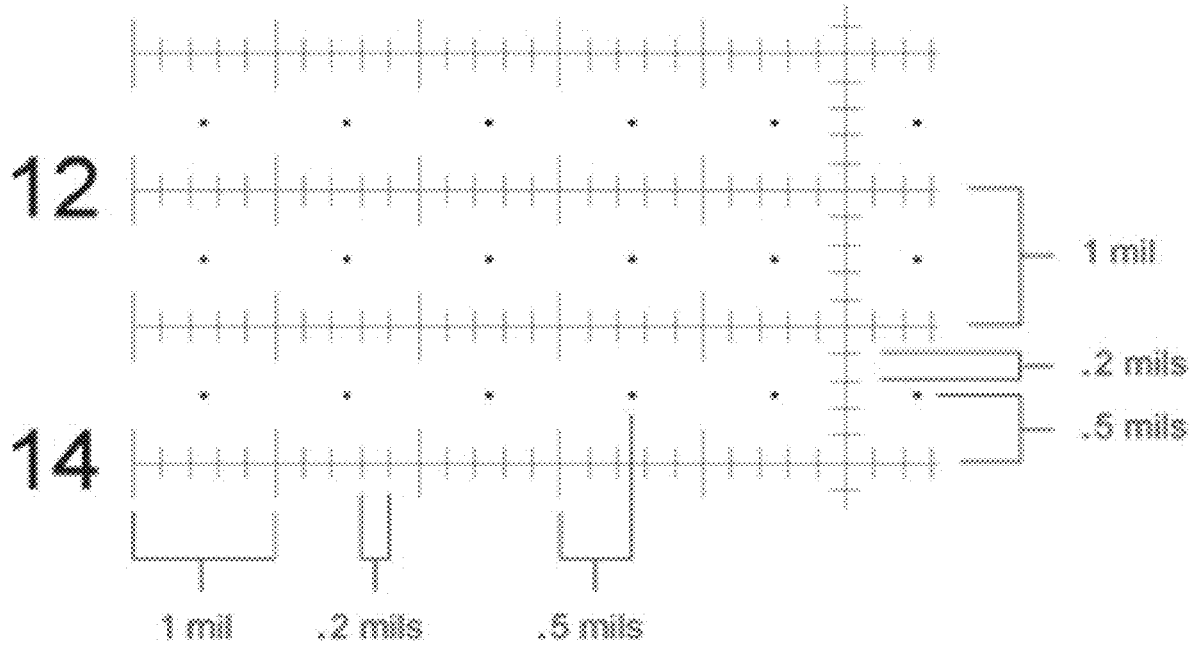
FIG. 19 shows 3 lengths of mil markers within an aiming grid of reticles of the present invention.

In some embodiments, the present invention comprises three types of mil markers: small 0.2 mil hash mark, larger 1.0 mil hash marks, and 0.5 mil dots. (FIG. 19) 0.2 mil hash marks within the aiming grid indicate 0.2 mil increments.

In other embodiments, hash marks indicating 1.0 mil increments occur throughout the reticles of the present invention. In certain embodiments, the 1.0 mil markers have different appearances depending on where they occur within the reticle. In further embodiments, 0.5 mil dots within the aiming grid indicate 0.5 mil increments. In other embodiments, reticles of the present invention comprise three distinct kinds of mil markers within the aiming grid: small 0.2 mil hash, larger 1 mil hash, and 0.5 mil dots. Additional mil markers appear above the aiming grid, including hash marks along the reticle's primary horizontal and vertical cross-hairs (shown inside the dotted circle of FIG. 19), in addition to smaller 1.0 mil hash marks which extend the aiming grid upward throughout the Accuracy 1st Speed Shooting pyramid. In some embodiments, reticles of the present invention comprise refined mil markers allow shooters to perform extremely rapid elevation adjustments for targets out to 600 meters without removing their eye from the target, make calculations, turn knobs or even be able to recite distance to target. In further embodiments, a Speed-Shooting Drop Finder quickly translates a 12" target's milled height into a drop hold within seconds.

Figure 20:
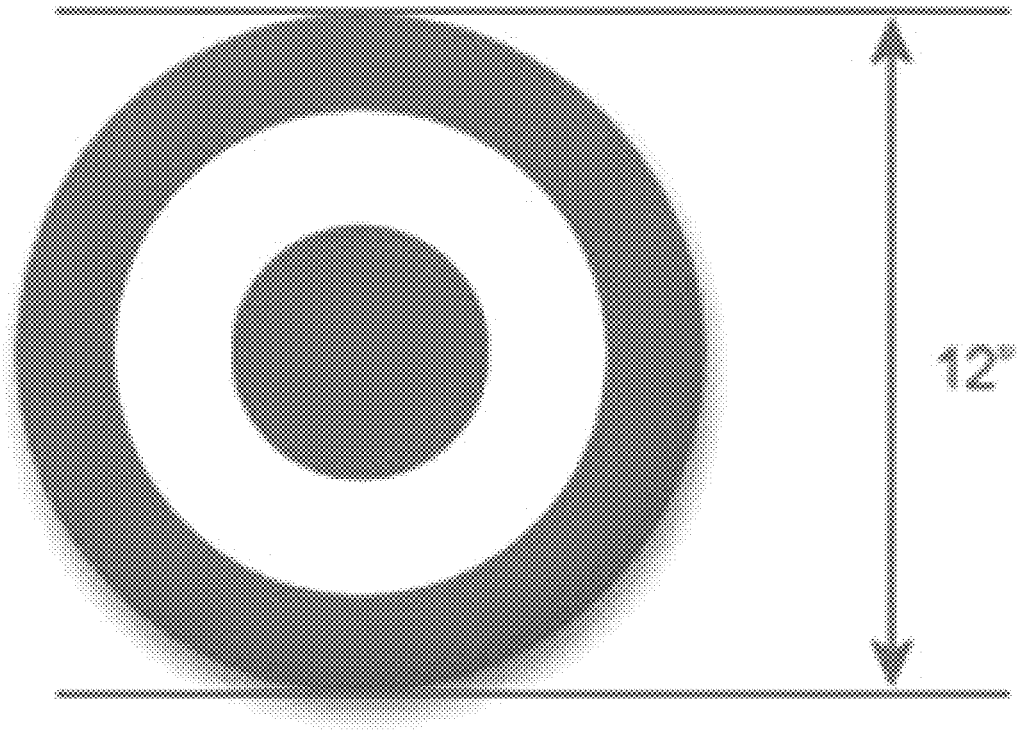
FIG. 20 shows an exemplary 12" target.

A first step, for example, is to locate a 12" target, a 12" portion of a target, or 12" object near the target as is commonly used in training and competition. (FIG. 20)

Figure 21:
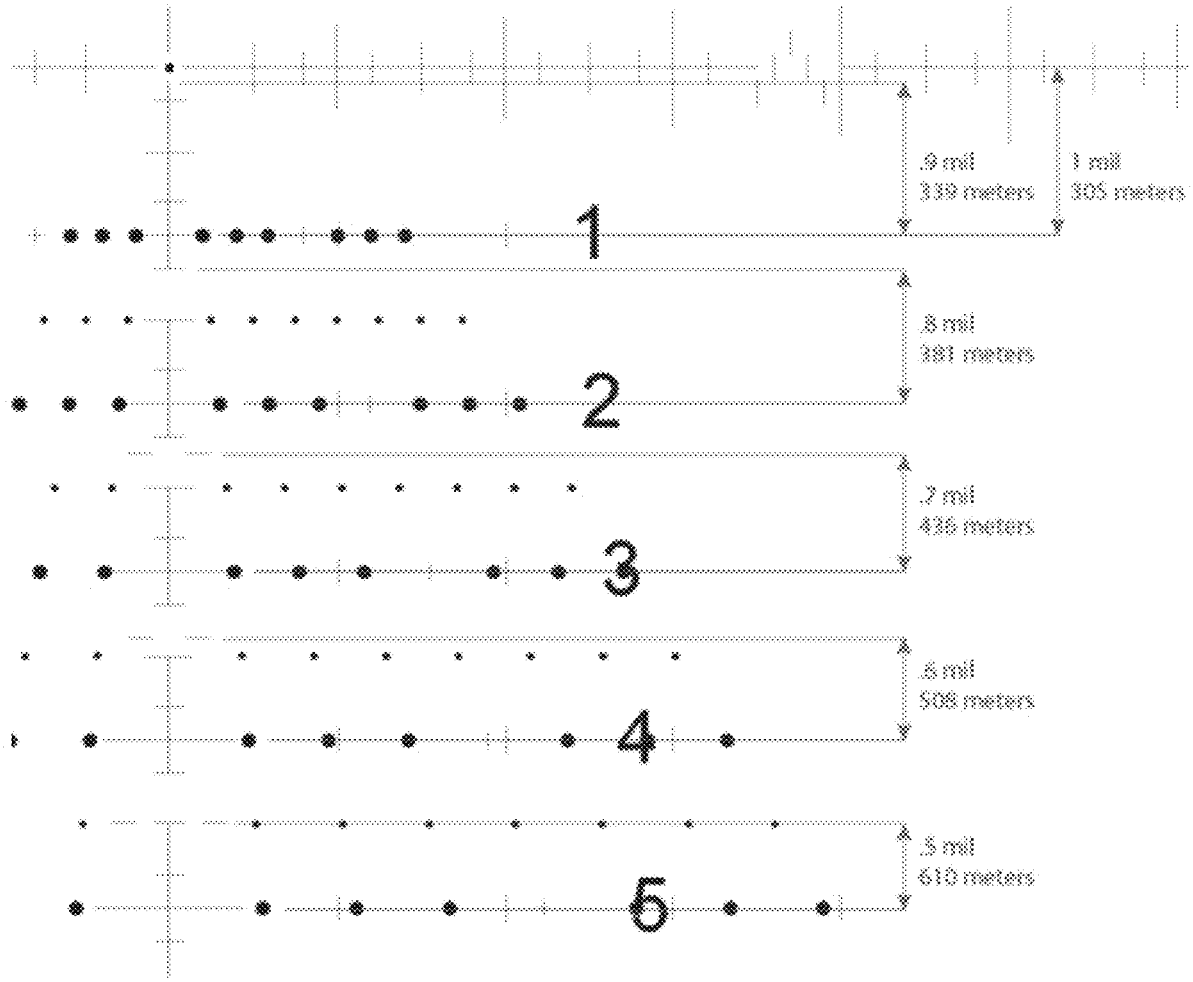
FIG. 21 shows five drop finder markings of reticles of the present invention.
Figure 22A:
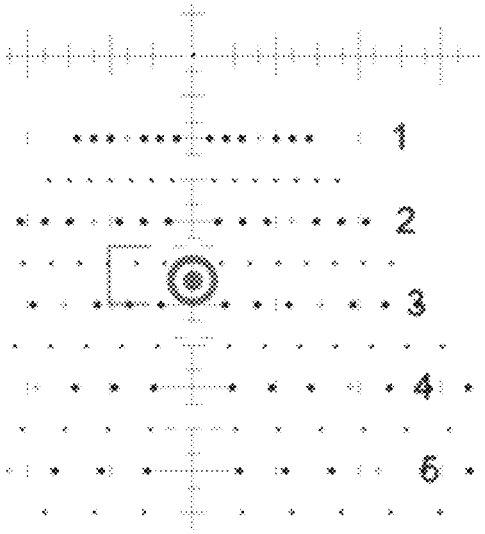
FIG. 22A shows an exemplary location of a target upon a secondary horizontal cross-hair.
Figure 22B:
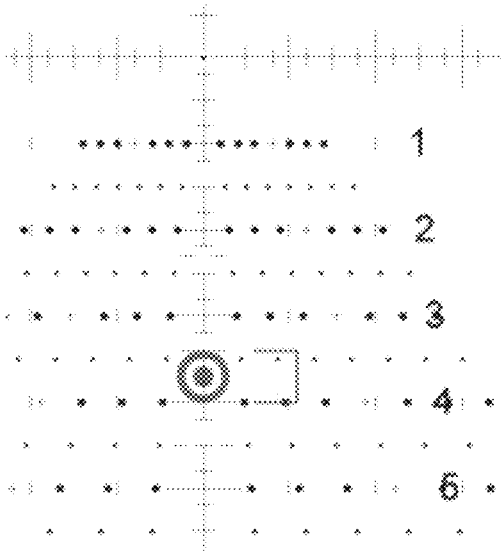
FIG. 22*b* shows an exemplary location of a target upon a secondary horizontal cross-hair.

In a second step, the target is bracketed. In some embodiments, reticles of the present invention comprise a speed-shooting drop finder consisting of five separate drop-finder markers embedded into the reticle's primary horizontal and vertical cross-hairs at drop lines 1 through 5. In certain embodiments, the baseline of each marker perfectly aligns with its corresponding drop line, and that the markers range in descending heights i.e., 1.0 mil, 0.9 mil, 0.8 mil, 0.7 mil. 0.6 mil, and 0.5 mil. The speed-shooting drop finder provides distance to a target that can be estimated if a target's real-world dimensions and the number of mils it subtends within a reticle at a given distance are known. In some embodiments of the present invention, Accuracy First Speed Shooting Formula's calculations for 12" targets, appropriately sized drop-finder markers are place at drop lines 1 through 5. To a range 600 meters, this method provides improved accuracy compared to traditionally-milled aiming point. FIG. 21 shows five drop-finder markers in an exemplary reticle of the present claims. The marker's mil height is indicated along with the corresponding target distance. The 1.0 mil marker and 0.9 mil marker both correspond to the 1.0 mil drop line. The 1.0 mil drop marker extends from the 1.0 mil drop line upwards to the reticle's primary horizontal cross-hair. The 0.9 mil drop line begins at the same 1.0 mil drop line, but only extends upward to the beginning of the reticle's primary vertical cross-hair, and does not include the 0.1-mil blank space beneath the reticle's center aiming dot. To determine which drop line to hold upon, the sized marker is identified which most closely brackets the 12" target. To do so, the target's bottom edge is placed along a drop line. If the marker is too tall for the target, the shooter move down to a lower drop line for a smaller marker. On the other hand, if the target is too tall for the marker, the shooter moves to a higher drop line for a taller marker. The further away a 12" target is located, the smaller it appears within a reticle. In some embodiments, in reticles of the present invention the drop-finder markings become smaller as the drop lines progress downward, for example, the drop-finder marker at drop-line 3 (i.e., secondary horizontal cross-hair 3) is smaller than the marker at drop-line 2 (i.e., secondary horizontal cross-hair 2). Hence, targets farther away which appear smaller within the reticle fit more snugly within the smaller drop-finder markers at lower drop lines (i.e., secondary horizontal cross-hairs). Conversely, larger targets fit more snugly at higher drop lines (i.e., secondary horizontal cross-hairs). For example we'll assume a target is best bracketed by the drop-finder marker resting on the 4-mil drop line/secondary horizontal cross-hair. FIG. 22 shows the process of locating a target's correct drop line. In FIG. 22A, the round 12" target is too short to fit snugly beneath the selected marker. In FIG. 22B the shooter moves downward, trying the marker at the next drop line, and finds that it's a snug fit. Thus the shooter has located the correct drop-hold line.

Figure 22C:
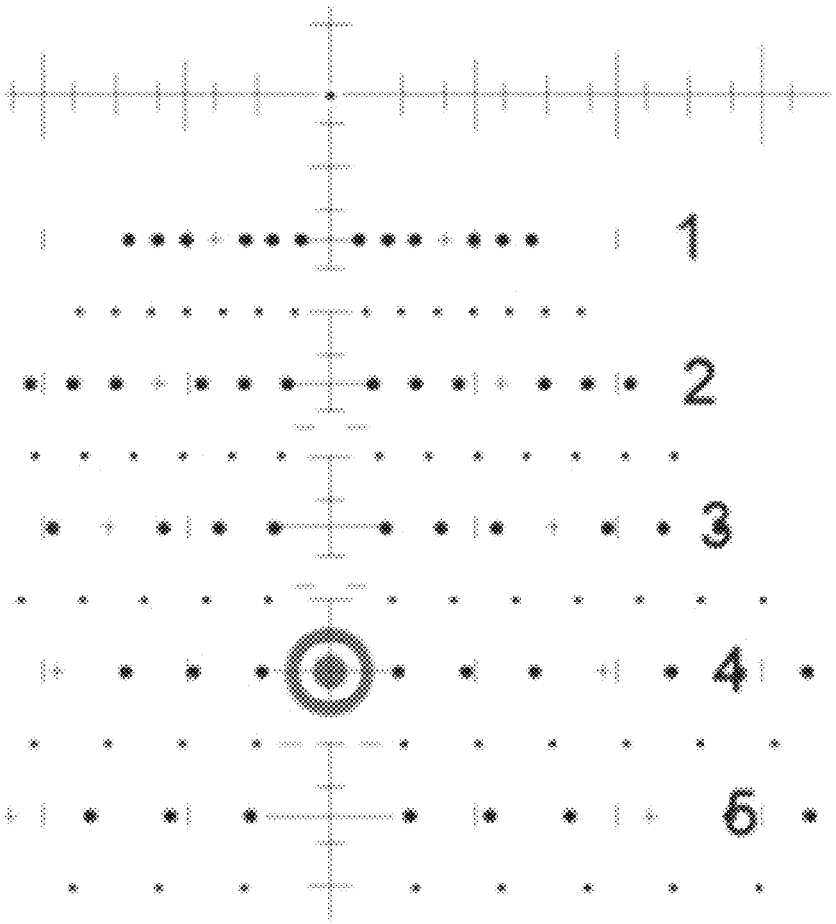
FIG. 22C shows repositioning to center a target directly upon a secondary horizontal cross-hair.

In a third step the target is centered. Having determined which drop-finder marker best brackets a target of interest the target is centered behind the drop line upon which the target was resting. For our example: repositioning the target slightly, it is centered behind the 4-mil drop line as shown in FIG. 22C. FIG. 22C shows the slight repositioning required to center a target directly behind the 4-mil drop line.

Figure 23A:
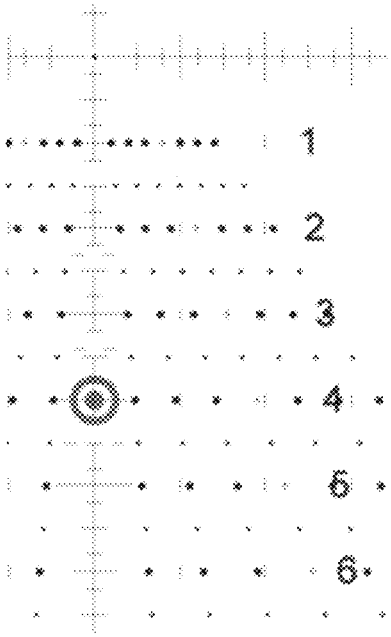
FIG. 23A shows an adjustment needed using an XM2010 weapon system and a reticle of the present invention.
Figure 23B:
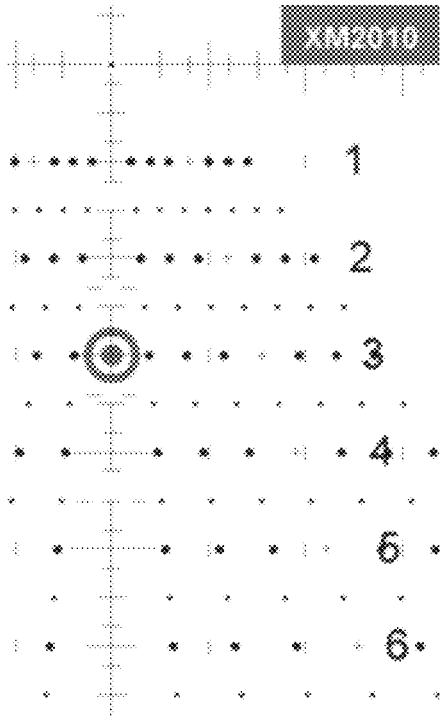
FIG. 23B shows an adjustment needed using an XM2010 weapon system and a reticle of the present invention.

An exemplary fourth step provides a drop adjustment after centering a target. For example, using an XM2010 weapon system, to achieve a center mass hit, a 1 mil-line adjustment upward is needed if a target is best bracketed along any drop line from 2 through 5. In some embodiments, the only XM2010 drop hold not requiring adjustment is for targets best bracketed on the 1-mil drop line. In FIG. 23A a 12" target is shown centered behind a 4-mil drop line. In FIG. 23B a 1.0 mil upward adjustment required when using an XM2010 weapon system is shown. In some embodiments this upward adjustment is required for targets best bracketed on any drop line 2 through 5, but no adjustment is required for a target best bracketed on the 1.0 mil drop line.

Figure 24A:
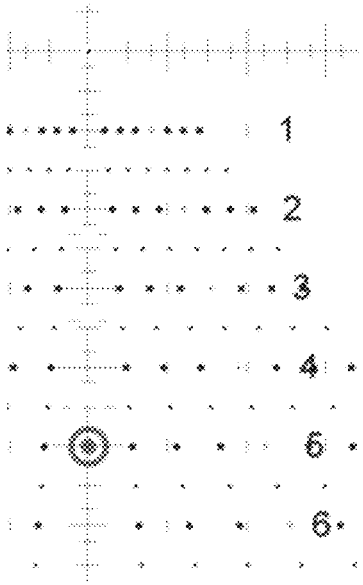
FIG. 24A shows an adjustment needed using an SPR weapon system and a reticle of the present invention.
Figure 24B:
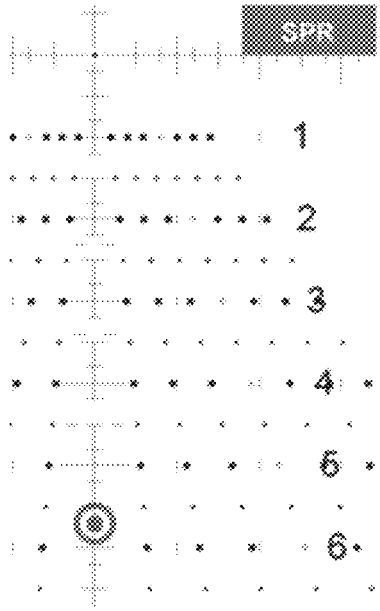
FIG. 24B shows an adjustment needed using an SPR-weapon system and a reticle of the present invention.

For example, using an SPR weapon system, adjustment is needed only if a target is best bracketed along the 5-mil drop line. In that case, a 0.7-mil downward adjustment is required for a center mass hold. FIG. 24A shows a 12" target centered behind the 5-mil drop line. FIG. 24B shows a 0.7-mil downward adjustment required for targets best bracketed on the 5-mil drop line. No other targets require adjustment with SPR.

Figure 25A:
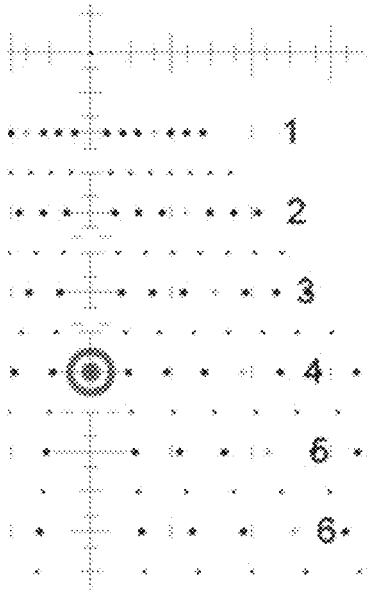
FIG. 25A shows an adjustment needed using an M110 weapon system and a reticle of the present invention.
Figure 25B:
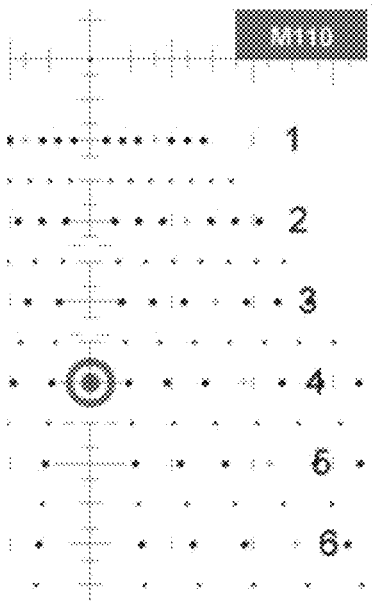
FIG. 25B shows that no adjustment is needed using an XM2010 weapon system and a reticle of the present invention compared to FIG. 25A.

For example, using an M110 weapons system, no adjustments are required. FIG. 25A shows a 12" target centered behind the 4.0 mil drop line. FIG. 25B shows that no change is required since the M110 weapon system requires no adjustments whatsoever.

Figure 26:
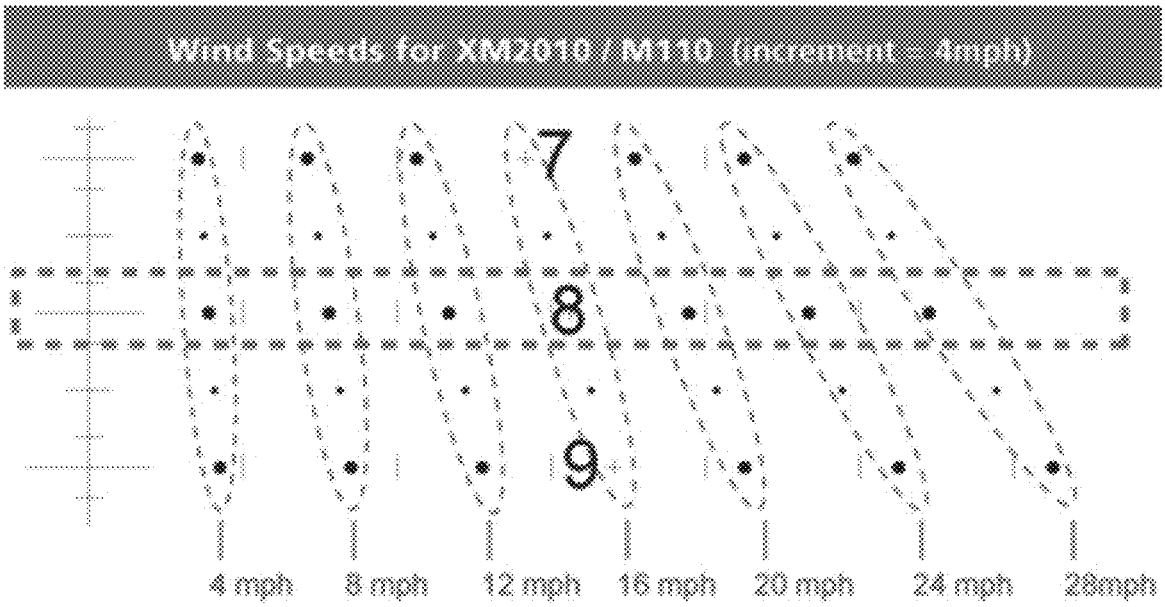
FIG. 26 shows miles per hour (mph) values for the 8-mil secondary horizontal cross-hair (drop line) in a reticle of the present invention.
Figure 27:
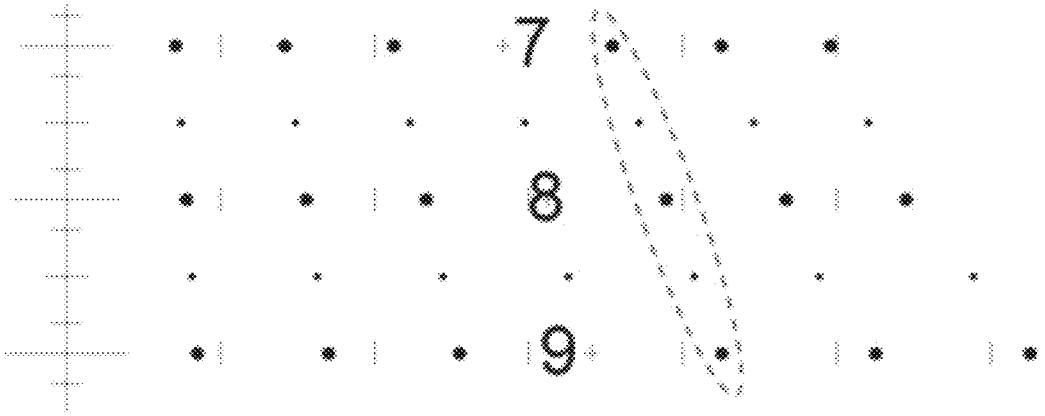
FIG. 27 shows the 20 mph wind-speed holds for an M110 weapon system using a reticle of the present invention.

In some embodiments, reticles of the present invention provide rapid windage adjustments for targets to 600 meters. In certain embodiments, speed-shooting wind markers are embedded into secondary horizontal cross-hairs descending from the reticle's primary horizontal cross-hair to the 10-mil drop line. A first step is to determine the wind speed in, for example, miles per hour. For our example, assume a 20-mph wind from the right. A second step is to locate the corresponding wind marker. In preferred embodiments, secondary horizontal cross-hairs (drop hold lines) 1 through 9 each contain a series of 14 speed-shooting windage markers, seven for right corrections, and seven for left corrections. For M110 and XM2010 weapon systems, each marker represents a 4 mile-per-hour increment. Hence, the first wind marker designates 4 mph, the second 8 mph, the third 12 mph, the 4th 16 mph, and so on to the 7th marker which designates 28 mph. For SPR weapons systems, each marker corresponds to 3 mph. For a M107 weapon system, each marker corresponds to 5 mph. Due to changes in density altitude, it may be necessary to re-calibrate wind-speed increments using, for example, a Kestrel wind speed indicator to calibrate speed increments for specific shooting settings. In some embodiments, wind-speed correction dots are provided on and between drop-hold/secondary horizontal cross-hairs lines 1-9. In FIG. 26, mph values for the 8-mil drop line are shown in the thick dashed box. Actual mph values may vary depending on the chosen weapon system and shooting conditions. As indicated by the dashed ovals, the same wind-speed values are applied onto each drop hold line. For example with a wind speed of 20 mph from the right, and a M1110 weapon system, the 5th windage marker to the right is selected. FIG. 27 shows the 20 mph wind-speed holds for a M110 weapons system.

Figure 28:
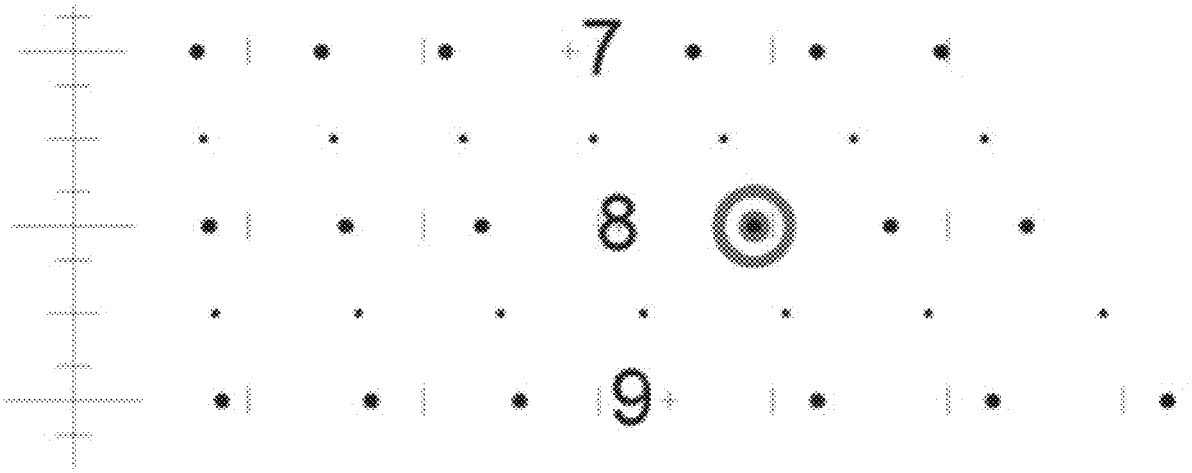
FIG. 28 shows an exemplary elevation hold using the $5^{th}$ wind speed marker of a reticle of the present invention.
Figure 29:
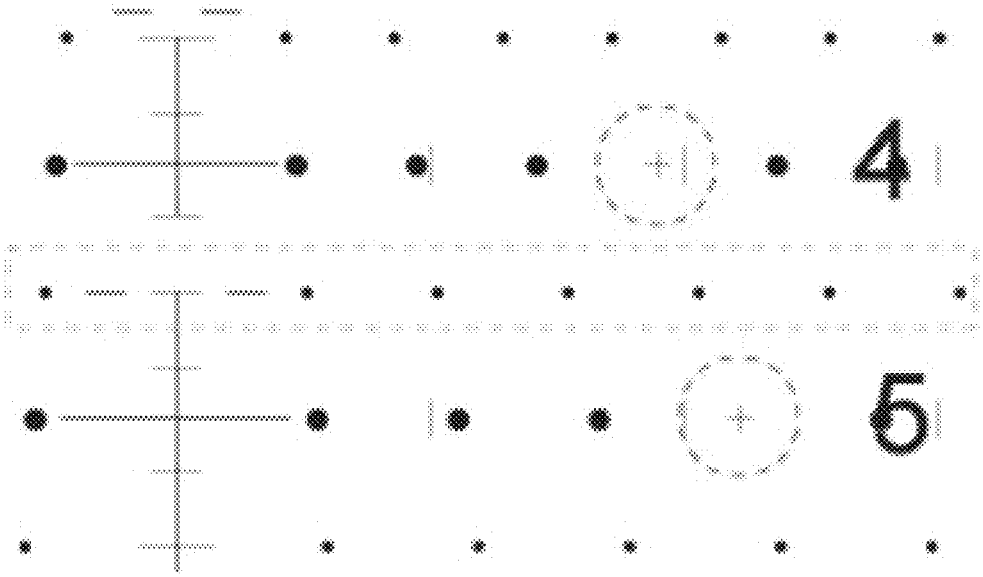
FIG. 29 shows a $4^{th}$ wind-speed marker in each series designated by a cross rather than a dot in a reticle of the present invention.

A third step is to place the target at the correct hold on the reticle. Assuming an elevation correction at the 8th secondary horizontal cross-hair, the 5th wind-speed marker in the 8th drop line is place over the target. (FIG. 28) In the present example, an elevation hold at the 8th drop line is selected, and the 5th wind-speed marker as determined in step 2 above is used. In some embodiments, the 4th marker in a series is represented by a cross, instead of a dot, to make counting faster and easier. In other embodiments, series are provided between drop-lines, at 0.5 mil vertical increments. FIG. 29 shows that the 4th wind-speed marker in each series, circled in red, may in certain embodiments be designated by a cross rather than a dot thereby providing fast and intuitive counter marking. In other embodiments a series of smaller wind markers appear half-way between each drop line (shown in dashed rectangle), providing wind holds at 0.5 mil drop increments.

Figure 30:
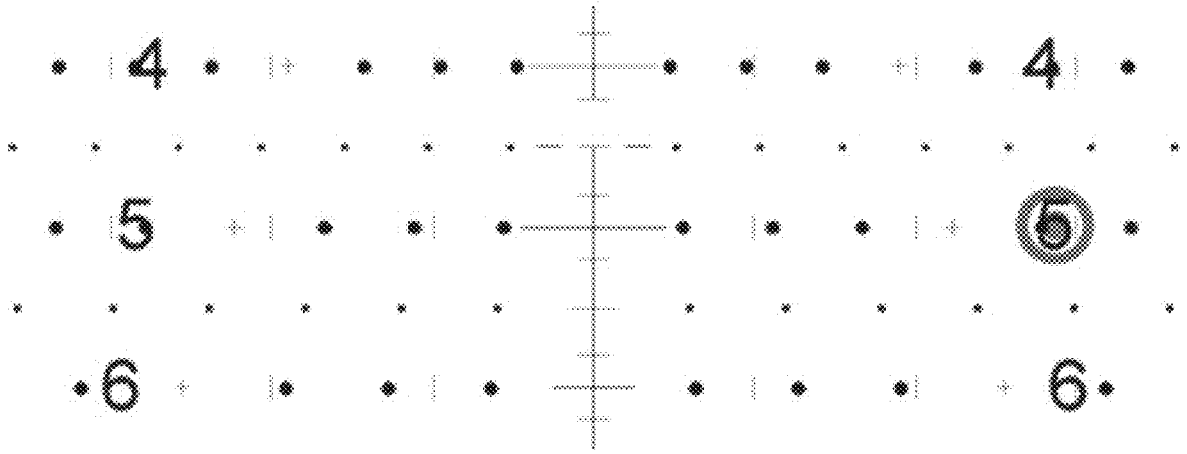
FIG. 30 shows a target positioned on the 5.0 mil secondary horizontal cross-hair for a target moving at 4 mph from the left on a reticle of the present invention.

In some embodiments, numbers used to designate secondary horizontal cross-hairs 1 through 9 are compressed on top of mil markers comprise hold points for targets moving at 4 mph. FIG. 30 shows a target positioned on the 5-mil secondary horizontal cross-hair for a target moving at 4 mph from the left.

Figure 31:
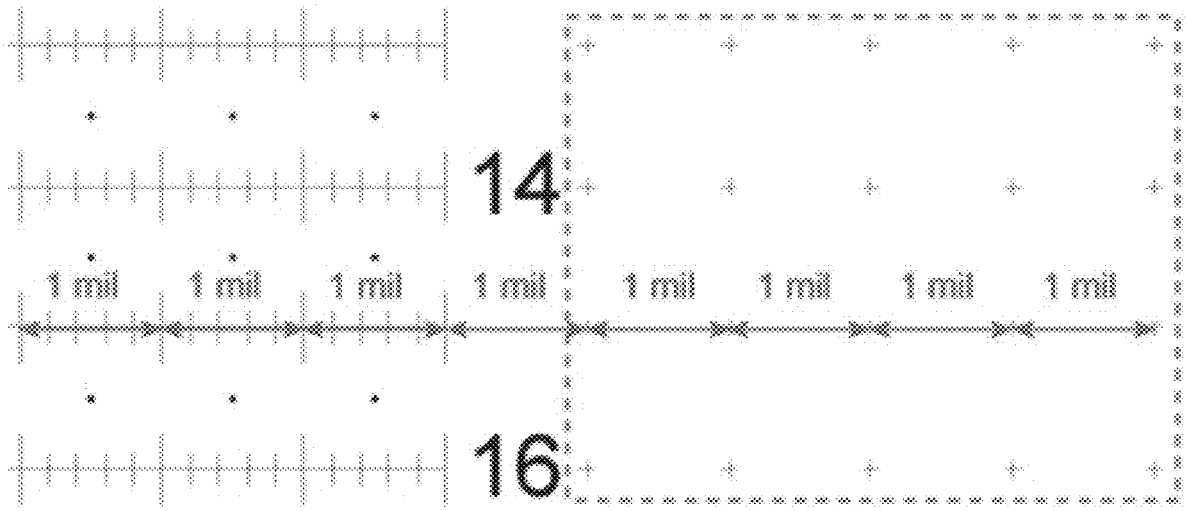
FIG. 31 shows crosses to proved hold points in 1.0 mil increments beyond an aiming grid.

In some embodiments, holdover (elevation) crosses extend the aiming grid in 1.0 mil increments, providing more hold markings without obscuring the shooter's sight picture view. In other embodiments, reticles of the present invention provide clear, uncluttered crosses to as additional hold points in 1.0 mil increments beyond the aiming grid as shown in FIG. 31. These provide additional hold guides for both elevation and windage.

Figure 32:
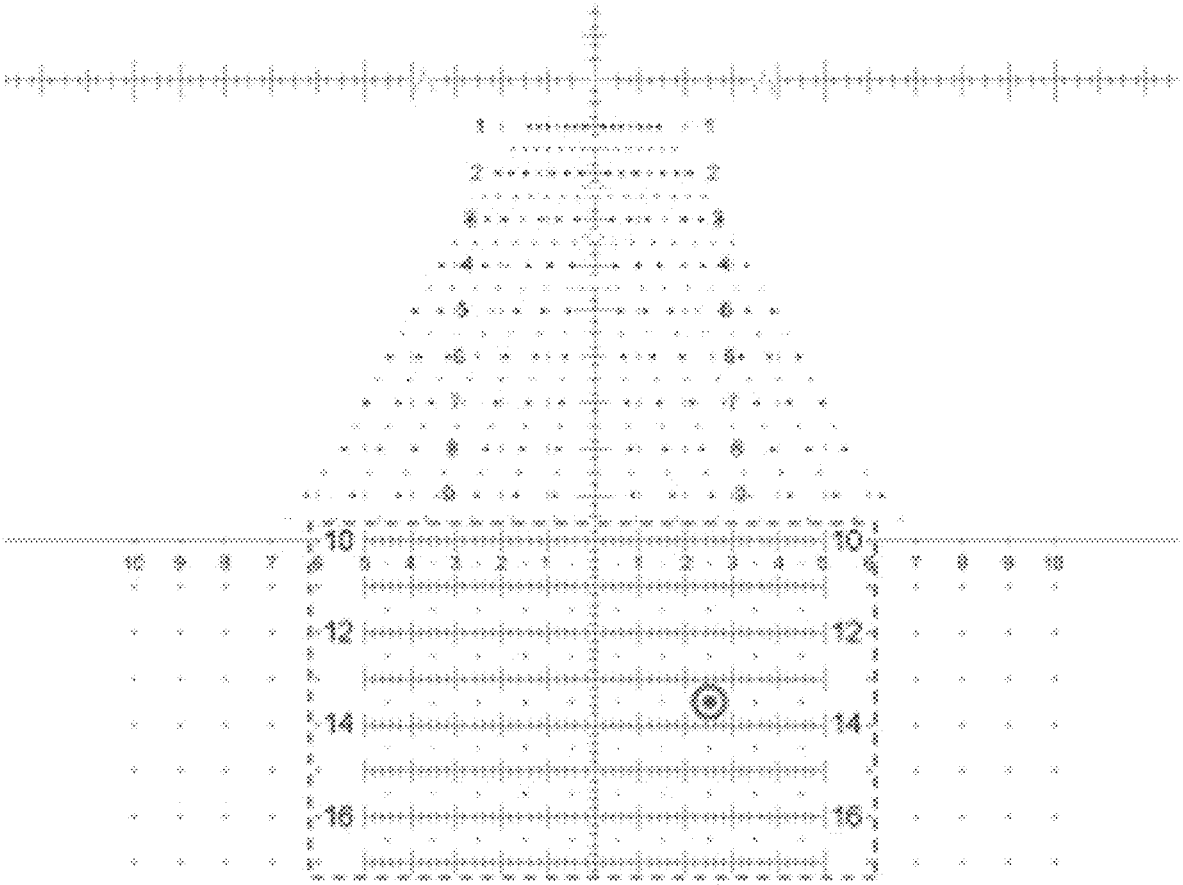
FIG. 32 shows a reticle of the present invention with an aiming grip and target placed for an adjustment of 13.5 mils down and 2.5 mils right.

In some embodiments, reticles of the present invention provide an aiming grid as shown, for example, in FIG. 32. In certain embodiments, the aiming grid eliminates the need to adjust windage or elevation knobs. The aiming grid may be used to mil targets and place aiming points at any range. FIG. 32 shows an aiming grid delineated by the dashed box. In this example, the target is placed for an adjustment of 13.5 mils down and 2.5 mils right.

Figure 33:
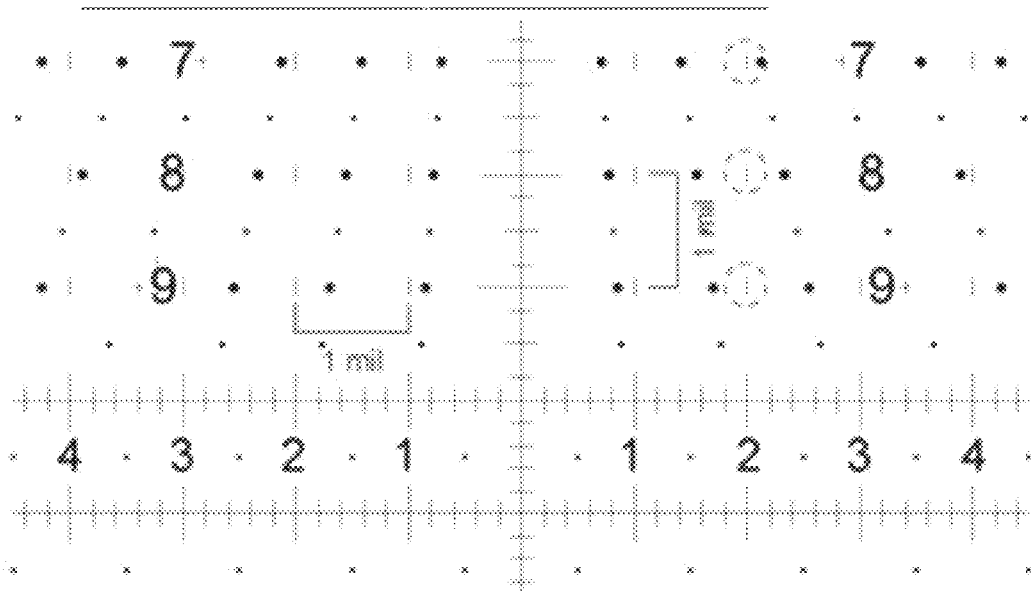
FIG. 33 shows mil markers represented by thin vertical hash marks spaced in 1.0 mil increment through secondary horizontal cross-hairs 1 through 9 of a reticle of the present invention.

In some embodiments, further mil markers are placed throughout secondary horizontal cross-hairs 1 through 9. Similar to holdover crosses described above, the mil markers extend the aiming grid up to the reticle's primary horizontal cross-hair, without obscuring the view. In further embodiments, the markers are 0.15 mils tall, and may be used for milling targets in addition to placing holds. In preferred embodiments, mil markers are represented by thin vertical hash marks spaced in 1.0 mil increments throughout secondary horizontal cross-hairs 1 through 9. FIG. 33 shows three exemplary markers within circles.

All publications and patents mentioned in the above specification are herein incorporated by reference. Various modifications and variations of the described compositions and methods of the invention will be apparent to those skilled in the art without departing from the scope and spirit of the invention. One skilled in the art will recognize at once that it would be possible to construct the present invention from a variety of materials and in a variety of different ways. Although the invention has been described in connection with specific preferred embodiments, it should be understood that the invention should not be unduly limited to such specific embodiments. While the preferred embodiments have been described in detail, and shown in the accompanying drawings, it will be evident that various further modification are possible without departing from the scope of the invention as set forth in the appended claims. Indeed, various modifications of the described modes for carrying out the invention which are obvious to those skilled in marksmanship, computers or related fields are intended to be within the scope of the following claims.

We claim:

1. A reticle, comprising:

a) a first interrupted horizontal cross-hair;

b) a first interrupted vertical cross-hair that intersects said first interrupted horizontal cross-hair at a point that said first interrupted horizontal cross-hair and said first interrupted vertical cross-hair intersect if linearly connected along their lengths, wherein the intersection of said first interrupted vertical cross-hair and said first interrupted horizontal cross-hair comprises a gap and a central dot, wherein said central dot is a solid central dot within said gap;

c) a plurality of evenly spaced second vertical lines that contact or intersect said first horizontal cross-hair to the right and to the left of said first vertical cross-hair;

d) three or more third vertical lines that contact or intersect said first horizontal cross-hair between two of said evenly spaced second vertical lines, wherein three or more of said three or more third vertical cross-hairs that contact or intersect said first horizontal cross-hair are spaced at predetermined even spaces, wherein three or more of said plurality of evenly spaced second vertical lines that contact or intersect said first horizontal cross-hair to the right and to the left of said first vertical cross-hair are of graduated length, wherein three or more of said plurality of evenly spaced second vertical lines that contact or intersect said first horizontal cross-hair to the right and to the left of said first vertical cross-hair of graduated length are graduated in length in a pattern replicated to the user's left and to the user's right of the intersection of said first horizontal cross-hair and said vertical cross-hair;

e) three or more second horizontal lines on said first vertical cross-hair above said intersection of said first horizontal cross-hair and said first vertical cross-hair, wherein two or more of said three or more second horizontal lines on said first vertical cross-hair above said intersection of said first horizontal cross-hair and said first vertical cross-hair are of unequal length, wherein three or more of said three or more second horizontal lines on said first vertical cross-hair above said intersection of said first horizontal cross-hair and said first vertical cross-hair are spaced at predetermined even spaces;

f) four or more second horizontal cross-hairs of graduated length on said first vertical cross-hair at predetermined distances below said intersection of said first horizontal cross-hair and said first vertical cross-hair wherein at least one of said second horizontal cross-hairs is an interrupted straight line comprising two or more gaps; and g) four or more second horizontal cross-hairs of identical length on said first vertical cross-hair at predetermined distances below said intersection of said first horizontal cross-hair and said first vertical cross-hair wherein at least one of said second horizontal cross-hairs is an interrupted straight line comprising two or more gaps, wherein said four or more second horizontal cross-hairs of identical length on said first vertical cross-hair below said intersection of said first horizontal cross-hair and said first vertical cross-hair are below said four or more second cross-hairs of graduated length on said first vertical cross-hair at predetermined distances below said intersection of said first horizontal cross-hair and said first vertical cross-hair.

2. The reticle of claim 1, wherein said first horizontal cross-hair is a line.

3. The reticle of claim 2, wherein said first horizontal cross-hair line is a straight line.

4. The reticle of claim 1, wherein said first horizontal cross-hair has a predetermined thickness.

5. The reticle of claim 4, wherein said predetermined thickness is a single thickness along said first horizontal cross-hair.

6. The reticle of claim 1, wherein said first vertical cross-hair is a line.

7. The reticle of claim 6, wherein said first vertical cross-hair line is a straight line.

8. The reticle of claim 1, wherein said first vertical cross-hair has a predetermined thickness.

9. The reticle of claim 8, wherein said predetermined thickness is a single thickness along said first vertical cross-hair.

10. The reticle of claim 1, wherein at least one of said interrupted straight line second horizontal cross-hairs is interrupted at a predetermined distance.

11. The reticle of claim 10, wherein said predetermined distance is an evenly spaced predetermined distance.

12. The reticle of claim 11, wherein said evenly spaced predetermined distance is a different evenly spaced predetermined distance between two or more said second horizontal cross-hairs.

13. The reticle of claim 1, comprising two or more second vertical cross-hairs at predetermined distances on at least one of said second horizontal cross-hairs, wherein an intersection or contact of at least one of said two or more second vertical cross-hairs and at least one of said second horizontal cross-hairs provides an aiming point.

14. The reticle of claim 13, wherein at least one of said two or more second vertical cross-hairs is an uninterrupted straight line.

15. The reticle of claim 13, wherein at least one of said two or more second vertical cross-hairs is a predetermined thickness.

16. The reticle of claim 15, wherein said predetermined thickness is a single thickness along said at least one of said two or more second vertical cross-hairs.

17. The reticle of claim 13, wherein at least one of said two or more second vertical cross-hairs is shorter in length than said first vertical cross-hair.

18. The reticle of claim 13, wherein a plurality of said two or more second vertical cross-hairs are evenly spaced.

19. The reticle of claim 1, wherein at least one of said second horizontal cross-hairs is identified by a number.

* * * * *